US009359744B2

(12) United States Patent
Clendenning et al.

(10) Patent No.: US 9,359,744 B2
(45) Date of Patent: Jun. 7, 2016

(54) MULTIPIECE WEAR ASSEMBLY

(71) Applicants: Charles Clendenning, Broken Arrow, OK (US); Russell N. Drake, Claremore, OK (US); Brian L. Launder, Tulsa, OK (US)

(72) Inventors: Charles Clendenning, Broken Arrow, OK (US); Russell N. Drake, Claremore, OK (US); Brian L. Launder, Tulsa, OK (US)

(73) Assignee: H&L TOOTH COMPANY, Tulsa, OK (US)

( * ) Notice: Subject to any disclaimer, the term of this patent is extended or adjusted under 35 U.S.C. 154(b) by 0 days.

(21) Appl. No.: 13/729,888

(22) Filed: Dec. 28, 2012

(65) Prior Publication Data

US 2014/0182174 A1 Jul. 3, 2014

Related U.S. Application Data

(63) Continuation-in-part of application No. 12/806,010, filed on Aug. 4, 2010, now Pat. No. 8,347,530.

(51) Int. Cl.
*E02F 9/28* (2006.01)

(52) U.S. Cl.
CPC ..... *E02F 9/2883* (2013.01); *E02F 9/2833* (2013.01); *E02F 9/2858* (2013.01); *E02F 9/2891* (2013.01)

(58) Field of Classification Search
CPC ..... E02F 9/2825; E02F 9/2833; E02F 9/2841
See application file for complete search history.

(56) References Cited

U.S. PATENT DOCUMENTS

| | | | | |
|---|---|---|---|---|
| 1,485,879 | A | | 3/1924 | Page |
| 1,620,132 | A | | 3/1927 | Psilander |
| 2,259,456 | A | | 10/1941 | Crawford |
| 3,312,004 | A | | 4/1967 | Johnson |
| 3,371,437 | A | | 3/1968 | Wilson et al. |
| 3,462,861 | A | * | 8/1969 | Kampert ..... 37/453 |
| 3,471,954 | A | | 10/1969 | Spivey |
| 3,678,605 | A | | 7/1972 | Prime |
| 3,982,339 | A | | 9/1976 | Nilsson |
| 4,027,408 | A | | 6/1977 | Ramella et al. |
| 4,182,058 | A | | 1/1980 | Poncin |
| 4,187,035 | A | | 2/1980 | Colghum |
| 4,274,678 | A | | 6/1981 | Herridge |

(Continued)

*Primary Examiner* — Matthew D Troutman
(74) *Attorney, Agent, or Firm* — Law Office of John W. Harbst

(57) ABSTRACT

A multipiece wear assembly including an adapter and a wear part. The adapter has a nose portion with a first predetermined configuration. The wear part is assembled onto the adapter nose portion by relative longitudinal movement and defines a blind cavity opening to a rear thereof. The blind cavity of the wear part has a second predetermined configuration. In one form, the second predetermined configuration defined by the blind cavity is greater than the first predetermined configuration defined by the adapter nose portion such that a relief is provided between the adapter nose portion and the blind cavity when the adapter and wear part are arranged in operable combination relative to each other. Lock structure is provided on one of the adapter nose portion and wear part for maintaining the wear part and adapter nose portion in operable combination. In one form, a modular securement member extends generally perpendicular to a longitudinal axis of the tooth assembly with a portion of the securement member filling the relief defined between confronting surfaces on the blind cavity and the adapter nose portion.

15 Claims, 28 Drawing Sheets

(56) References Cited

U.S. PATENT DOCUMENTS

| | | | | |
|---|---|---|---|---|
| 4,880,247 | A | 11/1989 | Herridge | |
| 4,965,945 | A * | 10/1990 | Emrich | 37/456 |
| 5,074,062 | A | 12/1991 | Hahn et al. | |
| 5,152,088 | A * | 10/1992 | Hahn | 37/458 |
| 5,177,886 | A * | 1/1993 | Klett | 37/452 |
| 5,379,535 | A | 1/1995 | Bowes, Jr. | |
| 5,469,648 | A | 11/1995 | Jones et al. | |
| 5,561,925 | A | 10/1996 | Livesay | |
| 5,713,145 | A | 2/1998 | Ruvang | |
| 6,047,487 | A | 4/2000 | Clendenning | |
| 6,247,255 | B1 | 6/2001 | Clendenning | |
| 6,735,890 | B2 * | 5/2004 | Carpenter et al. | 37/456 |
| 6,799,387 | B2 | 10/2004 | Pippins | |
| 6,865,828 | B1 * | 3/2005 | Molino et al. | 37/454 |
| 7,739,814 | B2 * | 6/2010 | Carpenter et al. | 37/450 |
| 8,347,530 | B2 * | 1/2013 | Clendenning et al. | 37/452 |
| 2001/0001352 | A1 * | 5/2001 | Fernandez Munoz et al. | 37/455 |
| 2003/0005606 | A1 * | 1/2003 | Carpenter et al. | 37/452 |
| 2003/0140531 | A1 | 7/2003 | Pippins | |
| 2006/0059732 | A1 | 3/2006 | Clendenning | |
| 2006/0236567 | A1 | 10/2006 | Adamic | |
| 2006/0265916 | A1 * | 11/2006 | Carpenter et al. | 37/452 |
| 2008/0000114 | A1 | 1/2008 | Bentley | |
| 2008/0201997 | A1 | 8/2008 | Armstrong | |
| 2011/0030248 | A1 * | 2/2011 | Clendenning et al. | 37/456 |
| 2011/0107624 | A1 * | 5/2011 | Carpenter et al. | 37/456 |
| 2012/0246982 | A1 * | 10/2012 | Bentley | 37/456 |

* cited by examiner

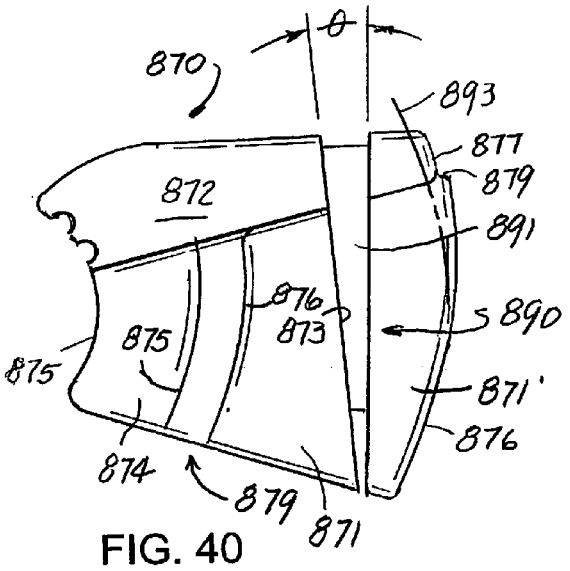
FIG. 40
FIG. 41
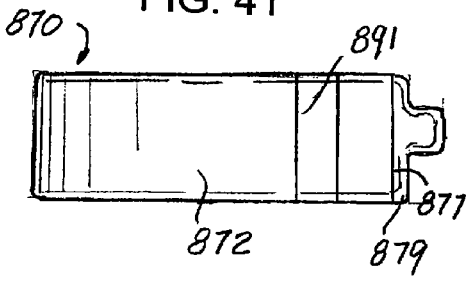
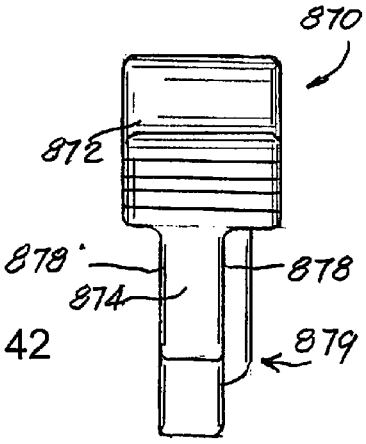
FIG. 42
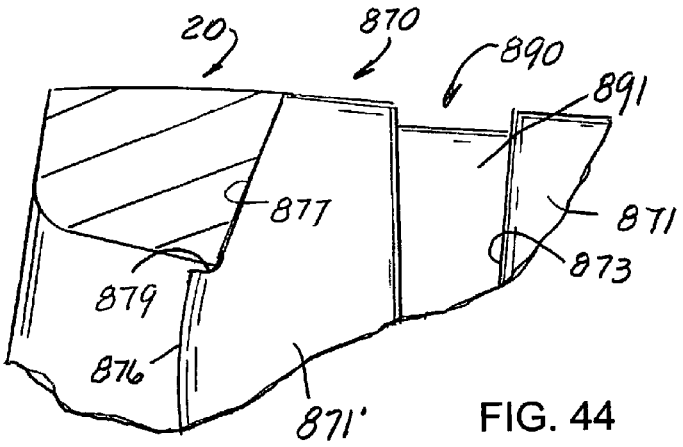
FIG. 44

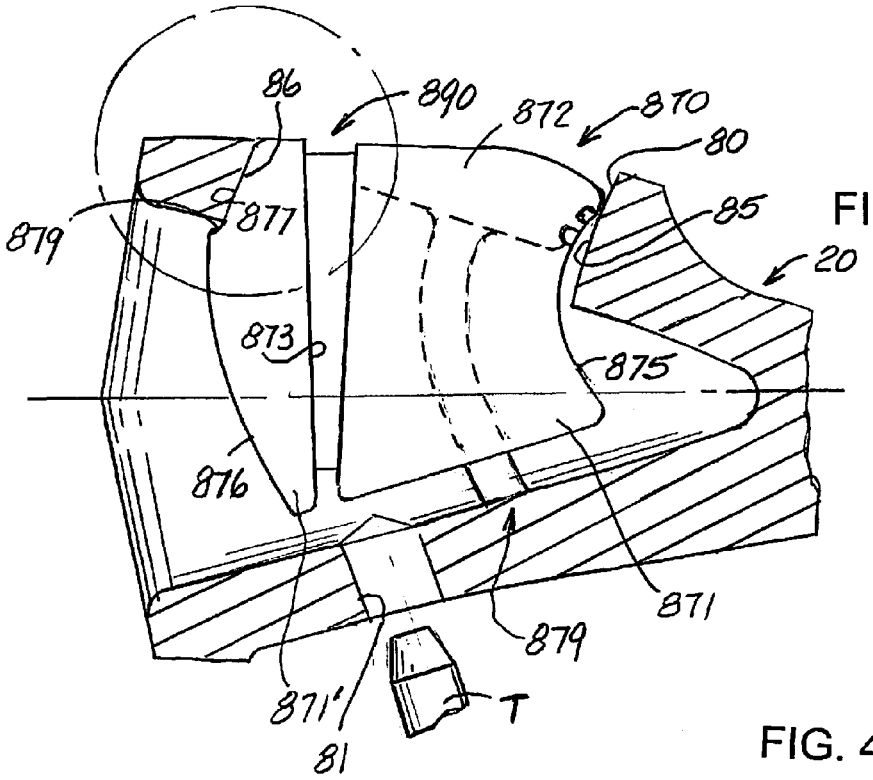
FIG. 43
FIG. 46
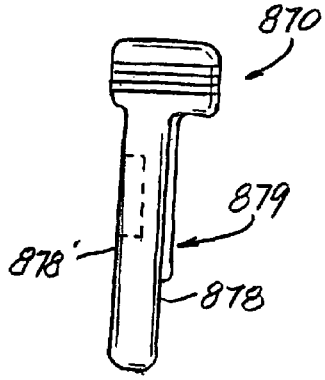
FIG. 45
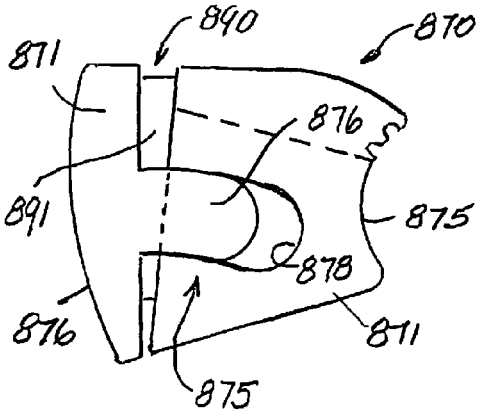
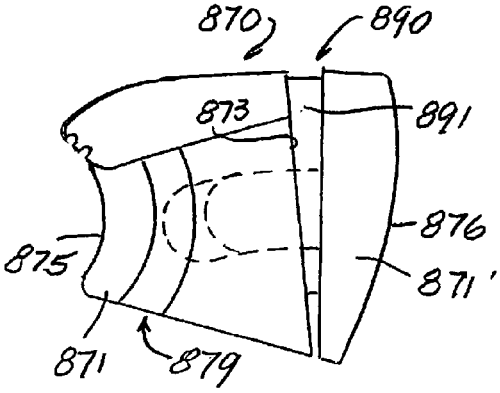
FIG. 47

MULTIPIECE WEAR ASSEMBLY

CROSS REFERENCE TO RELATED APPLICATIONS

This application is a continuation-in-part patent application of U.S. patent application Ser. No. 12/806,010 filed Aug. 4, 2010 and is based on and claims the benefit of coassigned provisional U.S. patent application Ser. No. 61/273,547 filed Aug. 5, 2009.

FIELD OF THE INVENTION DISCLOSURE

This invention disclosure generally relates to a multipiece wear assembly and, more specifically, to a wear assembly including an adapter and a wear part arranged in releasably coupled relation relative to each other.

BACKGROUND

Excavating or digging equipment used in mining, construction and a myriad of other ground engaging operations typically includes a series of spaced apart wear assemblies which project forward and serve to break up material to be gathered into a bucket of such digging equipment. Such wear assemblies are typically arranged in side-by-side and horizontally adjacent relation relative to each other.

Such wear assemblies can take a myriad of shapes and sizes. As used herein, the phrases "tooth" and "wear part" are intended to include lip protectors, lip shrouds, rippers and other ground engaging tools including, but not limited to, ground engaging teeth. For exemplary purposes, this invention disclosure is illustrated and described for use with a two-piece ground engaging tooth assembly. As mentioned, however, the present invention is equally applicable to other ground engaging equipment releasably secured to an edge or lip of a bucket or related digging equipment.

The art recognized long ago the advantages to be gained by constructing each assembly as a two-part system. That is, the art recognized the advantages to be obtained by connecting a tooth or tool to an adapter or support which, in turn, is connected to the bucket of excavating equipment. Typically, the adapter or support is provided with a base portion which is configured for attachment to the forward edge or lip of a bucket and a free ended nose portion. The wear part or tooth is typically provided with a blind cavity or socket whereby allowing such part to longitudinally fit over and along at least a lengthwise section of the adapter nose portion. The size of the adapter and wear part vary depending upon the particular digging application. Various types of pinning systems have been used to releasably interconnect the wear part and adapter in operable combination relative to each other.

In some operations, such multipiece assemblies are subjected to highly abrasive conditions and, thus, experience considerable and rapid wear. Unless the conjuncture between the component parts is properly fitted, wear problems, especially in the socket or cavity of the replacement part and along the nose portion of the adapter, can result. Moreover, the relatively high forces developed during some digging operations furthermore add to the rapid wear of the component parts of the tooth assembly. Additionally, the pinning systems used to interconnect the tooth and adapter can be harmed or even destroyed by excessive loading in field applications which can result in inadvertent separation of the tooth from the adapter nose portion.

Besides wear in the socket or cavity area of the replacement part or tooth, the adapter nose portion can also become worn from use in the field. Accordingly, and when a new replacement part is fitted to a worn nose portion of an adapter, clearances can exist between the adapter nose portion and the digging tooth. As a result, there can be significant movement between the new replacement part and the nose portion of the adapter. This movement furthermore wears on the nose portion of the adapter and increases the loads upon conventional pinning systems due to excessive tooth movements.

In service, and although specific steps can be taken during fabrication of the wear part to prolong their usefulness, a forward cutting edge of the replacement part sometimes quickly wears and become dull and, thus, inefficiencies in the digging operation develop thereby requiring replacement of such parts. As mentioned, the two-part construction of such an assembly advantageously allows the wear part or tooth to be replaced independent of the adapter. Depending upon conditions, an adapter can be successfully equipped with anywhere from five to thirty replacement parts to maintain a sharp penetrating edge for the assembly. In the field, replacement of worn parts is a common and sometimes a daily experience.

Removing or separating a worn or otherwise broken wear part from its support can involve a tedious and often difficult manual task of pounding or prying an elongated retaining pin from registering apertures in the wear part and adapter. Removal of the retaining pin is typically effected by using a hammer to manually endwise force the retaining pin from the apertures in the wear part and adapter. Of course, with larger assemblies, the retaining pins are proportionately sized larger thereby adding to the effort and, thus, increasing the time and expense involved to effect replacement and/or repair of the wear part. Problems involving the hammer missing the punch or other tool used to pound the retaining pin and hitting the hand of the operator are well known. Dangerous splintering of the metal parts used to drive the retaining pin from between the worn part and adapter can also result. Of course, similar problems exist when the retaining pin is again pounded into the apertures to effect reattachment of the replacement part to the adapter. The unavailability of appropriate tools, i.e., hammers and punches, in the field is also a consistent and well known problem.

Many multipiece assemblies arrange the retaining pin along a generally horizontal axis. When the assemblies are mounted in side-by-side proximate relation relative to each other across the bucket edge, however, the horizontal disposition of the retainer pin for each assembly only adds to the time and effort required to initially remove the pin, whereby allowing for removal/repair of the worn/broken part of the two-part system and, subsequent reinsertion of the pin into the registered apertures in the replacement part and adapter. Some operators utilize specially designed tools to facilitate removal of the horizontal pins.

It is also known to arrange the retaining pin in a generally vertical orientation. While advantageously enhancing access to the retaining pin, such retaining devices are more susceptible to the forces applied thereto as a result of the generally vertical movements of the bucket during a digging/excavating operation. Moreover, with a vertically oriented pin system, the lower hole or aperture in the replacement part of the two-part digging system is more exposed—as compared to a horizontal pinning system—to the ground surface over which the digging implement or bucket moves during a digging operation.

Typically, changing to a unique tooth design can create considerable hardship on original equipment manufacturers, part distributors, and end users since a new style adapter most likely must also be utilized to accommodate the innovative tooth and attachment device. This can require costly maintenance of multiple part inventories throughout the entire parts distribution system. This can also cause confusion as to which new tooth and pin will fit what adapter, which tool is needed, etc. Those concerns listed above at least partially explain the reluctance of some manufacturers and even end-users to accept and adopt a newer type of multipiece assembly, even after considering the advantages such a new assembly design can offer.

Thus, there is a need and continuing desire for a multipiece wear assembly wherein the wear part or tooth and adapter are releasably maintained in operable combination relative to each other. Also, there is a need and continuing desire for a multipiece assembly wherein the wear part can be removed from and reassembled to the adapter without requiring the use of a hammer. Moreover, there is an even greater need for a new design that can manifest numerous advantages for the manufacturer of the wear part and yet be utilized in combination with either new style adapters or with the existing population of older style adapters in the field.

SUMMARY

In view of the above, and in accordance with one aspect, there is provided a multipiece wear assembly for a digging implement. The wear assembly includes an adapter and a wear part or member. The adapter has a nose portion with a series of exterior surfaces defining a first predetermined configuration for the adapter nose portion. As is typical, the wear part is assembled onto the nose portion of the adapter by relative longitudinal movement. The wear part has top and bottom exterior surfaces and defines a blind cavity opening to a rear thereof. The blind cavity has a second predetermined configuration defined by a series of interior surfaces. In one embodiment, the configuration defined by the exterior surfaces of the blind cavity is larger than the configuration defined by the exterior surfaces of the adapter nose portion.

To releasably secure the adapter and wear part in operable combination relative to each other, a lock extends generally normal to a longitudinal axis of the wear assembly and from one of the interior surfaces defining the blind cavity of the wear part and one of the exterior surfaces on the nose portion of the adapter. When the wear part and adapter nose portion are arranged in operable combination relative to each other, the lock extends into one of a first recess defined by the adapter nose portion and a second recess defined by the wear part. A securement member is insertable between and in bearing contact with an exterior surface of the adapter nose portion and an adjacent interior surface defining the blind cavity in the wear part opposite from the lock such that the securement member positively and releasably maintains the lock in an operative position to releasably maintain the adapter nose portion and wear part in operable combination as long as the securement member is inserted between the wear part and the adapter nose portion.

In one form, the lock is formed independent of the wear part and the adapter nose portion. In another form, the lock is formed integral with one of the wear part and the nose portion of the adapter. Preferably, a lower wall of the wear part defines a bore extending through to the blind cavity so as to accommodate endwise passage of a tool from an underside of the securement member whereby facilitating removal of the securement member from operable engagement with the wear part and adapter.

In one form, a portion of the securement member has opposed and generally parallel sides. Preferably, the securement member further includes an enlarged head portion for limiting the extent to which the securement member is insertable into the relief defined between the wear part and adapter nose portion. In one form, the enlarged head portion of the securement member is configured to facilitate purposeful removal of the securement member from operable combination with the wear part and adapter nose portion to permit replacement of the wear part.

To guide and facilitate insertion of the securement member between the adapter nose portion and wear part, one of the sides of the securement member and a confronting surface partially defining the blind cavity on the wear part has a key projecting therefrom. Moreover, one of the securement member and a confronting surface partially defining the blind cavity on the wear part defines a keyway for slidably accommodating the key when the securement member is inserted into operable combination with the wear part and adapter nose portion.

Preferably, each of the key and keyway has an arcuate configuration including first and second radial edges. Moreover, the radial edges provided on the key and keyway are configured such that when forces act against the securement member, during operation of the wear assembly, the securement member is held against endwise separation from between the adapter nose portion and wear part. Moreover, the first and second radial edges on each of the key and keyway have a common vertex. In one form, such common vertex for the first and second radial edges is disposed in offset relation from the longitudinal; axis of the wear assembly.

In one embodiment, the wear part is configured as a digging tooth with top and bottom exterior surfaces converging toward a forward end of the tooth. Moreover, the series of interior surfaces defining the blind cavity includes top and bottom surfaces and a pair of side surfaces extending between the top and bottom surfaces. In one form, a bottom of the tooth defines a bore opening to the blind cavity for accommodating endwise passage of a tool used to facilitate removal of the securement member from between the tooth and the adapter nose portion.

The wear assembly furthermore includes a secondary lock for releasably maintaining the securement member in position between the wear part and the adapter nose portion. In one embodiment, the secondary lock is accommodated in the first recess defined by the adapter nose portion to operably cooperate with the securement member to inadvertent separation of the securement member relative to the wear part and the adapter nose portion thereby maintaining the lock within the recess in the adapter nose portion.

In another embodiment, the secondary lock is provided on and carried by the securement member. According to another embodiment, the securement member includes multiple parts and the secondary lock includes a resilient spring arranged in operable combination with the multiple parts of the securement member. Alternatively, the secondary lock includes a resilient projection carried by the securement member and which combines with a bore in the wear part to releasably maintain the securement member between the wear part and adapter nose portion so as to inhibit inadvertent shifting of the wear member relative to the adapter nose portion.

According to another aspect of this invention disclosure, there is provided a wear part for a multipiece wear assembly extending forward from a transverse edge of a digging implement. The wear part includes an elongated member having a forward end and a rear end generally aligned relative to each other along a longitudinal axis of the elongated member. The elongated member defines a blind cavity opening to a rear of the wear member. Such a blind cavity has a predetermined cross-sectional configuration defined by a series of interior surfaces which are joined but separated at a generally acute angle relative to each other. A free-ended lock extends generally normal to and inwardly toward the longitudinal axis of the member and from at least one of the interior surfaces defining the blind cavity of the elongated member.

In one form, the lock is formed independent of the wear member. In another embodiment, the elongated member defines a recess offset from the longitudinal axis of the elongated member and opening to an exterior of the elongated member and to the blind cavity defined by the elongated member.

Preferably, one of the interior surfaces defining the blind cavity of the wear member defines a keyway having first and second radial edges whereby providing an arcuate configuration to such keyway. In one form, the first and second radial edges on the keyway defined by the elongated member each have a common vertex, with such common vertex being disposed in offset relation from the longitudinal axis of the wear member.

In one family of embodiments, the elongated member is configured as a digging tooth having top and bottom walls converging tooth a forward end of the tooth. In this embodiment, the series of joined but separated interior surfaces defining the blind cavity includes top and bottom surfaces and a pair of side surfaces extending between the top and bottom surfaces of the cavity. Preferably, the bottom wall of the digging tooth defines a bore opening to the blind cavity for accommodating endwise passage of a tool from an exterior of the tooth toward an interior of the blind cavity defined by such tooth.

In another family of embodiments, there is provided a digging tooth having a ground penetrating edge extending transversely across a forward end thereof, and a blind cavity opening to a rear end of the tooth. The blind cavity defined by the tooth is defined by top and bottom surfaces which converge toward each other and toward a forward end of the tooth. The top surface of the cavity includes two angled sides disposed to opposed lateral sides of a longitudinal centerline of the tooth. Each side of the top surface extends at an acute angle ranging between about 35° and about 65° relative to the ground penetrating edge of the tooth. The angled sides of the top surface of the blind cavity are joined to each other along a common edge. The tooth further includes a free-ended lock extending generally normal to and inwardly toward the longitudinal axis of the tooth from at least one of the top and bottom surfaces of the tooth.

In one form, the lock is formed independent of the tooth. Also, the digging tooth has top and bottom surfaces converging tooth a forward end of the tooth. Preferably, the series of joined but separated interior surfaces defining the blind cavity of the tooth includes top and bottom angled surfaces. In this embodiment, the top surface of the digging tooth defines a bore which opens to the exterior of the tooth and to the blind cavity for accommodating passage of a securement member therethrough. Preferably, the bottom surface of the digging tooth defines a bore opening to the blind cavity for accommodating endwise passage of a tool from an exterior of the tooth toward an interior of the blind cavity defined by hew tooth for facilitating removal of a securement member operably associated with the tooth.

According to another family of embodiments, there is provided a wear assembly having a longitudinal axis. In this embodiment, the wear assembly includes a wear member and an adapter. The wear member has a plurality of interconnected exterior sides and a rearwardly opening socket having a predetermined configuration. The socket is larger toward an open end than toward the closed end and has a first cross-sectional configuration defined by a pair of opposed and spaced inner surfaces separated by a predetermined distance. The wear member further defines first and second axially aligned bores which open to opposed exterior sides of the wear member. The adapter has a nose portion configured to be longitudinally received and accommodated within the socket defined by the wear member. The adapter nose portion has a second predetermined configuration proximating the configuration of the socket defined by the wear member. The configuration of the adapter nose portion is partially defined by two opposed and spaced exterior surfaces. The respective lateral spacing between the opposed and spaced exterior surfaces of the adapter nose portion is less than the predetermined distance separating the pair of opposed surfaces of the socket defined by the wear member such that, when the adapter nose portion is arranged in operable combination with the wear member, a relief is defined between confronting surfaces of the wear member socket and the adapter nose portion, with such relief longitudinally opening to a rear end of the tooth. Also, the adapter nose portion further defines a recess opening to both opposed and spaced exterior surfaces and generally aligns with the bores defined by the wear member when the wear member and adapter are arranged in operative relation relative to each other.

In this embodiment, the wear assembly furthermore includes a lock arranged within the recess defined by the nose portion of the adapter for generally linear and transverse sliding movements relative to the adapter nose portion. The lock has first and second axially aligned terminal ends which are separated by a distance generally equal to or slightly shorter than the predetermined distance separating the spaced and opposed interior surfaces defining a portion of the socket in the wear member. The first terminal end of the lock is sized to be removably accommodated within either bore defined in the sides of the wear member. A securement member is slidably insertable into the relief defined between confronting surfaces on the socket defined by the wear member and the adapter nose portion through an opening defined by the wear member and in a direction generally normal to the longitudinal axis of the wear assembly. When inserted into operable combination with the wear assembly, the securement member at least partially fills the relief, bears against the confronting surfaces on the wear member socket and the adapter nose portion, and engages the second end of the lock whereby slidably moving the lock within the recess and relative to the adapter nose portion thereby causing the first terminal end of the lock to project into the adjacent bore in the wear member thereby releasably coupling the wear member and adapter in operable combination relative to each other as long as the securement member is arranged in operative combination with the wear member and adapter.

Preferably, the wear assembly further includes a secondary lock for releasably maintaining the securement member in position between the wear member and the nose portion of the adapter so as to inhibit shifting movement of the wear member relative to the adapter nose portion by maintaining the lock within the recess in the adapter nose portion. In one form, the secondary lock of the wear assembly passes endwise through an opening defined by the wear member and operably engages with the second terminal end of the lock whereby inhibiting the securement member from inadvertently moving from between the wear member and the adapter nose portion. Preferably, the secondary lock of the wear assembly is independently formed relative to the securement member. In a preferred embodiment, the recess defined by the adapter nose portion includes a counterbore at that end of the recess adjacent the second terminal end of the lock. In this embodiment, the second terminal end of the lock includes an enlarged head portion which is releasably accommodated in the counterbore of the recess defined by the nose portion of the adapter.

In one form, a portion of the securement member has opposed and generally parallel sides, with one of the sides of the securement member and a confronting surface partially defining the socket of the wear member has a key projecting therefrom. Similarly, one of the sides of the securement member and a confronting surface partially defining the socket of the wear member defines a keyway for accommodating the key when the securement member is inserted into operable combination with the wear member and adapter. In one embodiment, the key and keyway on the securement member and the confronting surface partially defining the socket of the wear member each have an arcuate configuration including first and second radial edges. The radial edges are configured such that, when forces act against the securement member during operation of the wear assembly, the securement member is held against endwise separation from between the adapter nose portion and the wear member. According to a preferred embodiment, the radial edges on each of the key and the keyway on the securement member and the confronting surface partially defining the blind cavity each have a common vertex. Such common vertex is preferably disposed in offset relation from the longitudinal axis of the wear assembly.

In one form, the securement member for the wear assembly further includes an enlarged head portion for limiting the extent to which the securement member is insertable between confronting surfaces on the adapter nose portion and the wear member. Preferably, the enlarged head portion of the securement member is configured to facilitate purposeful removal of the securement member from between the adapter nose portion and an adjacent interior surface defining the blind cavity in the wear member to permit replacement of the wear member.

In one embodiment, the wear member is configured as a digging tooth having top and bottom walls converging tooth a forward end of the tooth. In this embodiment, the series of separated interior surfaces defining the blind cavity includes top and bottom surfaces and a pair of side surfaces extending between the top and bottom surfaces of the cavity. Preferably, the bottom wall of the digging tooth defines a bore opening to the blind cavity for accommodating endwise passage of a tool used to facilitate removal of the securement member from between the tooth and the adapter nose portion.

According to yet another aspect, there is provided a wear part for a multipiece wear assembly extending forward from a transverse edge of a digging implement. The wear part includes an elongated member having a forward end and a rear end generally aligned relative to each other along a longitudinal axis. The elongated member also defines a blind cavity opening to a rear of the wear part. The blind cavity has a predetermined cross-sectional configuration defined by a series of interior surfaces which are joined but separated from each other. A free-ended lock extends generally normal to and inwardly toward the longitudinal axis from at least one of the interior surfaces defining the blind cavity of the wear part.

Preferably, the lock is formed independent of the wear part. In one embodiment, the elongated member defines a recess offset from the longitudinal axis and opening to both an exterior of the elongated member and to the blind cavity defined by the elongated member. In one form, one of the interior surfaces defining the blind cavity defines a keyway having first and second radial edges whereby providing an arcuate configuration to the keyway. Preferably, the first and second radial edges on such keyway each have a common vertex, with such common vertex being disposed in offset relation from the longitudinal axis of the wear part.

In one form, the wear part is configured as a digging tooth having top and bottom walls converging tooth a forward end of the tooth. The series of joined but separated interior surfaces defining the blind cavity includes top and bottom surfaces and a pair of side surfaces extending between the top and bottom surfaces of the cavity. Preferably, the bottom wall of the digging tooth defines a bore opening to the blind cavity for accommodating endwise passage of a tool from an exterior of the tooth toward an interior of the blind cavity.

According to another aspect of this invention disclosure, there is provided a digging tooth having a ground penetrating edge extending transversely across a forward end thereof, and a blind cavity opening to a rear end of the tooth. The blind cavity is defined by top and bottom surfaces which converge toward each other and toward a forward end of the tooth. The top surface of the blind cavity includes two angled sides disposed to opposed lateral sides of a longitudinal centerline of the tooth. Each side of the top surface extends at an acute angle ranging between about 35° and about 65° relative to the ground penetrating edge of the tooth. The angled sides of the top surface of the blind cavity are joined to each other along a common edge. The tooth further includes a lock extending generally normal to and inwardly toward the longitudinal axis of the tooth from at least one of the top and bottom surfaces of the tooth.

In one form, the lock is formed independent of the tooth. The digging tooth furthermore has top and bottom exterior surfaces converging tooth a forward end of the tooth. At least the top exterior surface of the tooth includes two angled sides disposed to opposed lateral sides of the longitudinal axis of the tooth. The top surface of the digging tooth defines a bore which opens to the exterior of the tooth and to the blind cavity for accommodating passage of a securement member therethrough. The bottom surface of the digging tooth defines a bore opening to the blind cavity for accommodating endwise passage of a tool from an exterior of the tooth toward an interior of the blind cavity.

According to still another aspect of this invention disclosure, there is provided a wear assembly having a longitudinal axis. The wear assembly includes a wear part having a plurality of interconnected exterior sides and a rearwardly opening socket having a first predetermined configuration. The socket is larger toward an open end than toward a closed end. The first predetermined configuration of the socket is at least partially defined by a pair of opposed and spaced inner surfaces separated by a predetermined distance. The wear part further defines a bore which opens to an exterior surface of the wear part and to the cavity. The wear assembly also includes an adapter having a nose portion configured to be longitudinally received and accommodated within the socket defined by the wear part. The adapter nose portion has a second predetermined configuration proximating the first predetermined configuration of the socket defined by the wear part. The second predetermined configuration of the adapter nose portion is at least partially defined by two opposed and spaced exterior surfaces. The spacing between two of the opposed and spaced exterior surfaces of the adapter nose portion being less than the spacing separating confronting opposed and spaced interior surfaces of the socket defined by the wear part such that, when the adapter nose portion is arranged in operable combination with the wear part, a relief is defined between two confronting surfaces of the wear part socket and the adapter nose portion, with the relief longitudinally opening to a rear end of the tooth. The adapter nose portion further defines a recess opening to both of the opposed and spaced exterior surfaces and generally aligns with the bore defined by the wear part when the wear part and adapter are arranged in operative relation relative to each other.

According to this aspect of the invention disclosure, a lock is arranged within the recess defined by the nose portion of the adapter for generally linear sliding movements relative to the adapter nose portion. The lock has first and second axially aligned terminal ends which are separated by a distance generally equal to or slightly less than the predetermined distance separating two spaced and opposed interior surfaces defining a portion of the socket in the wear part. The first terminal end of the lock is sized to removably extend into the bore defined by the wear part. A securement member is slidably insertable into the relief defined between confronting surfaces on the socket defined by the wear part and the adapter nose portion through an opening defined by the wear part and in a direction generally normal to the longitudinal axis of the wear assembly. A portion of the securement member at least partially fills the relief, bears against the confronting surfaces on the wear part socket and the adapter nose portion, and engages the second end of the lock whereby maintaining the first terminal end of the lock in the bore defined by the wear part thereby releasably coupling the wear part and adapter in operable combination relative to each other as long as the securement member is arranged in operative combination with the wear part and adapter nose portion.

In a preferred embodiment, a secondary lock is provided in combination with the wear assembly for releasably maintaining the securement member in position between the wear part and the adapter nose portion so as to inhibit inadvertent shifting movement of the lock relative to the adapter nose portion thereby maintaining the lock within the bore in the wear part. In one form, the secondary lock passes endwise through another bore defined by the wear part, through the securement member and operably engages with the second terminal end of the lock whereby inhibiting the securement member from inadvertently moving from between the wear part and the adapter nose portion.

Preferably, the secondary lock is independently formed relative to the securement member. In one form, the recess defined by the adapter nose portion includes a counterbore at that end of the recess adjacent the second terminal end of the lock. In this embodiment, the second terminal end of the lock includes an enlarged head portion releasably accommodated in the counterbore of the recess defined by the nose portion of the adapter. The enlarged head portion of the secondary lock limits the extent the first terminal end of the lock extends into the bore defined by the wear part. In on embodiment, the enlarged head portion of the securement member is configured to facilitate purposeful removal of the securement member from between the adapter nose portion and an adjacent interior surface defining the blind cavity in the wear part to permit replacement of the wear part.

Preferably, the wear part is configured as a digging tooth having top and bottom surfaces converging tooth a forward end of the tooth. The series of separated interior surfaces defining the blind cavity of the digging tooth includes top and bottom surfaces and a pair of side surfaces extending between the top and bottom surfaces of the cavity. In this embodiment, the bottom surface of the digging tooth defines a bore opening to the blind cavity for accommodating endwise passage of a tool used to facilitate removal of the securement member from between the tooth and the adapter nose portion.

According to yet another aspect of this invention disclosure, there is provided a digging tooth assembly including a digging tooth having a plurality of interconnected exterior sides and a rearwardly opening socket having a first predetermined configuration. The digging tooth further defines a pair of bores which open to opposed exterior sides of the digging tooth and to the cavity. The tooth assembly also includes an adapter having a nose portion configured to be longitudinally received and accommodated within the socket defined by the digging tooth. The adapter nose portion has a second predetermined configuration proximating the first predetermined configuration of the socket defined by the digging tooth. The second predetermined configuration of the adapter nose portion is at least partially defined by two opposed and spaced exterior surfaces. The adapter nose portion further defines a recess opening to both opposed and spaced exterior surfaces and which generally aligns with at least one of the bores defined by the digging tooth when the digging tooth and adapter are arranged in operative relation relative to each other.

According to this aspect, the digging tooth assembly is also provided with a lock for releasably maintaining the digging tooth and adapter in operable combination relative to each other. Such lock includes a body portion axially accommodated within the recess defined by the adapter nose portion, a head portion, and an axial extension releasably secured to the head portion of the lock and extending axially through one of the bores in the tooth whereby limiting longitudinal displacement of the tooth relative to the adapter nose portion after the lock is arranged in operable combination with the digging tooth and adapter nose portion.

Preferably, the recess defined by the adapter nose portion includes a counterbore opening to one of the exterior surfaces on the adapter nose portion. In one form, the head portion of the lock is secured to one end of the body portion of the lock and is releasably accommodated in the counterbore defined by the adapter nose portion.

According to another embodiment, there is provided a multipiece wear assembly for a digging implement. The multipiece wear assembly has a longitudinal axis and includes an adapter with a nose portion having a series of exterior surfaces joined to each other and which combine to define a first predetermined configuration for the nose portion of said adapter. The wear assembly also includes a wear part assembled to the adapter nose portion by relative longitudinal movement. The wear part has top and bottom exterior walls and defines a blind cavity having a second predetermined configuration defined by a series of interior surfaces which are separated from each other. The configuration of the cavity is greater than the configuration of the adapter nose portion. In this embodiment, lock structure extends generally normal to the longitudinal axis of the wear assembly and from one of the interior surfaces defining the blind cavity of said wear part and one of the exterior surfaces on the nose portion of the adapter for releasably coupling the wear member and the adapter nose portion in longitudinally assembled operable combination relative to each other. A securement member is insertable between and in bearing contact with an exterior surface of the adapter nose portion and an adjacent interior surface defining the blind cavity in the wear part opposite from the lock structure such that the securement member positively and releasably maintains the lock structure in an operative position to releasably maintain the adapter nose portion and wear part in operable combination as long as the securement member is inserted between the wear part and the nose portion of the adapter. A secondary lock carried by the securement member inhibits inadvertent displacement of the securement member from between the wear part and adapter nose portion.

According to this aspect of the invention disclosure, the securement member is comprised of at least two metal pieces which are joined to each other by the secondary lock. Preferably, the secondary lock includes a resilient spring which urges the first and second pieces of the securement member in opposed directions relative to each other. In one form, the wear part defines a bore disposed in opposed relation from the lock structure and has a closed margin. The secondary lock includes a resiliently biased detent which operably cooperates with the bore in the wear part after the wear part and the adapter nose portion are arranged in operable combination relative to inhibit inadvertent displacement of the securement member from between said wear part and said adapter nose portion.

According to still another aspect, there is provided an adapter for a multipiece wear assembly extending forward from a transverse edge of a digging implement. The adapter has a free-ended nose portion with a predetermined cross-sectional configuration defined by a series of exterior surfaces which are joined but separated relative to each other. The adapter defining a longitudinal axis and includes a free-ended lock extending generally normal to the longitudinal axis of the adapter and outwardly from at least one of the exterior surfaces defining the nose portion of the adapter.

In one embodiment, the lock is formed independent of the adapter. The series of exterior surfaces defining the nose portion of the adapter preferably includes spaced and opposed top and bottom surfaces converging toward one end of the adapter nose portion, and a pair of side surfaces extending between the top and bottom surfaces of the adapter nose portion. Preferably, the free-ended adapter nose portion defines a recess opening to at least one of the exterior side surfaces thereof. In this embodiment, the free-ended lock includes a first portion insertable into the recess, opening to at least one of the exterior side surfaces of the nose portion of the adapter, and a second portion for limiting the extent to which the first portion is insertable into the recess opening to at least one of the exterior side surfaces of the adapter nose portion.

DESCRIPTION OF THE DRAWINGS

FIGS. 40 through 42 are various views of a securement member which embodies a secondary lock as a part thereof;

FIG. 43 is a fragmentary longitudinal sectional view of a wear part embodying principals and teachings of this invention disclosure;

FIG. 44 is n enlarged view of the area encircled in phantom lines in FIG. 43;

FIGS. 45 through 47 are views of another form of securement member which can be used in operable combination with the present invention disclosure;

DETAILED DESCRIPTION

Figure 1:
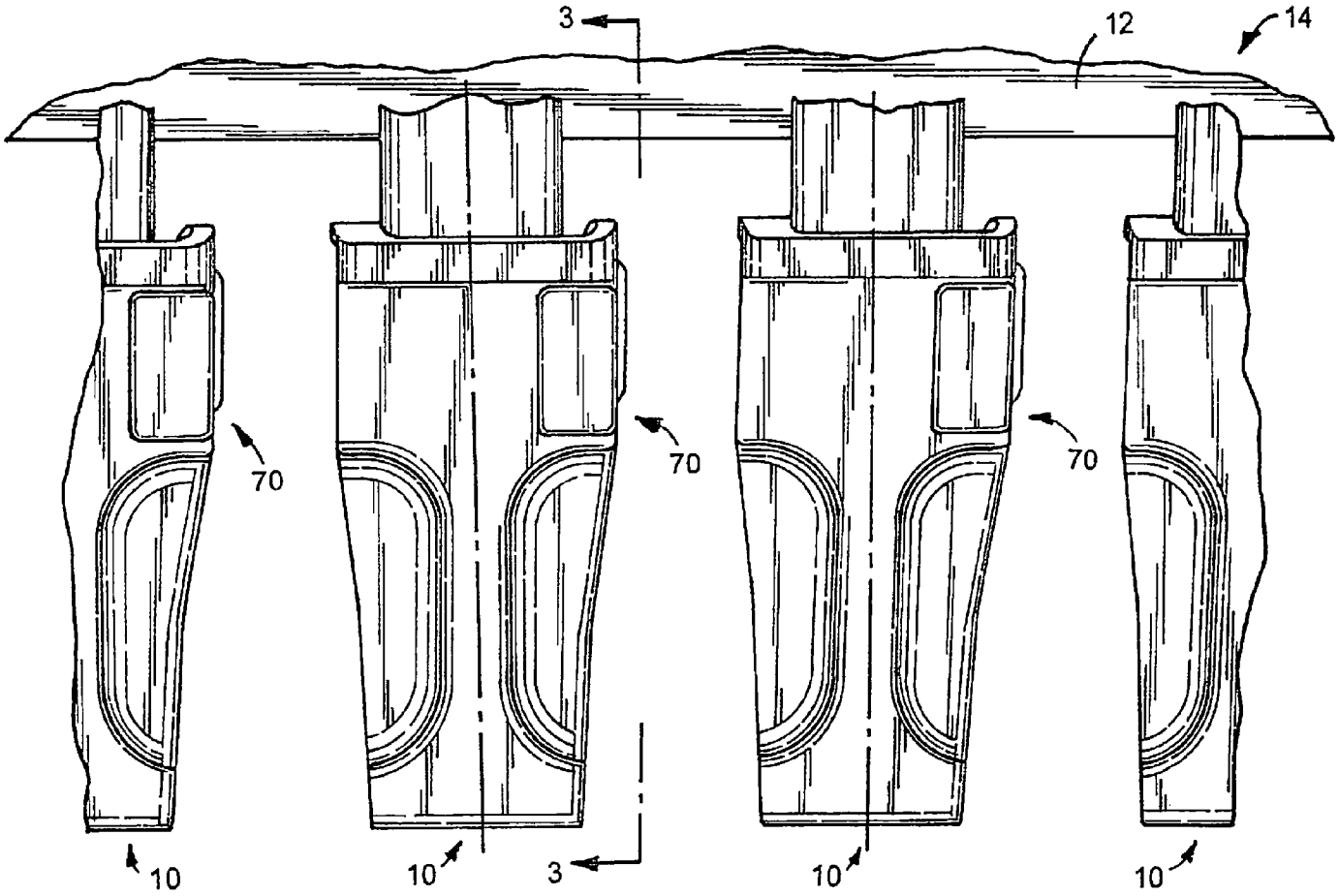
FIG. 1 is a fragmentary top plan view of one form of wear assembly embodying principals and teachings of the present disclosure.

While this invention disclosure is susceptible of embodiment in multiple forms, there is shown in the drawings and will hereinafter be described preferred embodiments, with the understanding the present disclosure sets forth exemplifications of the disclosure which are not intended to limit the disclosure to the specific embodiments illustrated and described.

Referring now to the drawings, wherein like reference numerals indicate like parts throughout the several views, there is shown in FIG. 1 a series of multipiece wear or digging tooth assemblies, with each assembly being identified generally by reference numeral 10. In the illustrated embodiment, the assemblies are arranged in generally horizontal and proximate relation relative to each other across and project forward from an edge or lip 12 of an implement such as a bucket or the like 14. During operation, the bucket or shovel 14 to which each assembly is attached moves both vertically and horizontally. Preferably, each assembly 10 is substantially identical in construction. Accordingly, only multipiece assembly will be discussed in detail.

Figure 2:
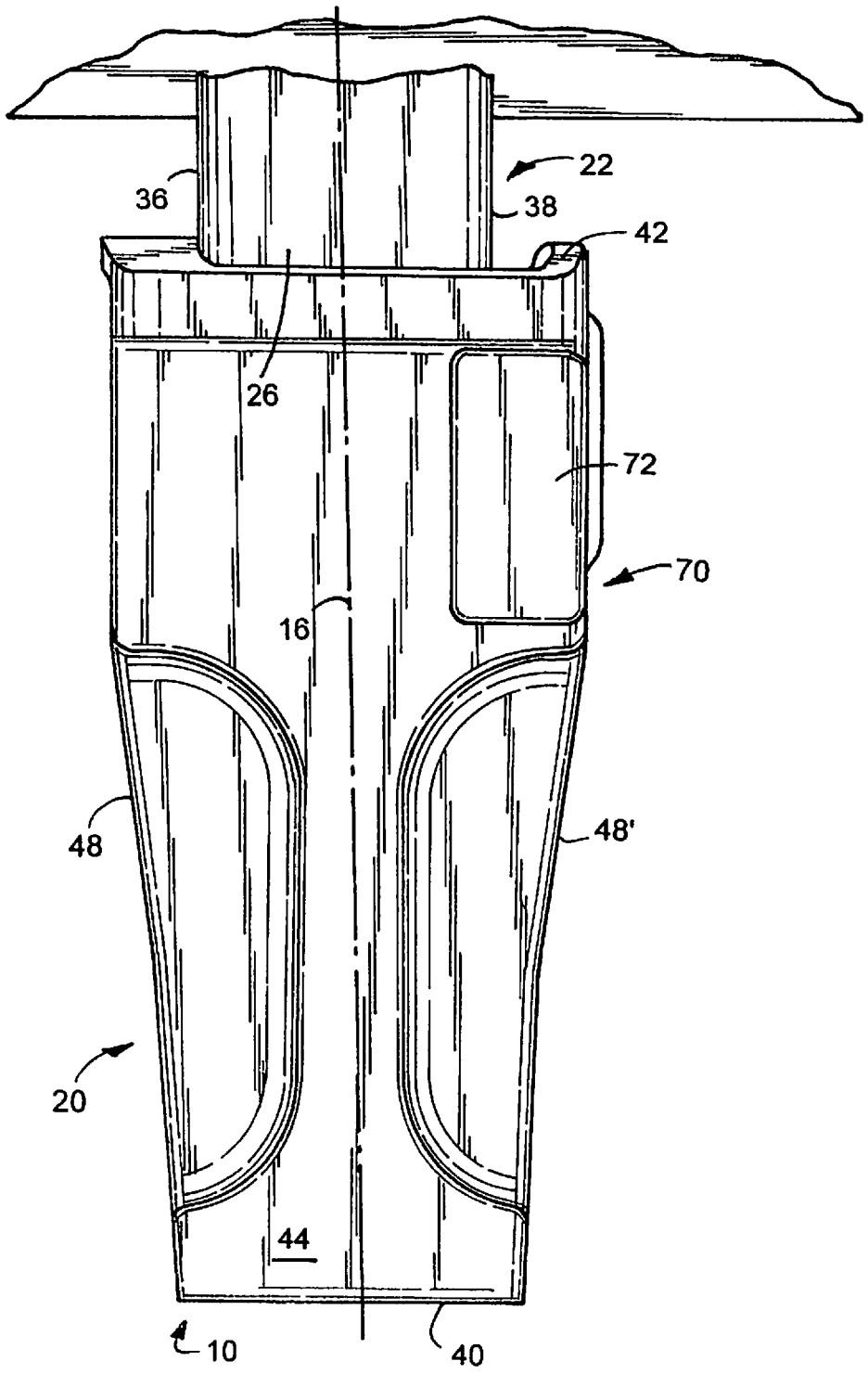
FIG. 2 is an enlarged top plan view of one wear assembly illustrated in FIG. 1.

As shown in FIG. 2, each wear assembly 10 has a longitudinal axis 16 and includes a replaceable wear part 20 and an adapter 22. In the illustrated embodiment, the replaceable wear part 20 is configured as a digging tooth. As mentioned, however, the wear part of assembly 10 can take a myriad of different designs other than a tooth, i.e., a ripper, lip shroud, wear cap, etc. without detracting or departing from the true spirit and scope of this invention disclosure.

Figure 3:
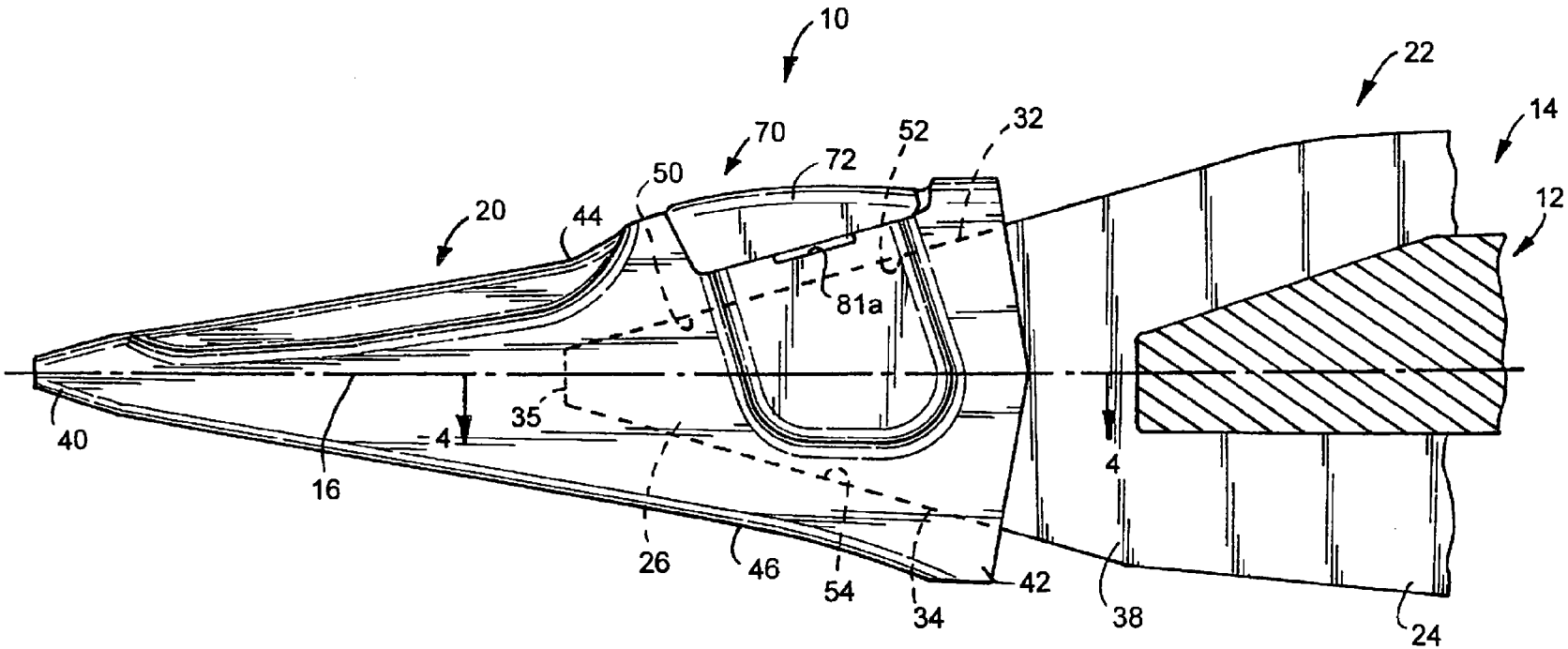
FIG. 3 is a sectional view taken along line 3-3 of FIG. 1.

In the embodiment illustrated by way of example in FIG. 3, adapter 22 has an elongated and preferably unitary construction and includes a base portion 24 and an elongated nose portion 26 projecting forward from the base portion 24. To add to the wearability thereof, adapter 22 is preferably formed from a ferrous metal, i.e., steel or a steel alloy. The adapter base portion 24 is configured for suitable attachment to the edge or lip 12 of the bucket or implement 14 through any suitable and well known means including a clamp mechanism, fastener, welding, etc.

Figure 4:
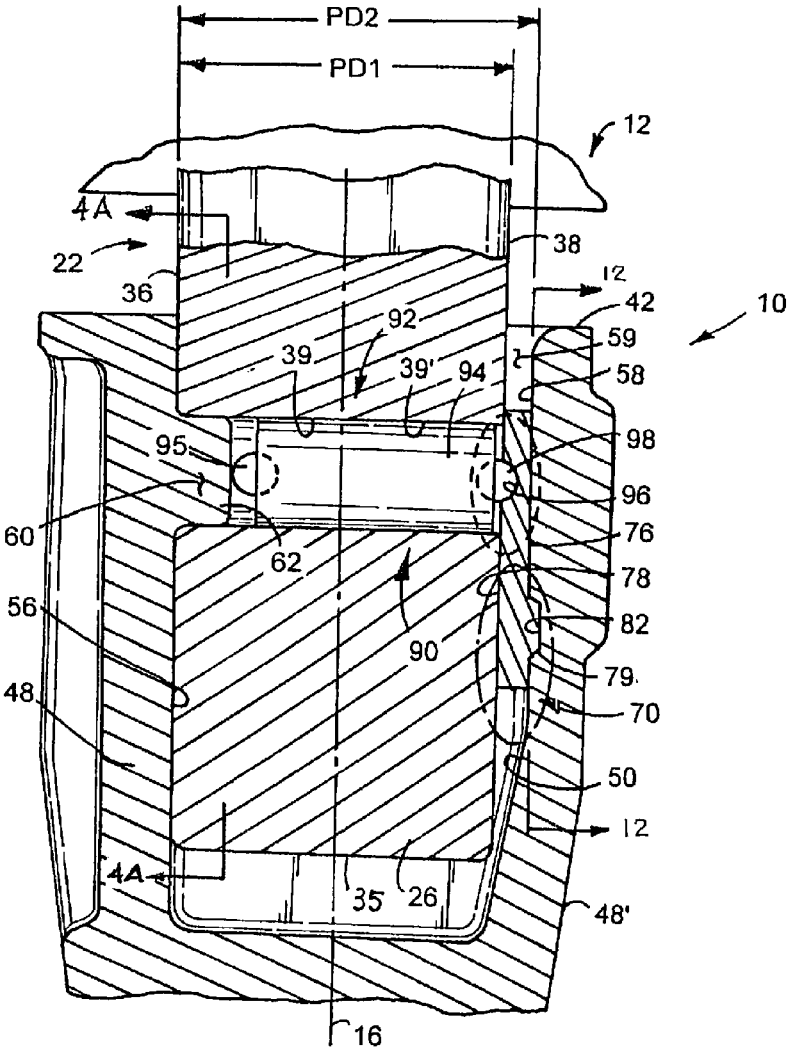
FIG. 4 is a sectional view taken along line 4-4 of FIG. 3.
Figure 4A:
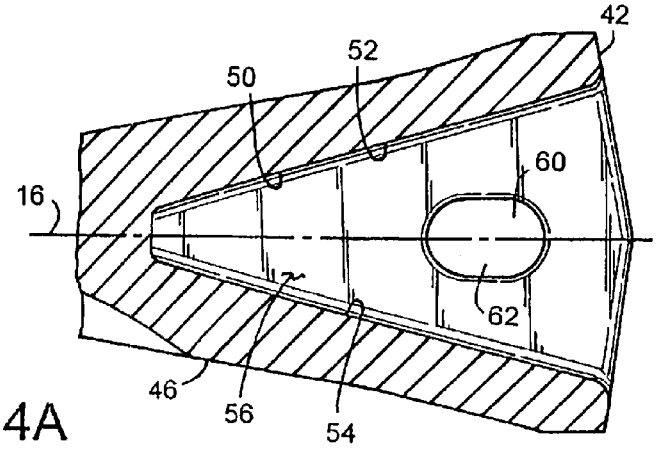
FIG. 4A is a sectional view taken along line 4A-4A of FIG. 4.

The adapter nose portion 26 can take any of a myriad of different designs without detracting or departing from the true spirit and scope of this invention disclosure. Suffice it to say, the configuration of the adapter nose portion 26 illustrated by way of example in FIGS. 3 and 4 is such that a longitudinal cross-sectional configuration of the adapter nose portion 26 increases as measured rearwardly from a free end of the adapter nose portion 26. The adapter nose portion 26 has a series of exterior surfaces joined to each other and which combine to define a first predetermined configuration. In the example selected for illustrative purposes in FIG. 3, the adapter nose portion 26 has top and bottom angled and exterior surfaces 32 and 34 which converge relative to each other and toward a free end 35 of the adapter 22. In the embodiment shown in FIGS. 2 and 4, the adapter nose portion 26 furthermore includes a pair of laterally spaced exterior surfaces or sides 36 and 38 which, in the form used as an example, extend generally parallel to each other. As shown in FIG. 4, the exterior surfaces or sides 36 and 38 of the adapter nose portion 22 are laterally separated or spaced apart by a predetermined transverse distance PD 1.

As shown in FIG. 4, the adapter nose portion 26 defines a recess or bore 39 extending generally normal to the tooth assembly axis 16. In the form shown in FIG. 4, recess 39 is defined by a throughbore 39' which opens to opposed exterior sides or surfaces 36 and 38 of the adapter nose portion 26. In the illustrated embodiment, recess 39 has a closed marginal edge. In the illustrated embodiment, the closed marginal edge of the recess 39 has a generally elliptical cross-sectional configuration which is elongated in a fore-and-aft direction but it could have other cross-sectional configurations i.e, circular, square, triangular, etc. without detracting or departing from the true spirit and scope of this invention disclosure.

In the example shown in FIG. 3, the wear part or tooth 20 of assembly 10 has an longitudinally elongated wedge shaped exterior between a forward cutting edge or end 40, operative to engage the material to be worked, and a rear end 42 thereof. Like adapter 22, tooth 20 is preferably formed from a ferrous metal, i.e., steel or a suitable steel alloy. Preferably, tooth 20 has a unitary design including an upper slanted or angled and exterior surface 44 and a lower slanted or angled exterior surface 46 arranged in converging relation toward the free end 40 of the tooth 20. As shown in FIG. 2, tooth 20 further includes a pair of exterior sides or surfaces 48 and 48' joined to and extending between exterior surfaces 44 and 46. Of course, the exterior sides or surfaces of tooth 20 can take a myriad of different shapes from that shown without detracting or departing from the true spirit and scope of this disclosure.

As shown in FIG. 4, the wear part or tooth 20 defines an open-ended blind cavity or socket 50 extending generally parallel to the longitudinal axis 16 of assembly 10 for longitudinally receiving and accommodating at least a lengthwise section of the adapter nose portion 26. Suffice it to say, socket 50 has a second predetermined configuration which compliments or proximates the first predetermined configuration of the adapter nose portion 26. In the illustrated form, the socket 50 has a larger configuration toward an open end than toward a closed end thereof. In the illustrated embodiment, the tooth cavity or socket 50 has top and bottom angled interior surfaces 52 and 54 (FIG. 3) which compliment the top and bottom angled exterior surfaces 32 and 34, respectively, on the adapter nose portion 26 and which converge relative to each other. The tooth cavity or socket 50 furthermore includes a pair of laterally spaced interior sides or surfaces 56 and 58 which, in one form, extend generally parallel to each other and to the longitudinal axis 16 of tooth assembly 10. Suffice it to say, the adapter nose portion 26 and tooth cavity or socket 50 have complimentary cross-sectional designs and/or configurations. It should be appreciated, however, the design, shape and/or configurations of the adapter nose portion 26 and tooth cavity or socket 50 can be different from that shown for illustrative purposes without detracting or departing from the true spirit and scope of this invention disclosure.

As shown in FIG. 4, the interior sides or surfaces 56 and 58 of cavity 50 are laterally separated or spaced apart by a predetermined lateral distance PD 2; with the predetermined lateral distance PD2 being greater than the predetermined lateral distance PD1 defined between the exterior sides or surfaces 36 and 38 of the adapter nose portion 22. That is, the respective spacing between the interior sides or surfaces 56 and 58 of cavity 50 is greater than the respective spacing between the exterior sides or surfaces 36 and 38 defined by the adapter nose portion 26. As such, and as shown in FIG. 4, when the adapter nose portion 26 is operably assembled within cavity 50, a space or relief 59 is defined between one exterior side or surface of the adapter nose portion 26 and the confronting interior side or surface 58 of cavity 50.

Assembly 10 further includes a lock structure 60 for releasably maintaining the wear part 20 and adapter nose portion 26 in operable combination relative to each other. Suffice it to say, lock 60 can embody different designs and alternative configurations without detracting or departing from the spirit and scope of this invention disclosure. In the form shown in FIG. 4, lock 60 has a free-ended design extending generally normal to the longitudinal axis 16 of the wear assembly 10 and inwardly from one interior surface defining the cavity 50 in the wear member 50. Lock 60 has a cross-sectional configuration which is preferably equal to or slightly smaller than the cross-section of the recess 39 defined by the adapter nose portion 26. Notably, the distance separating the free-end of lock 60 from the opposed interior side or surface 58 of cavity 50 is greater than the distance separating opposed exterior sides 36 and 38 of the adapter nose portion 26 whereby permitting longitudinal translation of the adapter nose portion 26 relative to the tooth socket 50 and longitudinally past lock 60. In one embodiment, lock 60 is a lug 62 formed integral with the wear part 20. As shown in FIG. 4, when the adapter nose portion 26 and wear part 20 are arranged in operable combination with each other, lock 60 is in registry with and extends into the recess 39 defined by the adapter nose portion 26. As such, the working loads and forces encountered by assembly 10 during operation are advantageously transferred from the tooth 20 to the adapter 22 through the lock 60 extending into the recess 39 on the adapter nose portion 26.

Figure 5:
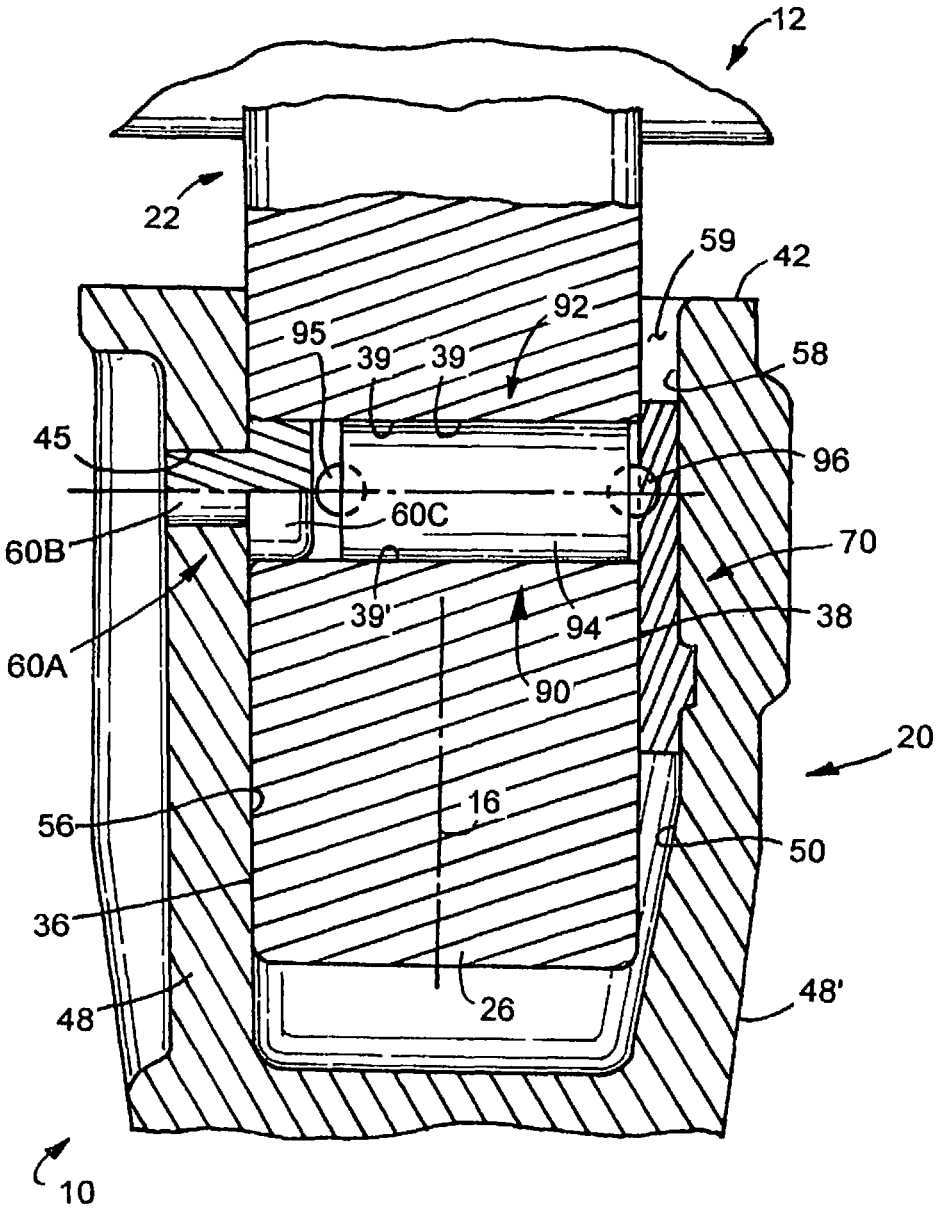
FIG. 5 is a view similar to FIG. 4 showing an alternative form of lock for releasably holding a wear part and an adapter nose portion in operable combination.

In an alternative lock embodiment illustrated in FIG. 5, lock structure 60A extends into the cavity 50 and toward axis 16 but is formed independent of the wear part 20. As shown in FIG. 5, wear part 20 is provided with a bore 45 in the side wall 48 forwardly from the rear end 42 and opens to cavity 50. Preferably, bore 45 has a closed marginal edge. Bore 45 is located in general registry with the recess 39 defined by the adapter nose portion 26 when the wear part 20 is fitted in operable combination on the adapter nose portion 26.

In this alternative embodiment, lock 60A includes a shank portion 60B and an enlarged head portion 60C. Preferably, the shank portion 60B and head portion 60C are axially aligned relative to each other. Shank portion 60B of lock 60A is received and secured against axial movements within bore 45 in the tooth side wall 48 through any suitable and well known means. As shown in FIG. 5, the head portion 60C of lock 60A extends into the socket 50 in general registry with the adapter nose portion recess 39 when the tooth 20 and adapter nose portion 26 are in operable combination relative to each other. Preferably, the cross-sectional configuration of head portion 60C on lock 60A is equal to or smaller than the cross-section of the recess 39 defined by the adapter nose portion 26. Like lock 60, the distance separating the free end of the head portion 60C from the opposed interior surface 58 of cavity 50 is greater than the distance separating opposed exterior sides 36 and 38 of the adapter nose portion 26 whereby permitting longitudinal translation of the adapter nose portion 26 relative to the socket 50 and past lock 60A. During operation, the working loads and forces encountered by tooth assembly 10 are advantageously transferred from the digging tooth 20 to the adapter 22 through the lock 60A extending into the recess 39 on the adapter nose portion 22.

Figure 6:
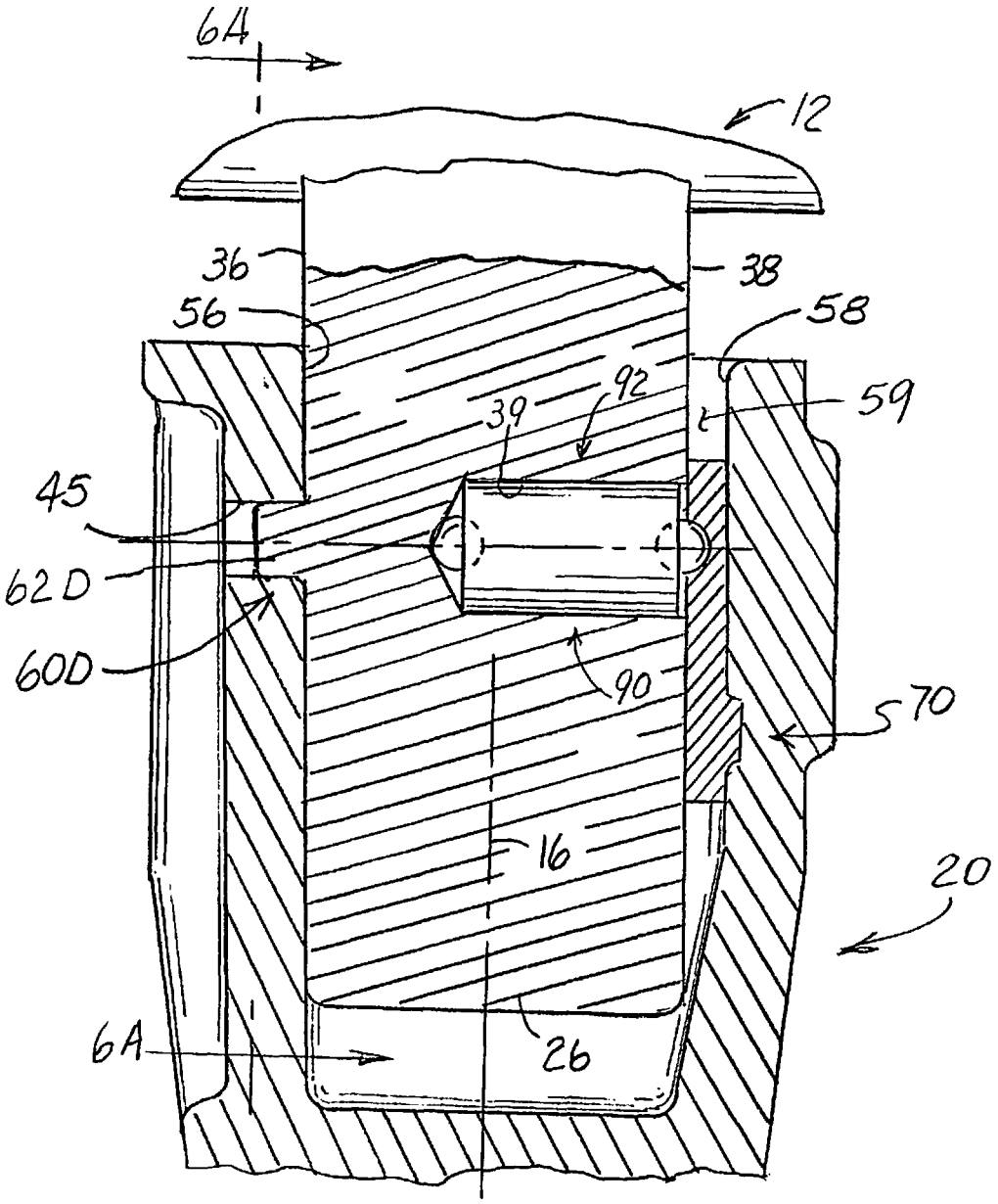
FIG. 6 is a view similar to FIG. 4 showing another alternative lock design for releasably holding a wear part and an adapter nose portion in operable combination.
Figure 6A:
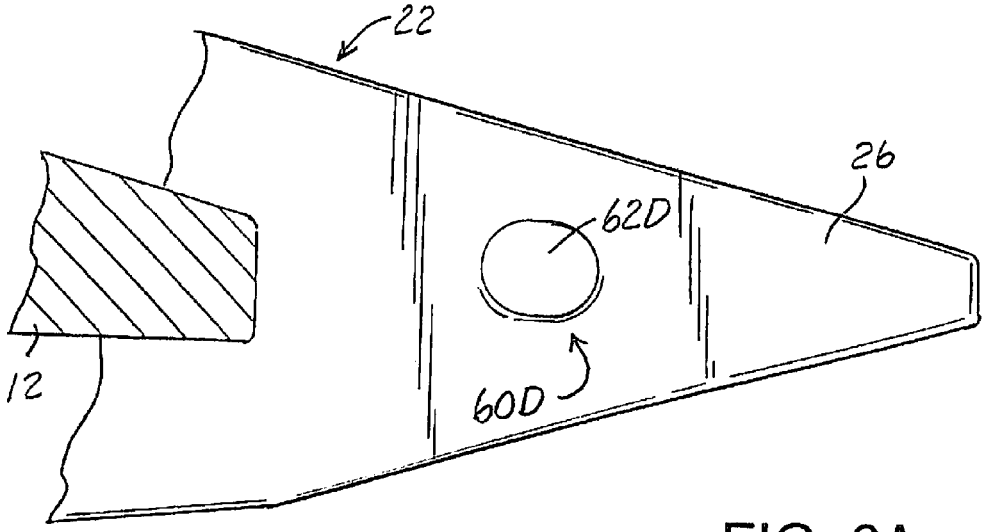
FIG. 6A is a sectional view taken along line 6A-6A of FIG. 6.

An alternative lock design is illustrated in FIGS. 6 and 6A. In the embodiment shown in FIGS. 6 and 6A, the lock structure is generally designed by reference numeral 60D. As shown, lock 60D extends outwardly away from one exterior side or surface of the adapter nose portion 26 in a direction generally normal to the longitudinal axis 16 of the tooth assembly 10. Lock 60D preferably has a cross-sectional configuration which is equal to or slightly smaller than the cross-section of the bore or opening 45 (FIG. 6) defined in the adjacent side or surface of tooth 20. Notably, the distance separating the free end of lock 60D from the opposed side or surface of the adapter nose portion is about equal to the distance separating opposed interior surfaces 56 and 58 partially defining the tooth cavity 50 from each other whereby permitting longitudinal translation of the adapter nose portion 26 relative to the tooth socket 50. In the illustrated embodiment, lock 60D is a lug 62D formed integral with the adapter nose portion 26. As shown in FIG. 6, when the adapter nose portion 26 and tooth 20 are arranged in operable combination with each other, lock 60D is in registry with and extends into the bore 45 defined by tooth 20. As such, the working loads and forces encountered by the tooth assembly 10 during operation are advantageously transferred from the digging tooth 20 to the adapter 22 through the lock 60D extending into the bore 45 defined by tooth 20.

Figure 7A:
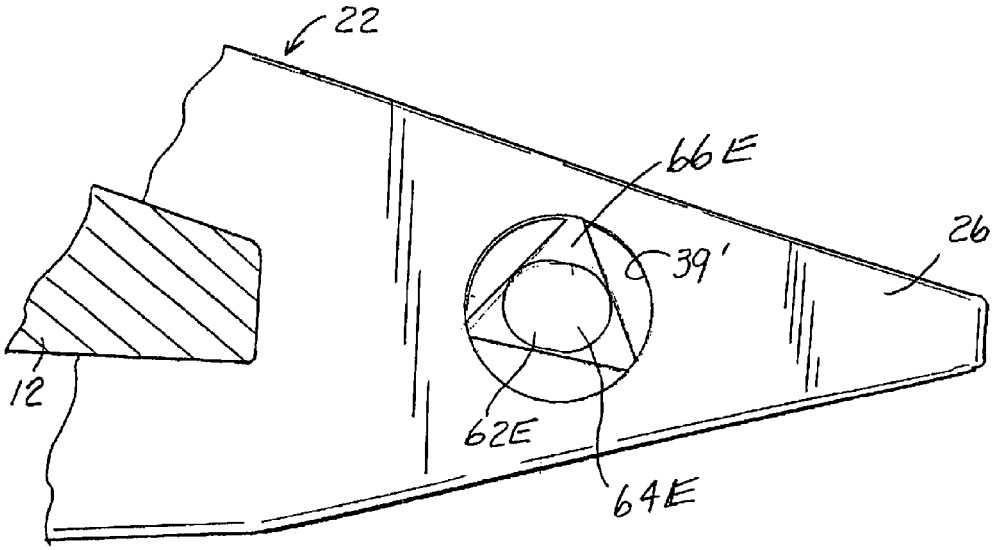
FIG. 7A is a sectional view taken along line 7A-7A of FIG. 7.
Figure 7:
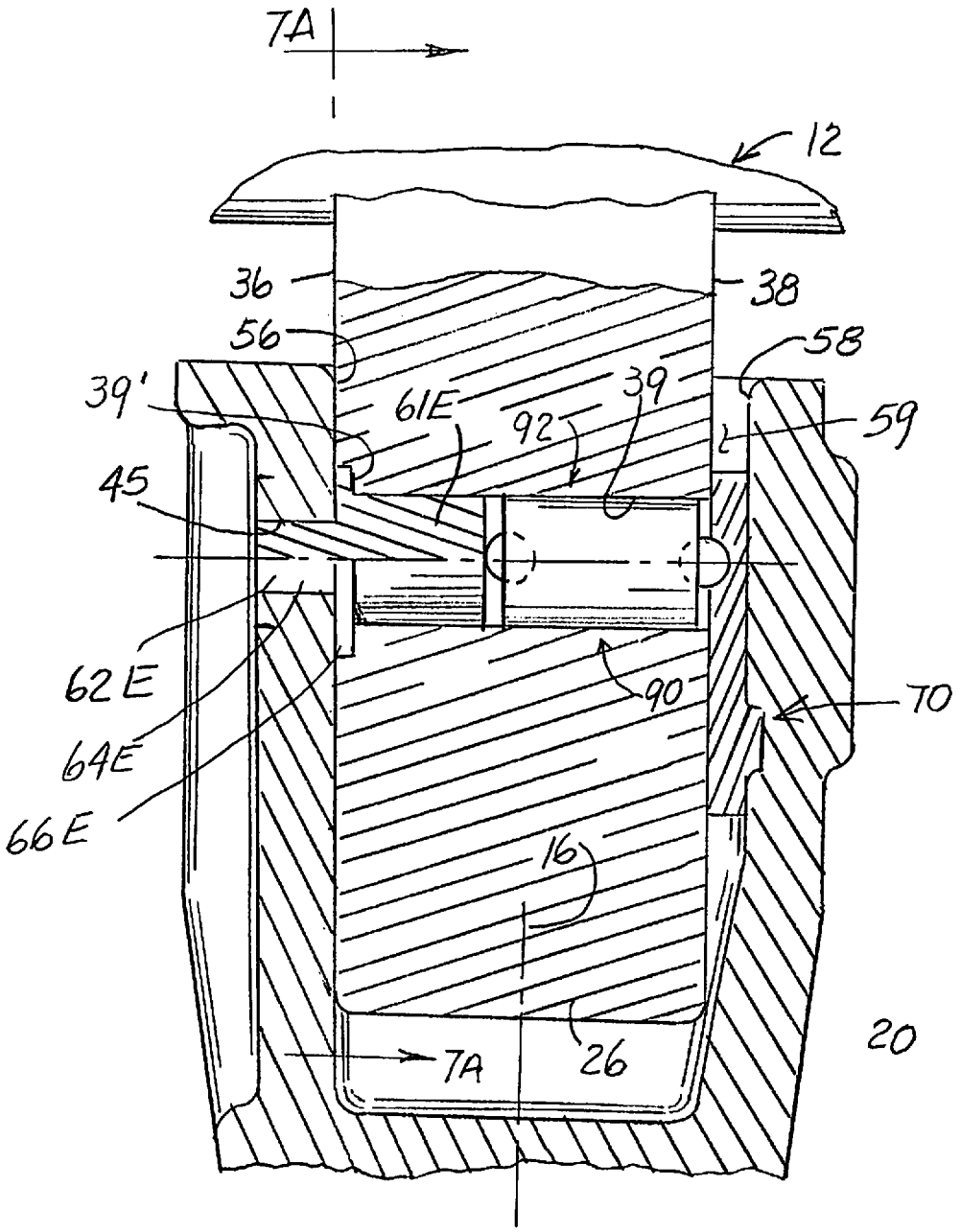
FIG. 7 is another view similar to FIG. 4 showing another alternative lock design for releasably holding a wear part and an adapter nose portion in operable combination.

Another alternative free-ended lock design is illustrated in FIGS. 7 and 7A. In the embodiment shown in FIGS. 7 and 7A, the lock structure is generally designed by reference numeral 60E. As shown, lock structure 60E extends outwardly away from one exterior side or surface of the adapter nose portion 26 in a direction generally normal to the longitudinal axis 16 of assembly 10.

In the alternative embodiment shown in FIGS. 7 and 7A, lock 60E includes a shank portion 61E and a head portion 62E preferably formed as an integral piece or part of each other. In one form, the shank portion 61E and a head portion 62E of lock 60E are axially aligned relative to each other. Preferably, shank portion 61E of lock 60E is sized to be received and snugly accommodated within that end of the recess 39 in the adapter nose portion 26 disposed closest to the bore 45 in part 20 In the embodiment shown by way of example in FIG. 7, the head portion 62E of lock 60E includes a first section 64E and a second section 66E. After the shank portion 61E of lock 60E is inserted within the recess 39 of the adapter nose portion 26 and part 20 along with the adapter nose portion 26 are arranged in operable combination relative to each other, the first section 64E of the head portion 62E of lock 60E is in general registry with the bore 45 in part 20. Preferably, the cross-sectional configuration of first section 64E on lock 60E is equal to or slightly smaller than the cross-section of the bore 45 in the side of the tooth 20. Like lock 60D, the distance separating the free end of lock 60E from the opposed exterior side surface of the adapter nose portion 26 is about equal to the distance separating opposed interior surfaces 56 and 58 partially defining the tooth cavity 50 whereby permitting longitudinal translation of the adapter nose portion 26 relative to the tooth socket 50. During operation, the working loads and forces encountered by tooth assembly 10 are advantageously transferred from the wear part/tooth 20 to the adapter 22 through the lock 60E extending into the recess 39 on the adapter nose portion 22.

Notably, the second section 66E of the head portion 62E of lock 60E is purposefully sized larger than the cross-section of the recess 39 in the adapter nose portion 26 so as to limit the extent the lock 60E can be inserted within the recess 39 in the adapter nose portion 26. Preferably, and as shown in FIG. 7, that exterior surface or side of the adapter nose portion 26 toward that end of the recess 39 in the adapter nose portion 26 disposed closest to the bore 45 in the digging tooth 20 is provided with a counterbore 39' which opens to the exterior side of the adapter nose portion 26. Suffice it to say, when lock 60D is assembled to the adapter nose portion 26, the counterbore 39' is sized to releasably accommodate the enlarged second section 66E of the head portion 62E of lock 60E.

From an understanding of this disclosure, it will be appreciated that lock structures or locks 60, 60A, 60D and 60E all serve the same functional purpose to releasably secure the tooth 20 and adapter nose portion 26 in operable combination. As such, the description below will only reference lock 60 for operably and releasably securing wear member 20 and the adapter nose portion 26 in operable combination but it should be appreciated lock 60 could have a design similar to locks 60A, 60D or 60E without detracting or departing from the true spirit and scope of this invention disclosure.

In accordance with one form of the present disclosure, each assembly 10 is furthermore provided with a spacer or securement member 70. After part/tooth 20 is arranged in operable combination with adapter 22, at least a portion of the securement member 70 is insertable through an opening 80 (FIG. 12) defined in the wear part/tooth 20 and into the relief or space 59 defined between the confronting surfaces on the adapter nose portion 26 and tooth cavity 50 so as to at least partially fill the relief 59, bear against confronting surfaces on the adapter nose portion 26 and tooth cavity 50 opposite from the lock 60 while positively and releasably maintaining the lock 60 in an operative position to releasably maintain the adapter nose portion and wear part in operable combination and inhibit longitudinal translation of part 20 relative to the adapter nose portion 26 as long as the securement member is inserted between wear part 20 and the adapter nose portion 26. By this design, securement member 70 extends in a direction relative to the axis 16 of assembly 10 so as to advantageously avoid operating loads being applied directly thereto during operation of assembly 10. As such, wear on securement member 70 is minimized thus allowing securement member 70 to be reused, if desired, when a replacement part 20 is again attached to adapter 22.

In the form shown in FIGS. 8 through 11, securement member or spacer 70 includes an enlarged head portion 72 and a shank portion 74. Member 70 is preferably formed from metal, i.e. steel or other suitable material or non-compressible metal alloy, with the head portion 72 and shank portion 74 preferably being formed integral relative to each other. The head portion 72 is preferably configured to limit the extent to which member 70 is insertable into the relief 59. In the illustrated form shown in FIGS. 2 and 3, the exposed section of the head portion 72 of member 70 compliments the fore-and-aft profile of tooth 20 to promote movement of material therepast.

Figure 9:
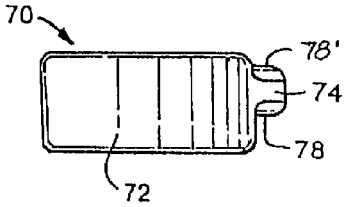
FIG. 9 is a top plan view of the securement member shown in FIG. 8.
Figure 10:
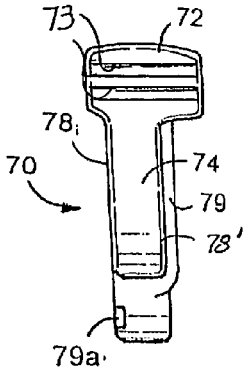
FIG. 10 is an elevational view of the securement member shown in FIG. 8.
Figure 11:
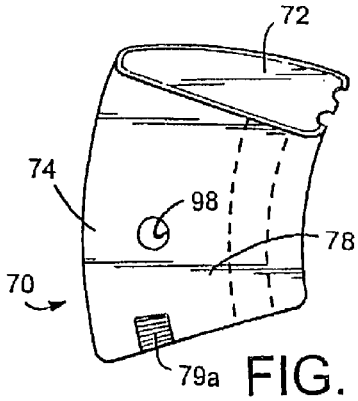
FIG. 11 is another side view of the securement member shown in FIG. 8.

As shown in FIGS. 9 and 10, the shank portion 74 of member 70 preferably includes two laterally spaced and generally parallel sides 78 and 78'. Notably, the distance between the sides 78 and 78' of as well as the configuration of the shank portion 74 can change from one securement member to another depending upon the particular tooth socket and adapter nose portion combination or conjuncture into which the member 70 is to be inserted. As such, securement member 70 is modular in nature. In one embodiment, tolerances of the shank portion 74 of member 70 are controlled by the difference between the predetermined distances PD1 and PD2. Thus, the combination of lock 60 with the securement member 70 allows the system of this invention disclosure to be used on scores of other manufacturers' adapters, even though the tolerances of those other manufacturers' adapters are not ascertainable with exacting certainty.

To reduce an accumulation of dirt fines between part 20 and securement member 70 during operation of assembly 10, and thereby facilitate removal of member 70 from between part 20 and the adapter nose portion 26, the shank portion 74 of member 70 preferably has an arcuate configuration between the free distal thereof and where it joins to the head portion 72. Additionally, and after the adapter nose portion 26 is arranged in operable combination with tooth 20, shank portion 74 of member 70 preferably extends across substantially an entire side of the adapter nose portion 26 after member 70 is fully inserted into an operational position whereby furthermore reducing stress concentrations during operation of assembly 10 (FIG. 1).

Figure 8:
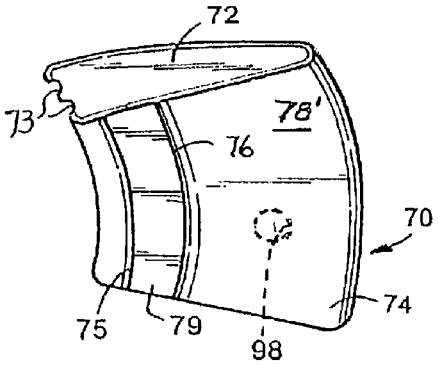
FIG. 8 is a side view of one form of securement member used in connection with the present disclosure.

In the form shown in FIGS. 8 and 10, the spacer or member 70 furthermore includes an elongated key 79 projecting from side 78' of the shank portion 74. The other side 78 of the shank portion 74, i.e. the side arranged in confronting relation with the exterior side of the adapter nose portion 26, preferably has a generally planar surface configuration. For reasons discussed in further detail below, the side 78 of member 70 preferably has a camming surface 79*a* to effectively reduce the lateral width leading from the terminal end of the shank portion 74 of member 70.

In one form, the key 79 on the shank portion 74 of member 70 has an arcuate configuration including first and second radially spaced edges 75 and 76 extending at least the majority and preferably the entire length of the shank portion 74 of member 70. The edges 75 and 76 on key 79 are configured such that when forces act against the security member 70 during operation of assembly 10, member 70 is held against endwise separation from between the wear part 20 and the adapter nose portion 26. Moreover, the configuration of key 79 preferably compliments the arcuate configuration of the shank portion 74 of member 70 and advantageously limits the direction which member 70 can be correctly inserted into operable combination with part 20 and adapter nose portion 26.

Figure 12:
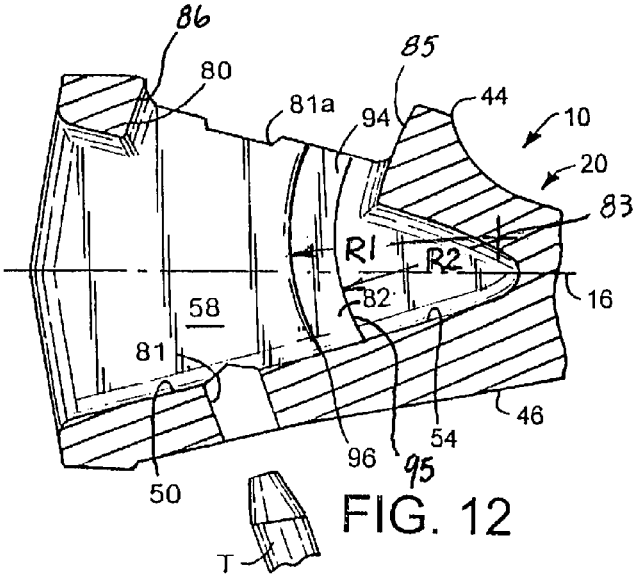
FIG. 12 is a sectional view taken along line 12-12 of FIG. 4.
Figure 13:
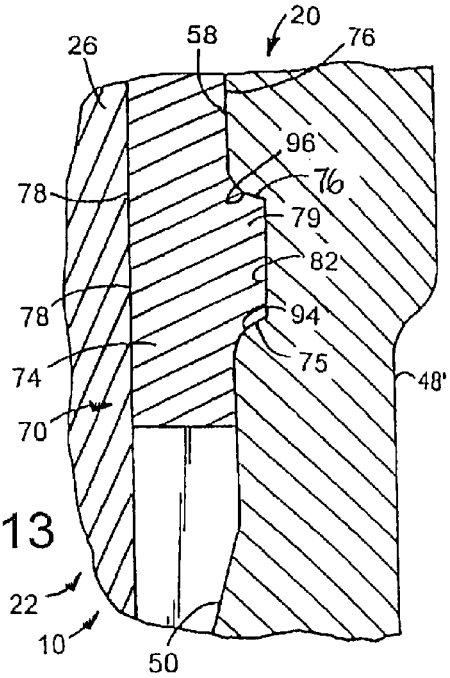
FIG. 13 is an enlarged fragmentary view of an area encompassed in phantom lines in FIG. 4.

Turning to the example illustrated FIGS. 12 and 13, the interior side surface 58 of cavity 50 opposite from the lock 60 (FIG. 4) preferably defines an arcuately shaped keyway 82 for slidably accommodating and guiding endwise passage of the key 79 on member 70 (FIG. 8) therethrough when the shank portion 74 of member 70 is inserted into operable combination with part 20 and the adapter nose portion 26. As shown in FIGS. 12 and 13, the keyway 82 defines first and second radially spaced radial edges or shoulders 95 and 96 which complement each other and cooperate with the spaced radial edges 75 and 76 on key 79 to allow the securement member 70 to interact with part 20 while maintaining and orienting the shank portion 74 of the member 70 relative to part 20. As shown in FIG. 12, the edges 95 and 96 of the keyway 82 have a radius R1 and R2, respectively, which complement the radiuses of the edges 75 and 76 on key 79. Preferably, the first and second radial edges 75 and 76 on key 79 along with the first and second radial edges 95 and 96 on the keyway 82 each have a common vertex represented in FIG. 12 by reference numeral 83. Notably, in a preferred embodiment, the common vertex 83 for the radial edges 75 and 76 on key 79 along with the radial edges 95 and 96 on the keyway 82 is offset from the longitudinal axis 16 of assembly 10. In a preferred form, member 70 has only one way of being inserted into operable combination with the adapter nose portion 26 and part 20. It should be appreciated, however, the arrangement of key 79 and keyway 82 could readily be reversed. That is, key 79 can be provided on one surface partially defining cavity 50 while the keyway 82 can be provided on the confronting surface 78 of the shank portion 74 of member 70 without detracting or departing from this invention disclosure.

In the illustrated embodiment, the opening 80 defined by the wear member or tooth 20 is provided in offset relation from the longitudinal axis 16 of assembly 10 and opens adjacent to interior side surface 58 of and extends through to the blind cavity or socket 50 of part 20. Notably, in the example illustrated in FIG. 12, the opening 80 defined by part 20 is arranged adjacent to that interior side surface 58 of the blind cavity 50 opposite from lock 60 (FIG. 4). The opening 80 in part 20 permits the shank portion 74 of member 70 (FIGS. 8 through 11) to pass endwise therethrough while limiting movement of the enlarged head portion 72 of securement member 70 from passing therethrough. As such, the marginal edge of the opening 80 preferably cooperates with the enlarged head portion 72 of member 70 to limit the extent member 70 can be inserted into the wear part 20.

In the embodiment illustrated in FIG. 12, an opening 81 in the lower or bottom wall 46 of wear part 20 proximate to the side surface 58 of cavity 54 permits passage of a suitably shaped tool T therethrough so as to engage and push upwardly against member 70 (FIGS. 8 through 11) whereby facilitating removal of member 70, when required or desired, from the space or relief 59 (FIG. 4) between wear part 20 and the adapter nose portion 26 to effect repair/replacement of the wear part 20. Passage of tool T through opening 81 on part 20 will cause vertical displacement of the member 70 through the opening 80. Only after member 70 is removed from between part 20 and adapter nose portion 26 can the wear part 20 be shifted whereby releasing the lock 60 from inhibiting longitudinal translation between the wear part 20 and the adapter nose portion 26.

Returning to FIG. 3, when securement member 70 is fully inserted into operable combination with part 20 and the adapter nose portion 26, a section of the head portion 72 of member 70 overlies and is arranged in confronting relation relative to a section of part 20. As shown in FIGS. 3 and 12, a slot or other suitably shaped recess 81*a* extends to the exterior of part 20 from a marginal edge of the opening 80. Besides those steps mentioned above for effecting release of member 70 from engagement with part 20 and the adapter nose portion 26, opening 81*a* allows a suitably shaped tool (not shown) to be inserted between the head portion 72 of member 70 and that section of part 20 arranged in confronting relation relative thereto to effect separation between member 70 and part 20 whereby effecting release of the member 70.

In a preferred form, the enlarged head portion 72 of securement member 70 can also be configured to facilitate purposeful removal of the securement member from operable combination with the wear part 20 and the adapter nose portion 26 whereby permitting repair/replacement of the wear part 20. Returning to that embodiment illustrated for exemplary purposes in FIGS. 8, 10 and 11, a forward end of the enlarged head portion 72 of member 70 is preferably provided with a series of vertically spaced notches or open-sided grooves 73. When removal of the securement member 70 from operable association with the wear part 20 and adapter nose portion 26 is desired, a suitably shaped tool (not shown) can be inserted between the marginal edge of the opening 80 and the forward end of the enlarged head portion 72 of securement member 70 and inserted into one of the notches or open-sided groves 73 so as to permit the tool to be leveraged whereby forcibly prying the securement member 70 upward and out of its from its operable association with the wear part 20 and adapter nose portion 26.

In one embodiment of the invention disclosure, a secondary lock 90 is provided for releasably maintaining member 70 in operable position between part 20 and the adapter nose portion 26 during operation of assembly 10 whereby inhibiting inadvertent longitudinal separation of part 20 relative to the adapter nose portion 26. More specifically, and in the example shown in FIG. 4, the secondary lock 90 is arranged in operable combination with part 20, the adapter nose portion 26, and member 70. It will be appreciated, however, and as discussed below, the secondary lock 90 can take various configurations without detracting or departing from the spirit and scope of the present disclosure.

Figure 14:
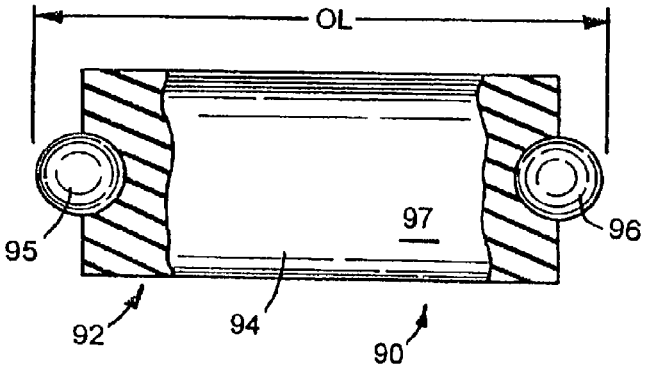
FIG. 14 is an enlarged top plan view, partly in section, showing part of a secondary lock for use in combination with this invention disclosure.
Figure 15:
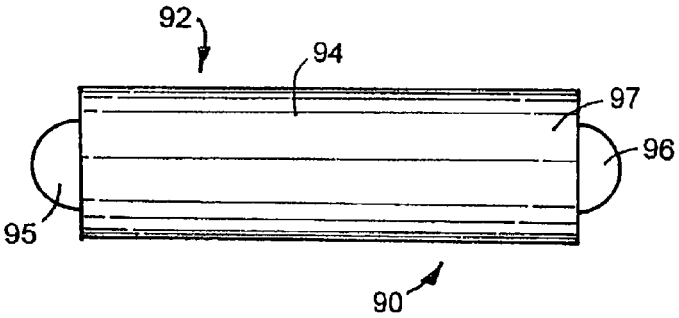
FIG. 15 is an elevational view of the part illustrated in FIG. 14.
Figure 16:
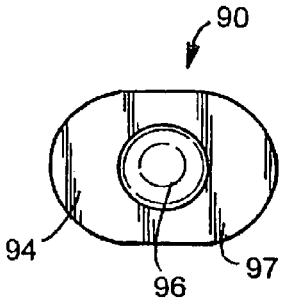
FIG. 16 is an end view of the part illustrated in FIG. 14.

In the embodiment shown in FIG. 4, the secondary lock 90 is designed as a detent mechanism 92 for releasably maintaining securement member 70 between part 20 and the adapter nose portion 26 during operation of assembly 10. More specifically, and as shown in FIGS. 14, 15 and 16, mechanism 92 includes a spring 94 preferably having a semi-spherical element 95 and 96 longitudinally projecting from each end thereof. Suffice it to say, the operative length OL of mechanism 92 (FIG. 14) is greater than the distance between the distal end of lock 60 and the planar side surface 78 of lock 70 (FIG. 4). As such, and when the securement member 70 is inserted between part 20 and the adapter nose portion 26, and the secondary lock 90 is arranged in the position shown in FIG. 4, spring 94 is longitudinally compressed such that the elements 95 and 96 are continually urged in opposed longitudinal directions relative to each other.

In the embodiment shown in FIG. 4, spring 94 is designed as a longitudinally compressible elastomeric member 97. Alternatively, however, a conventional mechanical or coil spring can be used as part of mechanism 92. As shown, member 97 fits into the recess or bore 39 in the adapter nose portion 26 (FIGS. 4, 5, 6 and 7). Moreover, elements 95 and 96 are preferably metal, i.e., steel, ball bearings extend longitudinally from and are secured, as by vulcanization or other suitable process, to opposed ends of the spring 94, such that about half of each element 95, 96 extends beyond the respective free end of the spring 94. By this design, mechanism 92 can be inserted into the bore 39 in the adapter nose portion 26 with elements 95, 96 longitudinally extending from either end thereof without detracting from the effective and efficient operation of lock 90. Moreover, and with the secondary lock embodiment illustrated in FIGS. 4 and 14 through 17, the secondary lock 90 advantageously cannot be incorrectly installed into operable combination with the tooth 20, adapter nose portion 26 and member 70.

Figure 17:
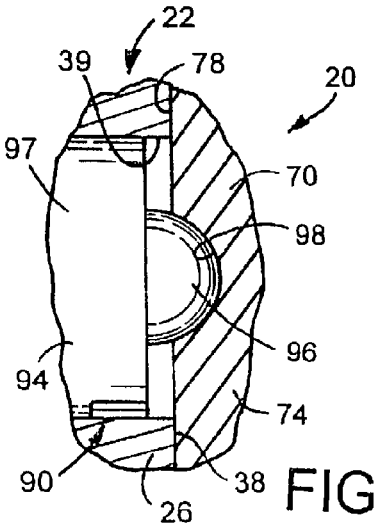
FIG. 17 is an enlarged sectional view of the area encompassed by dash lines in FIG. 4.

As shown by way of example in FIGS. 4 and 17, and when lock 90 is arranged in operable combination with part/tooth 20, the adapter nose portion 26, and member 70, element 96 is urged by spring 94 into a suitably configured recess 98 defined on the generally planar face of side surface 78 of member 70. As will be understood, during insertion of member 70 into the space 59 between the wear part 20 and the adapter nose portion 26, spring 94 initially and longitudinally compresses to permit the shank portion 74 of member 70 to pass element 96. In this regard, and as member 70 is inserted into the relief 59 between the wear part 20 and the adapter nose portion 26, a ramp or camming surface 79*a* (FIG. 9) on member 70 progressively compresses the spring 94 whereby easing installation of the secondary lock 90 and reducing the likelihood of damage to element 96 of the secondary lock 90.

Continued insertion of the securement member 70 into the space or void 59 separating the exterior surface or side 38 of the adapter nose portion 26 from the confronting interior side or surface 58 of cavity 50 eventually causes the recess 98 on the face 78 of lock 70 to align with element 96, acting under the compression of spring 94, whereby causing element 96 to forcibly snap into and engage the recess 98 thereby inhibiting inadvertent removal of member 70 from between the tooth 20 and the adapter nose portion 26. The resiliency of the secondary lock 90, however, furthermore permits purposeful removal of the securement member 70 from between the tooth 20 and adapter nose portion 26 whereby permitting repair and/or removal of the wear part 20 when required or desired without the use of hammers or the like.

Of course, the design of mechanism 92 could be altered without detracting or seriously departing from the true spirit and scope of this disclosure. That is, and if so desired, mechanism 92 could be designed with but a single detent 96 at only one end of the spring 94 so as to coact with recess 98 on the side surface 78 of lock 70. Alternatively, a spherical projection 96 can be provided on surface 78 of member 70, with the accommodating recess 98 for releasably holding that element 96 can be provided at the end of the spring 94.

As mentioned, the secondary lock for maintaining member 70 between part 20 and the adapter nose portion 26 can take varied configurations without detracting or departing from the spirit and scope of the present disclosure. In this regard, an alternative secondary lock arrangement is illustrated by way of example in FIGS. 18 and 19. This alternative form of secondary lock is designated generally by reference numeral 190. The elements of wear part 20, the adapter nose portion 26, and securement member 70 which are similar to those mentioned above are identified by like reference numerals.

Figure 18:
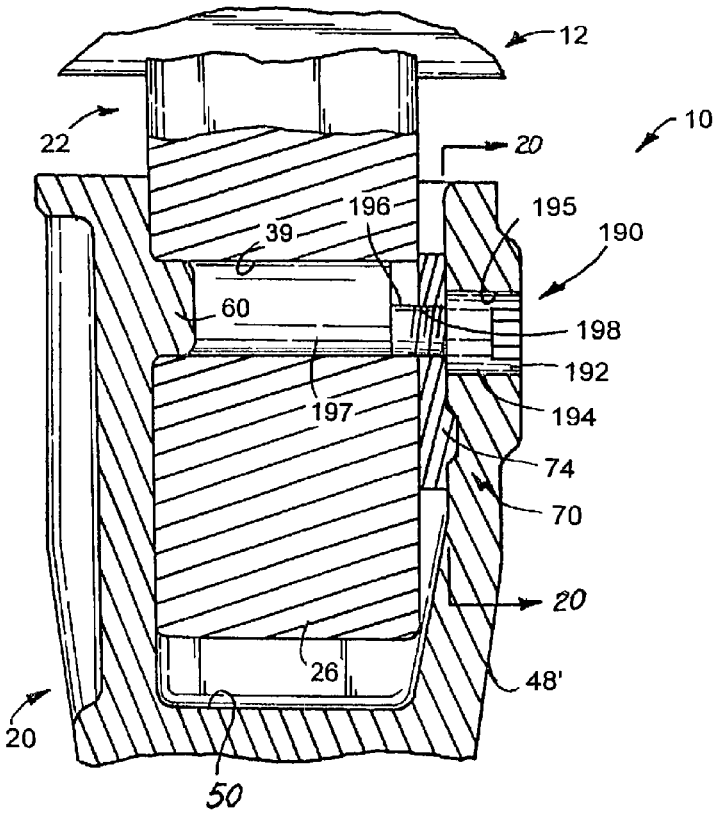
FIG. 18 is a view similar to FIG. 4 showing an alternative secondary lock for use in combination with this invention disclosure.
Figure 19:
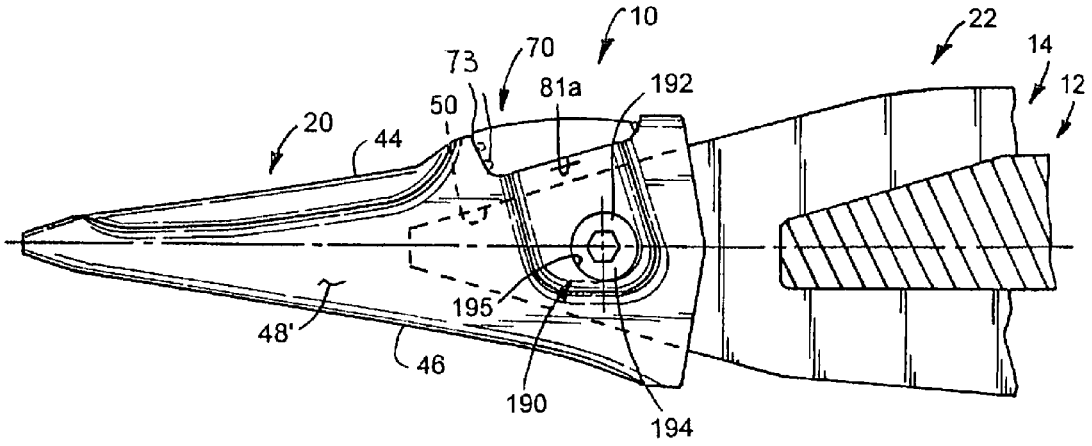
FIG. 19 is a view similar to FIG. 3 showing the alternative secondary lock for use in combination with this invention disclosure.

In that embodiment shown in FIG. 18, the secondary lock 190 includes an elongated member 192 having an enlarged head portion 194 and a shank portion 196. At least a lengthwise section of the shank portion 196, axially extending from the head portion 194 of member 192, is provided with external threading thereon. Moreover, and as illustrated by way of example in FIGS. 18 and 19, the head portion 194 of member 192 is configured to accommodate a tool (not shown) suitable for imparting rotation to member 192 from outside the tooth or wear part 20.

Figure 20:
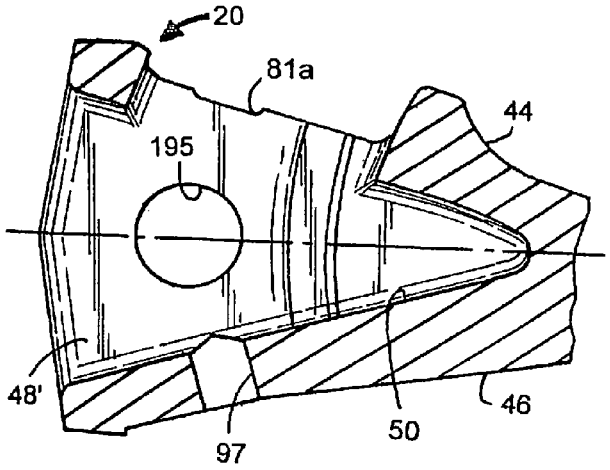
FIG. 20 is a sectional view taken along line 20-20 of FIG. 18 showing a preferred design of the wear part/digging tooth to accommodate the secondary lock shown in FIGS. 18 and 19.

When wear part 20 and the adapter nose portion 26 are arranged in operable combination with each other, and in example shown in FIG. 18, the head portion 194 and shank portion 196 of member 192 extend endwise through a bore 195 (FIGS. 18, 19 and 20) provided in the side wall or surface 48' and opening to cavity 50. When the secondary lock 190 is in an operative position shown in FIG. 18, the head portion 194 of member 192 is preferably accommodated within the confines defined by the closed margin of the bore 195 defined by tooth/part 20 and protected against wear during operation of assembly 10.

Figure 21:
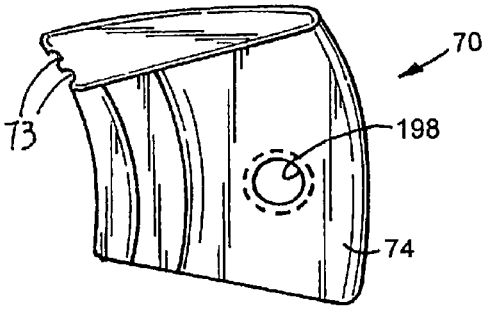
FIG. 21 is a view similar to FIG. 8 showing an alternative design for the securement member to accommodate the secondary lock shown in FIGS. 18 and 19.

In the example illustrated in FIG. 18, and when member 192 is inserted fully into operable combination with the wear part 20 and adapter nose portion 26, the free end of the shank portion 196 of member 192 axially extends into the recess 39 in the adapter nose portion 26 thereby furthermore inhibiting inadvertent longitudinal translation of part 20 relative to the adapter nose portion 26. In the example shown, and to inhibit inadvertent separation of member 70 from between part 20 and the adapter nose portion 26, the threaded shank portion 196 of member 192 threadably engages with a threaded opening 198 (FIG. 21) extending through the shank portion 74 of securement member 70. As such, securement member 70 is maintained in position between part 20 and adapter 22 by the secondary lock 190 thereby releasably maintaining part 20 and the adapter nose portion 26 in operable combination with each other until the secondary lock 190 is removed from operable association with securement member 70.

To add strength and rigidity to that section of the adapter nose portion 26 defining the bore 39, the secondary lock 190 can further include a metal, preferably steel, insert 197 between the free end of lock 60 and the distal end of the threaded shank portion 196 of member 192. Preferably, insert 197 would have a cross-sectional configuration which proximates the cross-sectional configuration of bore 39 defined by the adapter nose portion 26. Moreover, the insert 197 would have a length generally equal to the length separating the free end of lock 60 from the distal end of the threaded shank portion 196 of member 192 when member 192 is fully engaged with the securement member 70 so as to furthermore and advantageously limit displacement and movements of the wear part/tooth 20 on the adapter nose portion 26 during operation of the digging tooth assembly 10.

Figure 22:
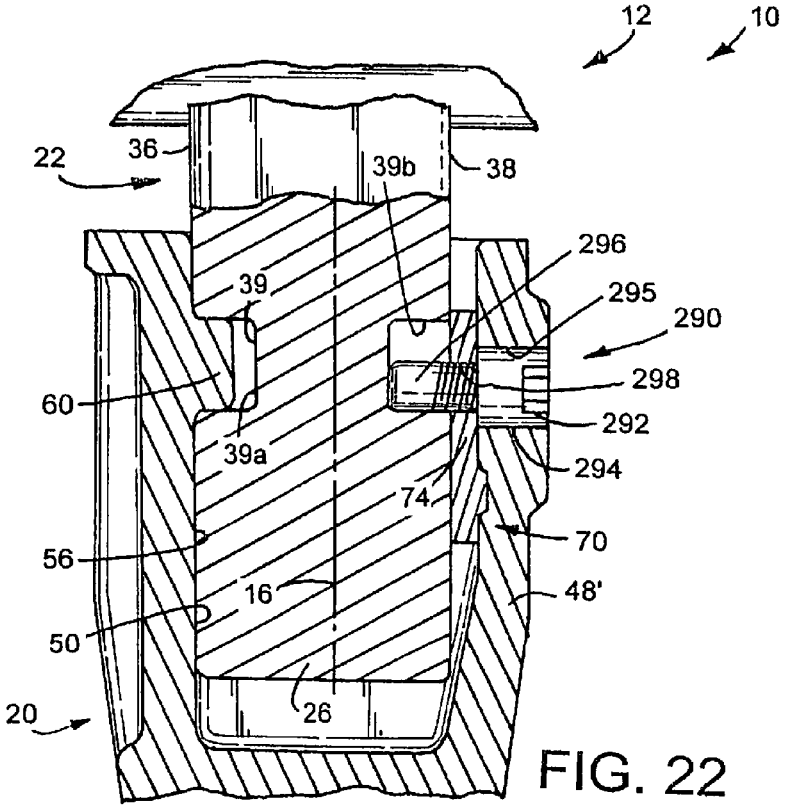
FIG. 22 is a view similar to FIG. 4 showing another alternative secondary lock for use in combination with this invention disclosure.

Another alternative secondary lock design is illustrated by way of example in FIG. 22. This alternative form of secondary lock is designated generally by reference numeral 290. The elements of wear part 20, the adapter nose portion 26, and securement member 70 which are similar to those mentioned above are identified by like reference numerals.

In the embodiment shown in FIG. 22, the recess or bore 39 in the adapter nose portion 26 is defined by a pair of axially aligned blind bores **39*a* and 39*b*. Each void or opening 39*a* and 39*b* opens to a respective exterior side or surface 36 and 38 of the adapter nose portion 26. Moreover, each void or opening 39*a* and 39*b* preferably has a closed marginal edge; with the blind bore 39*a* being configured to endwise accommodate the lock 60**.

In the embodiment illustrated in FIG. 22, the secondary lock 290 includes an elongated member 292 having an enlarged head portion 294 and a shank portion 296. At least a lengthwise section of the shank portion 296, axially extending from the head portion 294 of member 292, is provided with external threading thereon. As with the secondary lock embodiment illustrated in FIGS. 18 and 19, the head portion 294 of member 292 is configured to accommodate a tool (not shown) suitable for imparting rotation to member 292 from outside the tooth or wear part 20.

When wear part 20 and the adapter nose portion 26 are arranged in operable combination with each other, and in the example shown in FIG. 22, the head portion 294 and shank portion 296 of member 292 extend endwise through a bore 295 (similar to bore 195 illustrated in FIGS. 19 and 20) provided in part 20. As such, head portion 294 of member 292 is preferably accommodated and protected against wear within the confines defined by the closed margin of the bore 295 on the wall or surface 48' of part 20 during operation of assembly 10.

When member 292 is inserted fully into operable combination with wear part 20 and adapter nose portion 26, a lengthwise section of shank portion 296 axially extends through member 70 and into the recess **39*b* in the adapter nose portion 26 thereby furthermore inhibiting inadvertent longitudinal translation of part 20 relative to the adapter nose portion 26. In this embodiment, the shank portion 296 of member 292 is sized such that the free end thereof engages with and presses against the closed end of the blind cavity 39*b* whereby advantageously moving part 20 relative to the adapter nose portion 26 and in a direction whereby further securing lock 60 within the blind cavity 39*a* on the other side of the adapter nose portion 26**.

In the example shown in FIG. 22, and to inhibit inadvertent separation of lock 290 from securement member 70, the threaded shank portion 296 of member 292 engages with an opening 298 (similar to opening 198 illustrated in FIG. 19) extending through the shank portion 74 of member 70. As such, securement member 70 is maintained in position between part 20 and the adapter nose portion 26 by the secondary lock 290 thereby releasably maintaining part 20 and the adapter nose portion 26 in operable combination with each other until the secondary lock 290 is removed from operable association with securement member 70.

Figure 23:
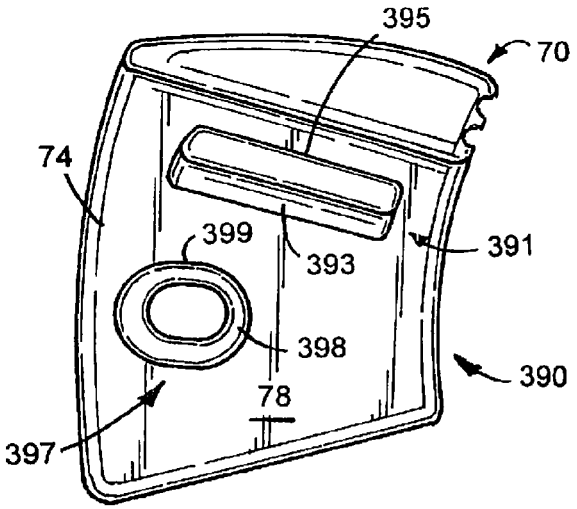
FIG. 23 is an enlarged view of a securement member similar to FIG. 11 showing another alternative secondary lock design.
Figure 24:
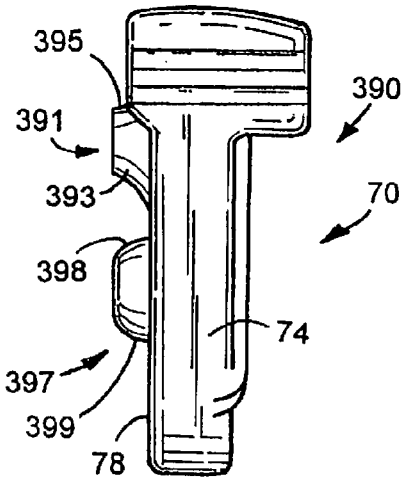
FIG. 24 is an elevational view of the securement member illustrated in FIG. 23.
Figure 25:
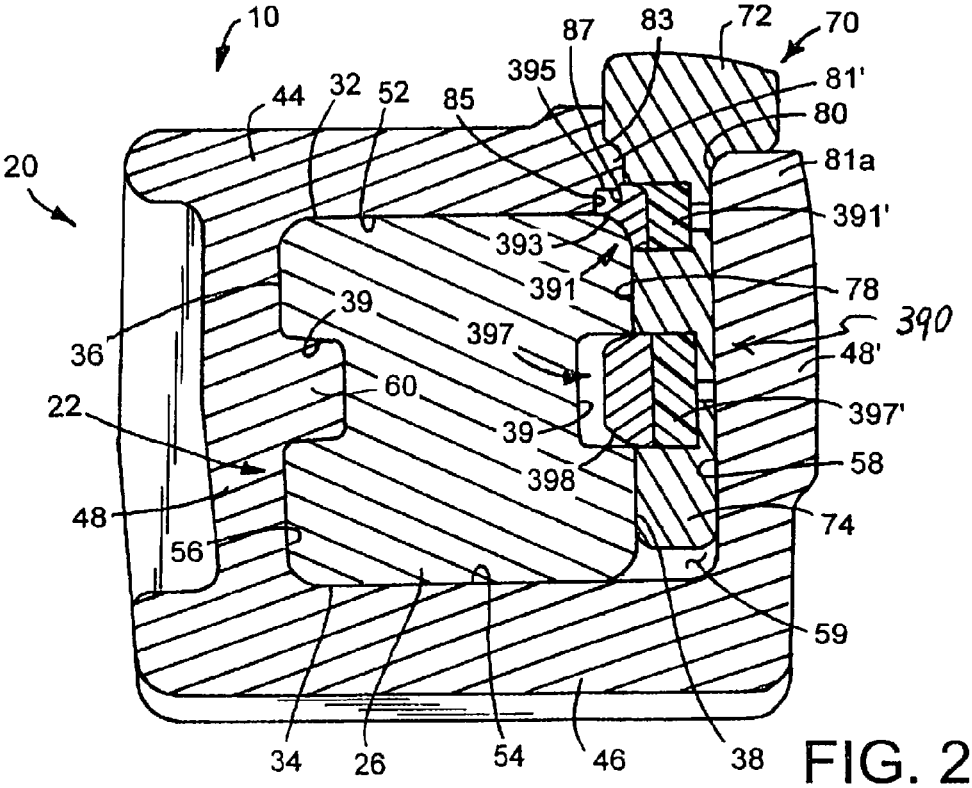
FIG. 25 is an enlarged transverse sectional view illustrating the securement member shown in FIGS. 23 and 24 in operable combination with a wear assembly according to the present disclosure.

Still another alternative secondary lock arrangement for maintaining securement member 70 in operable association with and between part 20 and adapter nose portion 26 is illustrated by way of example in FIGS. 23, 24 and 25. This alternative form of secondary lock is designated generally by reference numeral 390. The elements of wear part 20, the adapter nose portion 26, and lock 70 which are similar to those mentioned above are identified by like reference numerals.

This form of secondary lock 390 is preferably carried by the securement member 70 having a design substantially similar to that discussed above. Accordingly, the same reference numerals will be used for securement member 70 as were used above. As shown in FIGS. 23 and 24, this alternative form of secondary lock 390 is designed as a detent mechanism and preferably includes a resiliently biased elongated detent 391 extending longitudinally across and laterally from side 78 of the shank portion 74 of member 70 adapted to be arranged in confronting relation relative to the adapter nose portion 26 when member 70 is inserted into operable combination with tooth 20 (FIG. 24). While the free end of detent 391 extends from the shank portion 74 of member 70, it is to be understood detent 391 is preferably captured and carried by the shank portion 74 of member 70. Moreover, detent 391 is preferably configured with a chamfered lower surface or edge 393 and an upper edge 395. Edge 395 preferably extends generally normal to that side 78 of the shank portion 74 of the member 70 adapted to be arranged in confronting relation relative to the adapter nose portion 26 when member 70 is inserted into operable combination with the tooth 20 (FIG. 25).

Detent 391 of the secondary lock 390 is permitted to initially move inwardly toward that side 78 of the shank portion 74 of member 70, adapted to be arranged in confronting relation relative to the adapter nose portion 26, when member 70 is inserted between part 20 and the adapter nose portion 26 (FIG. 25). When the securement member 70 is fully inserted unto operable combination with part 20 and the adapter nose portion 26, detent 391 springs back to the position shown in FIG. 24 under the influence of a resilient member 391'.

In the embodiment shown in FIG. 25, a marginal edge of opening 80 in the upper slanted wall 44 of part 20 is provided with a longitudinally elongated and free-ended lip 81'. Notably, the free end of lip 81' is arranged in general vertical alignment with the exterior side or surface 38 of the adapter nose portion 26 when part 20 and the adapter nose portion 26 are arranged in operable combination relative to each other. In the illustrated embodiment, part 20 further defines a chamfered or angled surface 83 extending upwardly and laterally from the free end of the lip 81' toward an upper surface on the upper wall 44. In the illustrated embodiment, part 20 further defines an undercut or recess 85 extending laterally from the free end of the lip 81' and defining a shoulder 87 extending at an angle of about 90° relative to the free end of the lip 81'.

Returning to FIGS. 23 and 24, this alternative form of secondary lock 390 can furthermore include a second resiliently biased detent 397 laterally extending from side 78 of the shank portion 74 of securement member 70 in vertically spaced relation from detent 391. Detent 397 is adapted to be arranged in confronting relation relative to the adapter nose portion 26 when member 70 is inserted into the relief 59 defined between confronting surfaces on the adapter nose portion 26 and part 20 (FIG. 25). Preferably, detent 397 has a button-like configuration with a chamfered outer edge 398. Like detent 391, detent 397 is captured and carried by the securement member 70 and operates under the influence of a resilient member 397'. As shown, detent 397 preferably has an outer diameter 399 generally equal to the outer diameter of recess 39 opening to that exterior side of the adapter nose portion 26 to be arranged in confronting relation relative to the member 70 when the adapter nose portion 26 and part 20 are arranged in locked relation relative to each other. When member 70 is inserted into the relief or space 59 between part 20 and adapter nose portion 26, the resilient detent 397 first moves inward toward side 78 of member 70. After the securement member 70 is fully inserted into the relief or space 59 between part 20 and adapter nose portion 26 (FIG. 25), the detent 397 snaps or returns to a position, as shown in FIG. 25, under the influence of the resilient member 397'.

As shown in FIG. 25, when the securement member 70 is inserted through the opening 80 in the upper wall or surface of part 20 and into the space or relief 59 between confronting surfaces on part 20 and the adapter nose portion 26, the chamfered outer edge 398 of detent 397 engages with the upper chamfered or slanted surface 83 extending from the lip 81' whereby forcibly causing the detent 397 to retract toward member 70 and move past the free-ended lip 81' on part 20. As member 70 is furthermore moved into the space 59 between part 20 and adapter 22, the chamfered lower surface 393 on detent 391 engages with the upper chamfered or slanted surface 83 extending from the lip 81' whereby forcibly causing detent 391 to retract toward member 70 and move past the free-ended tooth lip 81

As the securement member 70 is still furthermore inserted into the opening 80 in the upper wall or surface of part 20 and into the space 59 between confronting surfaces on part 20 the adapter nose portion 26 and when the upper edge 395 of detent 391 moves past the free-ended lip 81', the resiliency of detent 391 causes the detent 391 to spring into the undercut or recess 85 under the lip 81' whereby inhibiting the securement member 70 from inadvertently being displaced from between part 20 the adapter nose portion 26. Preferably, and substantially concurrently with the action of detent 391, the other resilient detent 397 springs into the recess 39 on the adapter nose portion 26 whereby furthermore securing securement member 70 against inadvertent displacement from between part 20 and the adapter nose portion 26 so as to inhibit longitudinal translation of part 20 relative to the adapter nose portion 26. The resiliency of the detents 391 and 397 furthermore permits removal of the securement member 70, when required or desired, from between part 20 and the adapter nose portion 26 so as to effect repair/replacement of the wear part when required or desired.

Figure 26:
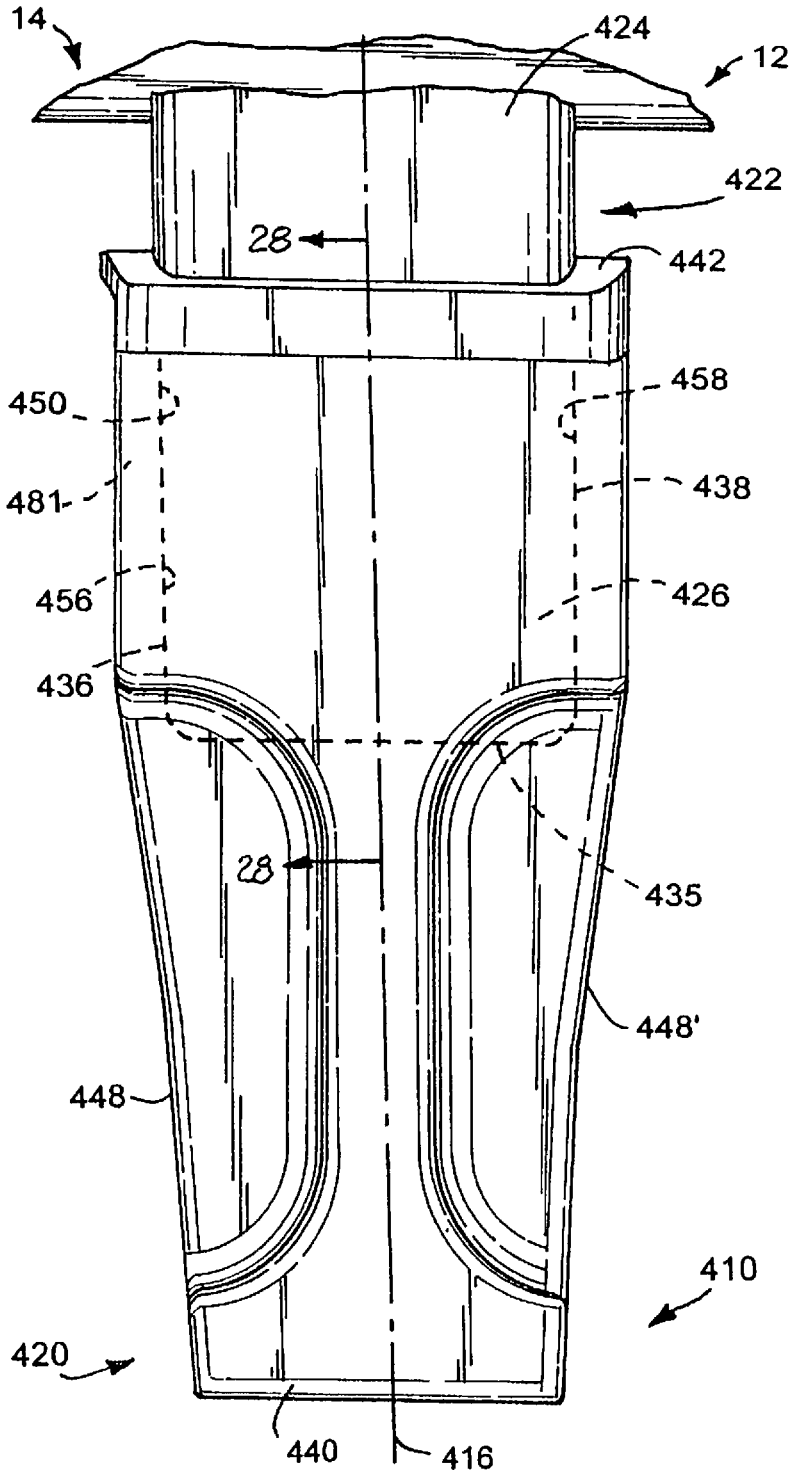
FIG. 26 is an enlarged top plan view of another form of wear assembly.
Figure 27:
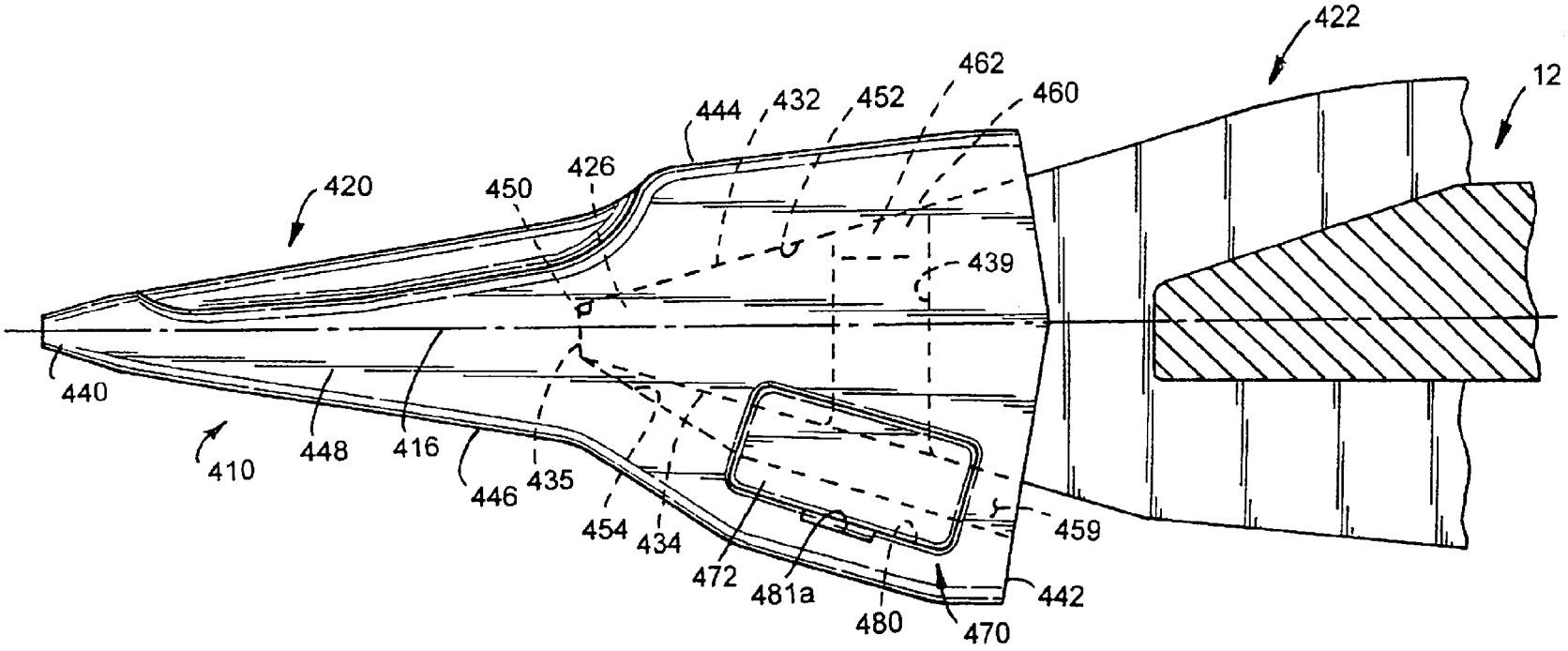
FIG. 27 is a side elevational view of the wear assembly illustrated in FIG. 26.
Figure 28:
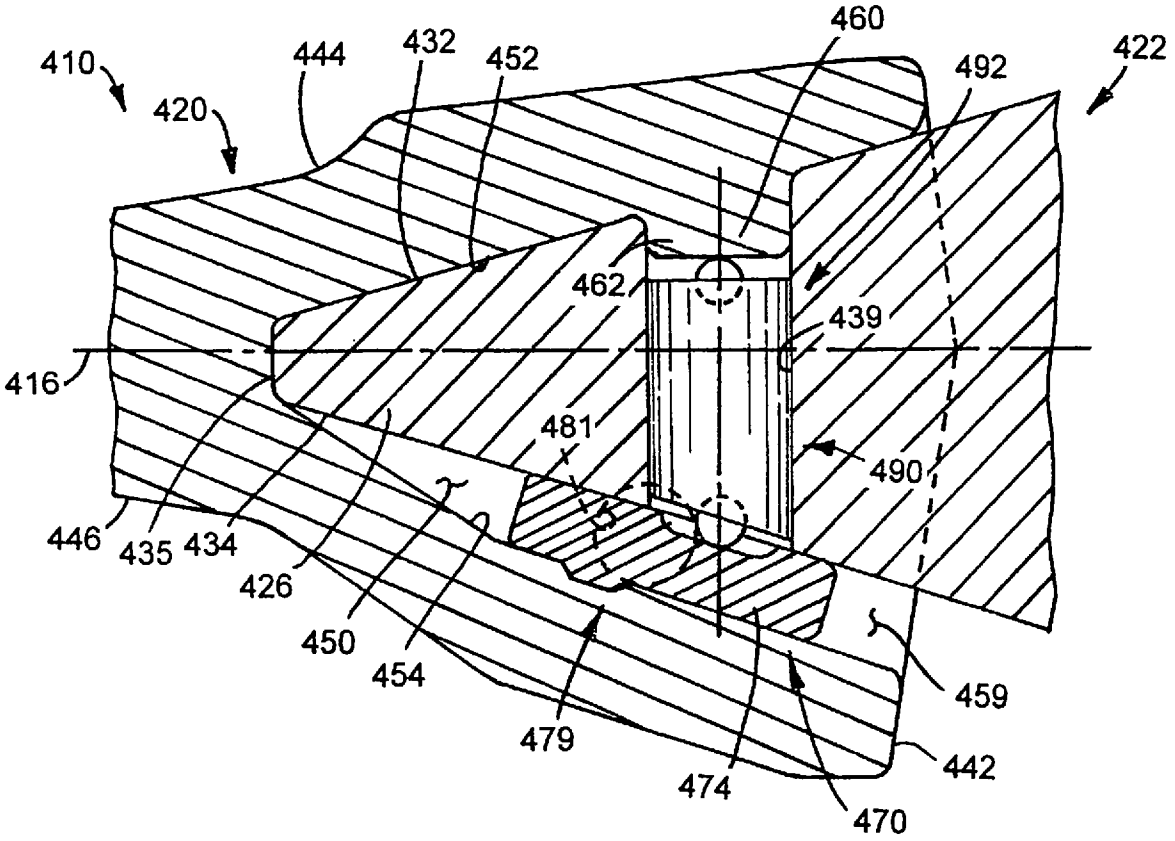
FIG. 28 is a fragmentary sectional view of the wear assembly shown in FIG. 26.

FIGS. 26, 27 and 28 illustrate another multipiece wear assembly including a wear part and adapter. The assembly illustrated in FIGS. 26 through 28 is designated generally by reference numeral 410 while the replaceable wear part is generally designed by reference numeral 420. In the illustrated embodiment, the replaceable wear part 420 is configured as a digging tooth. As mentioned, however, the wear part can take any of a myriad of different designs other than a tooth, i.e., a ripper, lip shroud, wear cap, etc. without detracting or departing from the true spirit and scope of this invention disclosure. The adapter or support illustrated in FIGS. 26 through 28 is designated generally by reference numeral 422. The elements of this alternative wear assembly which are functionally analogous to those components or elements discussed above regarding wear part 20 and adapter 22 are designated by reference numerals identical to those listed above with the exception this embodiment uses reference numerals in the 400 series.

Turning to FIG. 26, the adapter 422 has an elongated and preferably unitary construction and includes a base portion 424 and an elongated nose portion 426 projecting forward from the base portion 424. The adapter base portion 424 is configured for suitable attachment to the edge or lip 12 of the bucket or implement 14 through any suitable and well known means including clamps, fasteners, welding, etc.

The configuration of the adapter nose portion 426, illustrated by way of example in FIGS. 26 through 28, is such that a cross-sectional configuration of the adapter nose portion 426 increases as measured rearwardly from a free end 435 of the adapter nose portion 426. In the example selected for illustrative purposes in FIGS. 27 and 28, the adapter nose portion 426 has top and bottom angled surfaces 432 and 434 which converge relative to each other and toward the free end 435 of the adapter 422. In the embodiment shown in FIG. 26, the adapter nose portion 426 furthermore includes a pair of laterally spaced sides 436 and 438 which, in the form used as an example, extend generally parallel to each other. Suffice it to say, the adapter nose portion 426 has a first predetermined configuration.

As shown in FIG. 28, the adapter or support 422 defines a recess or bore 439 extending generally normal to the axis 416 of assembly 410. In the form shown in FIG. 28, recess 439 is defined by a vertically disposed throughbore which opens to the top and bottom exterior surfaces 432 and 434 of the adapter nose portion 426. In the illustrated embodiment, recess 439 has a closed marginal edge.

In the example shown in FIG. 27, the wear part/tooth 420 has an elongated wedge shape between a forward cutting edge or end 440, operative to engage the material to be worked, and a rear end 442 thereof. Like adapter 422, tooth 420 is preferably formed from a ferrous metal, i.e., steel or a steel alloy. Preferably, tooth 420 has a unitary design including an upper slanted wall or surface 444 and a lower slanted wall or surface 446 arranged in converging relation toward the end 440 of the tooth 420. As shown in FIG. 26, tooth 420 further includes a pair of side walls or surfaces 448 and 448' between walls 444 and 446, respectively (FIG. 27). Of course, the exterior sides or surfaces of tooth 420 can take a myriad of different shapes from that shown without detracting or departing from the true spirit and scope of this disclosure.

As shown in FIGS. 26 through 28, the wear part or tooth 420 defines an open-ended blind cavity or socket 450 for longitudinally receiving and accommodating at least a lengthwise section of the adapter nose portion 426. Suffice it to say, socket 450 has a predetermined configuration which compliments or proximates the configuration of the adapter nose portion 426. In the illustrated form, the socket 450 has a larger cross-sectional configuration toward an open end than toward a closed end thereof. In the illustrated embodiment, the tooth cavity or socket 450 has top and bottom angled interior surfaces 452 and 454 (FIGS. 27 and 28) which converge relative to each other. The tooth cavity or socket 450 furthermore includes a pair of spaced sides or interior surfaces 456 and 458 which, in one form, extend generally parallel to each other and to the longitudinal axis 416. Suffice it to say, the adapter nose portion 426 and tooth cavity or socket 450 have complimentary designs and/or configurations.

As shown in FIGS. 27 and 28, the interior surfaces 452 and 454 of cavity 450 are spaced or otherwise separated by a distance greater than the distance separating exterior surfaces 432 and 434, respectively, on the adapter nose portion 426. That is, the predetermined configuration of cavity 450 is larger in cross-section than the predetermined configuration defined by the adapter nose portion 426. As such, and as shown in FIG. 28, when the adapter nose portion 426 is operably assembled within cavity 450, a space or relief 459 is defined between exterior surface 434 on the adapter nose portion 426 and the confronting interior surface 454 on tooth cavity 450.

In the embodiment shown in FIG. 28, a free-ended lock 460 extends into the socket 450 and toward the axis 416 of assembly 410. Lock 460 has a cross-sectional configuration which is equal to or smaller than the cross-section of the recess 439 defined by the adapter nose portion 426. Notably, the distance separating the free end of lock 460 from the opposed surface 454 of tooth cavity 450 is such as to permit longitudinal translation of the adapter nose portion 426 relative to the tooth socket 450 and longitudinally past lock 460.

Lock 460 is preferably formed as a lug 462 formed integral with the tooth 420. As discussed above, however, other lock designs (see FIGS. 4, 5, 6 and 7) can be used and provided without detracting or departing from the true spirit and novel concept of this invention disclosure. As shown in FIG. 28, when the adapter nose portion 426 and tooth 450 are arranged in operable combination with each other, lock 460 is in registry with and extends into the recess 439 defined by the adapter nose portion 426. As such, part 420 is locked to the adapter nose portion 426 and the working loads and forces encountered by the assembly 410 during operation are advantageously transferred from the part 420 to the adapter 422 through the lock 460 extending into the recess 439 on the adapter nose portion 26.

In accordance with the present disclosure, and as illustrated by way of example in FIGS. 27 and 28, assembly 410 is furthermore provided with a spacer or securement member 470. As with securement member 70 discussed above, at least a portion of securement member 470 is insertable into the relief or space 459 defined between the confronting surfaces on the adapter nose portion 426 and cavity 450 so as to: at least partially fill the relief 459; establish bearing contact with an exterior surface on the adapter nose portion and an interior surface partially defining the cavity 450 in part 420; and, maintain lock 460 in an operative position so as to inhibit longitudinal translation of part 420 relative to the adapter nose portion 426. Preferably, securement member 470 extends in a direction relative to the longitudinal axis 416 of assembly 410 so as to advantageously avoid operating loads being applied directly thereto during operation of assembly 410. As such, wear on member 470 is minimized thus allowing securement member 470 to be reused, if desired, when a replacement part 420 is again attached to adapter 422.

The securement member or spacer 470 preferably has a design similar to lock 70 discussed in detail above and includes an enlarged head portion 472 (FIG. 26) and shank portion 474 (FIG. 27). Preferably, the exposed section of the head portion 472 of member 470 compliments the profile of tooth 420 to promote movement of material therepast.

The interior surface of cavity 450 along with the securement member 470 preferably have a key and keyway design, generally identified in FIG. 28 by reference numeral 479. The key and keyway design 479 are similar to the key and keyway design discussed in detail above. Such design advantageously allows securement member 470 to interact with part 420 so as to guide insertion of the member 470 into operable combination with part 420 while preferably limiting the direction securement member 470 can be correctly inserted into operable combination with part 420 and adapter nose portion 426.

In the example shown in FIG. 27, the side wall or surface 448' of the wear part or tooth 420 defines an opening 480 disposed adjacent to surface 454 of and extending through to the blind cavity or socket 450 of the tooth 420. Notably, in the example illustrated in FIG. 27, the opening 480 defined by tooth 420 is arranged adjacent to that surface of the blind cavity 450 opposite from lock 460. The opening 480 in part 420 permits the shank portion 474 of member 470 (FIG. 28) to pass endwise therethrough while limiting movement of the enlarged head portion 472 from passing therethrough. As such, the marginal edge of the opening 480 acts as a limit stop for the securement member 470.

An opening 481 (FIG. 28) in the bottom of wear part 420 is disposed in general alignment with member 460 and permits endwise passage of a suitably shaped tool (not shown) therethrough so as to engage and push upward against member 470 whereby facilitating removal of member 470, when required or desired, from the space or gap 459 between part 420 and the adapter nose portion 426 to effect repair/replacement of part 420. Passage of the tool through opening 481 on tooth 420 will cause displacement of the member 470 through the opening 480. Only after member 470 is removed from between part 420 and the adapter nose portion 426 can the wear part 420 be shifted from operable engagement with the lock 460 (FIG. 28) on part 420 and thereafter permitting the longitudinal translation of part 420 relative the adapter nose portion 426 to effect release of part 420 from the adapter nose portion 426.

When securement member 470 is fully inserted into operable combination with part 420 and the adapter nose portion 426, a section of the head portion 472 of member 470 overlies and is arranged in confronting relation relative to a section of part 420. As shown in FIG. 27, a slot or other suitably shaped recess 481*a* preferably extends to the exterior of tooth 420 from a marginal edge of the opening 480. Besides those steps mentioned above for effecting release of member 470 from engagement with the tooth 420 and adapter 422, opening 481*a* furthermore allows a suitably shaped tool (not shown) to be inserted between the head portion 472 of member 470 and that portion of the tooth 420 arranged in confronting relation relative thereto to effect separation between member 470 and part 420 whereby effecting release of the member 470. As mentioned above, the head portion 472 of securement member 470 can also be configured with notches or grooves similar to that shown in FIG. 8 so as to facilitate removal of securement member 470 from between part 420 and the adapter nose portion 426 whereby permitting repair/replacement of part 420 as required and/or desired.

As shown in FIG. 28, a secondary lock 490 is preferably provided for releasably maintaining member 470 in position between part 420 and the adapter nose portion 426 during operation of assembly 410 whereby inhibiting inadvertent longitudinal separation of part 420 relative to the adapter 422. More specifically, and in the example shown in FIG. 28, the secondary lock 490 is arranged in operable combination with the digging tooth 420, the adapter nose portion 426, and member 470.

In the embodiment shown in FIG. 28, the secondary lock 490 is designed as a detent mechanism 492 arranged within the recess 439 defined by the adapter nose portion 426 for releasably maintaining the securement member 470 between part 420 and the adapter nose portion 426 during operation of assembly 410. The mechanism 492 illustrated in FIG. 28 is substantially similar to and functions in the substantially the same manner as mechanism 92 discussed in detail above. It will be appreciated, however, and as discussed above, the secondary lock 490 can take various other configurations without detracting or departing from the spirit and scope of the present disclosure.

Figure 29:
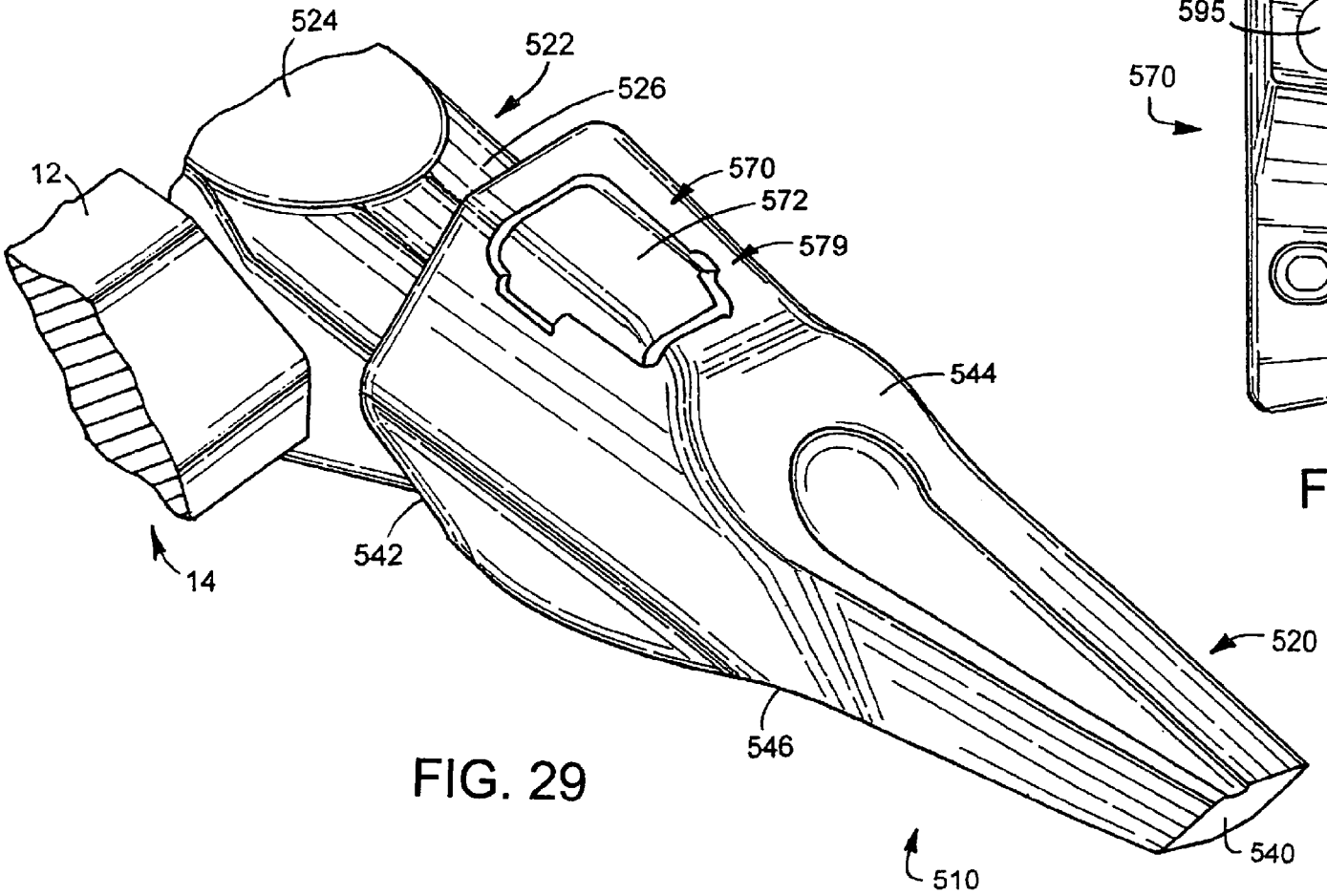
FIG. 29 is a perspective view of another form of wear assembly.
Figure 30:
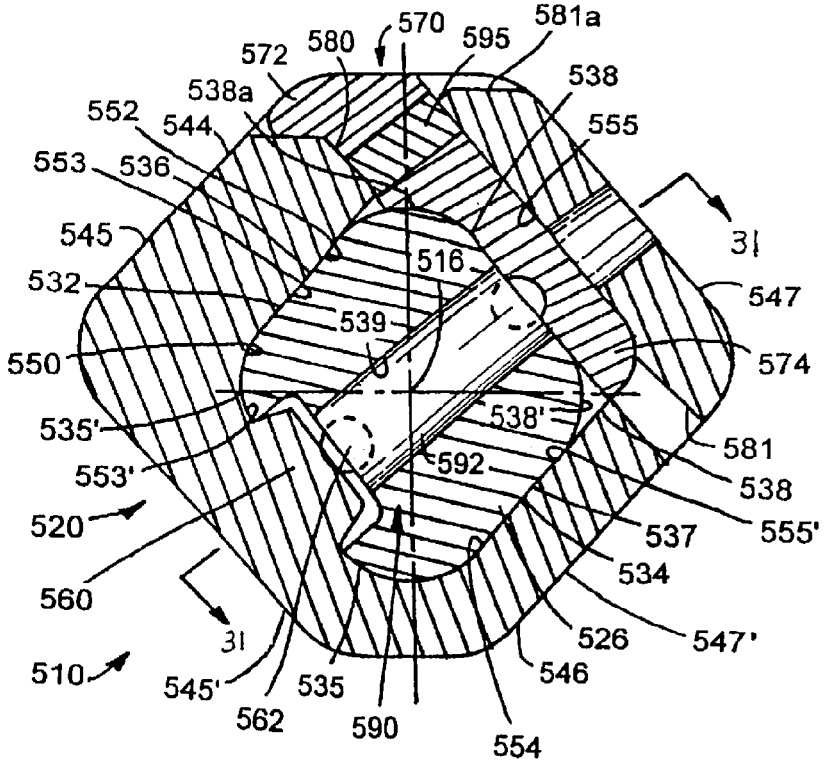
FIG. 30 is a transverse sectional view of the wear assembly shown in FIG. 29.
Figure 31:
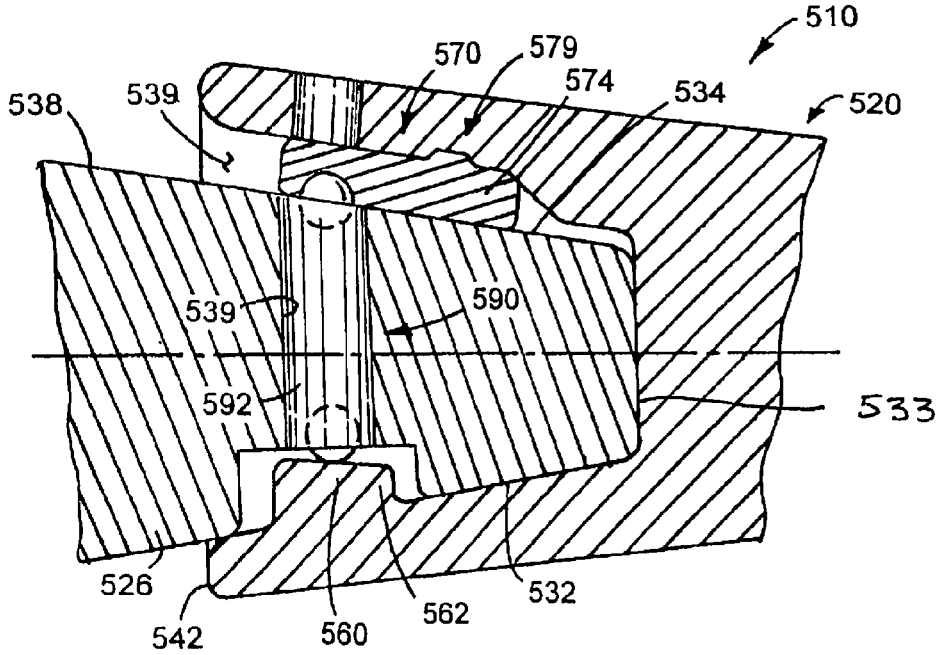
FIG. 31 is a sectional view taken along line 31-31 of FIG. 30.

FIGS. 29 through 31 illustrate yet another multipiece assembly including another form of tooth and adapter. The two-part assembly shown in FIGS. 29 through 31 is designated generally by reference numeral 510 while the tooth or wear part illustrated in FIGS. 29 through 31 is designated generally by reference numeral 520. In the illustrated embodiment, the replaceable wear part 520 is configured as a digging tooth. As mentioned, however, the wear part can take any of a myriad of different designs other than a tooth, i.e., a ripper, lip shroud, wear cap, etc. without detracting or departing from the true spirit and scope of this invention disclosure. The adapter or support illustrated in FIGS. 29 through 31 is designated generally by reference numeral 522. The elements of this alternative digging tooth assembly which are functionally analogous to those components or elements discussed above regarding part 20 and adapter 22 are designated by reference numerals identical to those listed above with the exception this embodiment uses reference numerals in the 500 series.

Turning to FIG. 29, the adapter 522 has an elongated and preferably unitary construction and includes a base portion 524 and an elongated nose portion 526 projecting forward from the base portion 524. The adapter base portion 524 is configured for suitable attachment to the edge or lip 12 of the bucket or implement 14 through any suitable and well known means including a clamp mechanism, fasteners, welding, etc.

The configuration of the adapter nose portion 526, illustrated by way of example in FIGS. 30 and 31, is such that the cross-sectional configuration of the adapter nose portion 526 increases as measured rearwardly from a free end of the adapter nose portion 526. In the example selected for illustrative purposes in FIGS. 30 and 31, the adapter nose portion 526 is configured in accordance with the teachings and principals set forth in U.S. Pat. Nos. 6,047,487 and 6,247,255 assigned to H&L Tooth Company; the applicable portions of which are incorporated herein by reference.

The adapter nose portion 526 has top and bottom angled surfaces 532 and 534 which converge relative to each other and toward the free end 533 (FIG. 31) of the adapter 522. In the embodiment shown in FIG. 30, the exterior top surface 532 of adapter nose portion 526 has two downwardly angled exterior sides 536 and 538 disposed to opposed lateral sides of the longitudinal axis 516 of assembly 510. Similarly, the bottom exterior surface 534 of adapter nose portion 526 preferably has two upwardly angled exterior sides 535 and 537 disposed to opposed lateral sides of the longitudinal axis 516 of assembly 510. In the embodiment illustrated in FIG. 30, the angled exterior sides 535 and 536 are joined to each other along an edge 535'. Similarly, in the embodiment illustrated in FIG. 30, the angled exterior sides 537 and 538 are joined to each other along an edge 538'. Suffice it to say, the nose portion 526 has a first predetermined configuration.

As shown in FIGS. 30 and 31, the adapter nose portion 526 defines a recess or bore 539 extending generally normal to the axis 516 of assembly 510. In the form shown in FIG. 30, recess 539 is defined by an angled throughbore which opens to the angled exterior side 538 of the top surface 532 of the adapter nose portion 526 to one side of the longitudinal axis 516 of assembly 510 and to the angled exterior side 535 of the bottom surface 534 of the adapter nose portion 526 on an opposed side of the axis 516 of assembly 510 while passing generally through the longitudinal axis 516 of assembly 510. Of course, recess 539 can alternatively be defined by an angled throughbore which opens to the angled exterior side 536 of the top surface 532 of the adapter nose portion 526 to one side of the longitudinal axis 516 of assembly 510 and to the angled exterior side 537 of the bottom surface 534 of the adapter nose portion 526 on an opposed side of the axis 516 of assembly 510 while passing generally through the longitudinal axis 516 without detracting or departing from the true spirit and scope of this invention disclosure. In the illustrated embodiment, recess 539 has a closed marginal edge.

In the example shown in FIG. 29, the wear part or tooth 520 has a longitudinally elongated wedge shape between a forward cutting or ground penetrating edge or end 540, operative to engage the material to be worked, and a rear end 542 thereof. Like adapter 522, tooth 520 is preferably formed from a ferrous metal, i.e., steel or a steel alloy. Preferably, tooth 520 has a unitary design including an upper slanted surface 544 and a lower slanted surface 546 arranged in converging relation toward the end 540 of the tooth 520. In the embodiment illustrated in FIG. 29, the upper or top exterior surface 544 of tooth 520 includes two downwardly angled exterior sides 545 and 547 disposed to opposed lateral sides of the longitudinal axis 516 of assembly 510. Similarly, the bottom exterior surface 546 of tooth 520 preferably has two upwardly angled exterior sides 545' and 547' disposed to opposed lateral sides of the longitudinal axis 516 of assembly 510. Of course, the exterior surfaces of wear part 520 can take a myriad of different shapes from that shown without detracting or departing from the true spirit and scope of this disclosure.

As shown in FIGS. 30 and 31, the wear part or tooth 520 defines an open-ended blind cavity or socket 550 for longitudinally receiving and accommodating at least a lengthwise section of the adapter nose portion 526. Suffice it to say, socket 550 has a predetermined configuration which compliments or proximates the configuration of the adapter nose portion 526. In the illustrated form, the socket 550 has a larger cross-sectional configuration toward an open end than toward a closed end thereof. In the illustrated embodiment, the cavity or socket 550 has top and bottom angled interior surfaces 552 and 554 (FIG. 30), respectively, which converge relative to each other and toward a forward or closed end of cavity 450.

In one form, and as described in further detail in the aforementioned U.S. patents to H&L Tooth Company, the top interior surface 552 of cavity 550 is defined, at least in part, by two angled interior sides 553 and 555 disposed to opposed sides of the longitudinal axis 516. In one form, each interior side 553 and 555 of the top interior surface 552 of cavity 550 extends at an acute angle ranging between about 35° and about 65° relative to the ground penetrating edge 540 of tooth 520. Similarly, and in the illustrated embodiment, the bottom interior surface 554 of cavity 550 is defined, at least in part, by two angled interior sides 553' and 555' disposed to opposed sides of the longitudinal axis 516. In one form, each interior side 553' and 555' of the bottom interior surface 554 of cavity 550 preferably extends at an acute angle ranging between about 35° and about 65° relative to the ground penetrating edge 540 of tooth 520. Suffice it to say, the tooth cavity 550 has a second predetermined configuration which is proximate to but different from the first predetermined configuration defined by the adapter nose portion 526.

In the embodiment shown in FIG. 30, the angled exterior sides 535 and 538 of the adapter nose portion 526 are spaced or otherwise separated from each other by a distance less than the distance separating the angled interior sides or surfaces 553' and 555 of the tooth cavity 550. Because the predetermined configuration of the tooth cavity 550 is larger in cross-section than the predetermined configuration defined by the adapter nose portion 526, and as shown in FIGS. 30 and 31, when the adapter nose portion 526 is operably assembled within the tooth cavity 550, a space or relief 559 is defined between the angled exterior side 538 on the adapter nose portion 526 and the confronting interior surface 555 on tooth cavity 550. Notably, however, in the embodiment illustrated in FIG. 30, the angled exterior sides 536 and 537 of the adapter nose portion 526 are spaced or otherwise separated from each other by a distance about equal to slightly less than the distance separating the angled interior sides or surfaces 553 and 554 of the tooth cavity 550. Of course, and without detracting or departing from the spirit and scope of this invention disclosure, the spacing between opposed exterior surfaces on the adapter nose portion 526 and tooth cavity 550 could be reversed such that the relief 559 is disposed other than as shown for illustrative purposes in FIGS. 30 and 31.

In the embodiment shown in FIGS. 30 and 31, a free-ended lock 560 extends into the socket 550 and toward the tooth assembly axis 516. In the embodiment shown, lock 560 has a cross-sectional configuration which is equal to or smaller than the cross-section of the recess 539 defined by the adapter nose portion 526. Notably, the distance separating the free end of lock 560 from the opposed surface 555 of tooth cavity 550 is such as to permit longitudinal translation of the adapter nose portion 526 relative to the tooth socket 550 and longitudinally past lock 560.

In the embodiment shown in FIGS. 30 and 31, lock 560 is a lug 562 formed integral with tooth 520. As discussed above, however, other lock designs (see FIGS. 4, 5, 6 and 7) can be used and provided without detracting or departing from the true spirit and novel concept of this invention disclosure. As shown in FIGS. 30 and 31, when the adapter nose portion 526 and tooth 550 are arranged in operable combination with each other, lock 560 is in registry with and extends into the recess 539 defined by the adapter nose portion 526. As such, the working loads and forces encountered by the tooth assembly during operation are advantageously transferred from the digging tooth 520 to the adapter 522 through the lock 560 extending into the recess 539 on the adapter nose portion 526.

As illustrated by way of example in FIGS. 30 and 31, assembly 510 is furthermore provided with a spacer or securement member 570. As with securement member 70 discussed above, and as shown in FIG. 31, at least a part of securement member 570 is insertable into the relief or space 559 defined between the confronting surfaces on the adapter nose portion 526 and tooth cavity 550 so as to: at least partially fill the relief 559; engage confronting surfaces on the adapter nose portion 26 and cavity 550; and, maintain lock 560 in position so as to inhibit longitudinal translation of part 520 relative to the adapter nose portion 526. Preferably, securement member 570 extends in a direction relative to the longitudinal axis 516 of assembly 510 so as to advantageously avoid operating loads being applied directly thereto during operation of the digging tooth assembly.

In the embodiment shown in FIG. 30, at least a portion 574 of securement member 570 fits between the exterior of adapter nose portion 526 and the interior of the tooth socket 550 opposite from lock 560. By this design, member 570 advantageously avoids operating loads being applied directly thereto during operation of assembly 510. As such, wear on securement member 570 is minimized thus allowing securement member 570 to be reused, if desired, when a replacement part 520 is again attached to adapter 522.

Figure 32:
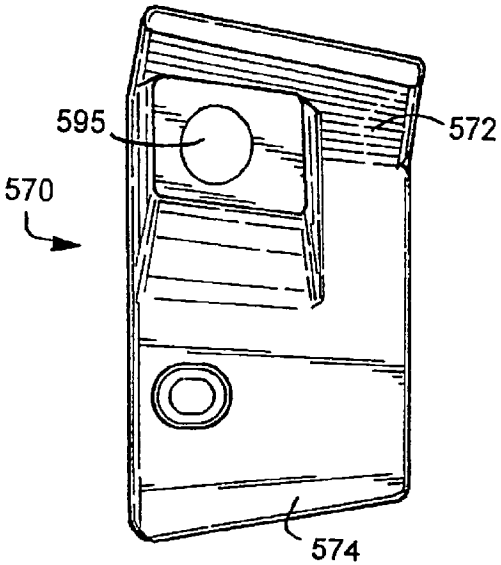
FIG. 32 is an elevational view of another form of securement member used in combination with the wear assembly shown in FIG. 29.

The securement member or spacer 570 preferably has a design similar to lock 70 discussed in detail above and includes an enlarged head portion 572 (FIGS. 29 and 32) and shank portion 574 (FIGS. 30, 31 and 32). Preferably, the exposed section of the member head portion 572 complements the exterior profile of part 520 to promote movement of material therepast.

The interior surface of tooth cavity 550 along with the securement member 570 preferably have a key and keyway design, generally identified in FIG. 31 by reference numeral 579. The key and keyway design 579 is similar to the key and keyway design discussed in detail above except in this embodiment the key and keyway design preferably has a generally linear design as compared to the curved or arcuate key and keyway design discussed above. This design change notwithstanding, the key and keyway 579 preferably provided in combination with the securement member 570 and the cavity 550 advantageously allows securement member 570 to interact with part 520 so as to guide insertion of the member 570 into operable combination with the part 520 while preferably limiting the direction securement member 570 can be inserted into operable combination with part 520 and adapter nose portion 526.

In the example shown in FIG. 30, the top exterior surface 544 of the wear part or tooth 520 defines an opening 580 arranged offset from the axis 516 of assembly 510 and which opens adjacent to the angled interior side 555 of and extends through to the blind cavity or socket 550 of part 520. Notably, in the example illustrated in FIG. 30, the opening 580 defined by part 520 is arranged opposite from lock 560. The opening 580 in part 520 permits the shank portion 574 of member 570 (FIG. 30) to pass endwise therethrough while limiting movement of the enlarged head portion 572 of member 570 from passing completely into the recess 539.

In the embodiment of the securement member illustrated in FIGS. 30 and 32, a lower section of the securement member 570 is configured to engage with the adapter nose portion 526. That is, in the embodiment illustrated by way of example in FIG. 30, the angled exterior sides 536 and 538 on the upper surface 532 of the adapter nose portion are joined to each other along a longitudinally extending edge 538*a*. In the embodiment illustrated by way of example in FIG. 30, the longitudinally extending edge 538*a* has a curved or arcuate configuration in cross-section. Moreover, the lower section of the securement member 570 is configured to engage with the longitudinally extending edge 538*a* on the adapter nose portion whereby adding stability and strength to the releasable conjunction between part 520 and the adapter nose portion 526.

As shown in FIG. 30, an opening 581 in the exterior surface 546 of wear part 520 and which opens proximate to the angled interior side 555 of cavity 550 permits endwise passage of a suitably shaped tool (not shown) therethrough so as to engage and push from underneath and against member 570 whereby facilitating removal of member 570, when required or desired, from the space or gap 559 between wear part 520 and the adapter nose portion 526 to effect repair/replacement of the wear part 520. Passage of the tool through opening 581 on tooth 520 will cause displacement of member 570 through the tooth opening 580. Only after member 570 is removed from between part 520 and adapter nose portion 526 can the lock 560 (FIG. 30) be released and thereafter permit the longitudinal translation of part 520 relative the adapter nose portion 526 to effect release of the part 520 from adapter 522.

When securement member 570 is fully inserted into operable combination with part 520 and adapter 522, a section of the head portion 572 of member 570 preferably overlies and is arranged in confronting relation relative to a section of part 520. As shown in FIG. 30, a slot or other suitably shaped recess 581*a* extends to the exterior of tooth 520 from a marginal edge of the opening 580. Besides those steps mentioned above for effecting release of member 570 from engagement with part 520 and adapter 522, opening 581*a* allows a suitably shaped tool (not shown) to be inserted between head portion 572 of member 570 and that section of part 520 arranged in confronting relation relative thereto to effect separation between member 570 and part 520 whereby effecting release of the securement member 570. As mentioned above, the head portion 572 of securement member 570 can also be configured with notches or grooves similar to that shown in FIG. 8 to facilitate removal of member 570 from between part 520 and the adapter nose portion 526 whereby permitting repair/replacement of part 520 as required and/or desired.

As shown in FIGS. 30 and 31, a secondary lock 590 is preferably provided for releasably maintaining member 570 in position between part 520 and the adapter nose portion 526 during operation of assembly 510 whereby inhibiting inadvertent longitudinal separation of part 520 relative to the adapter 522. More specifically, and in the example shown in FIGS. 30 and 31, the secondary lock 590 is arranged in operable combination with part 520, the adapter nose portion 526, and member 570.

In the embodiment shown in FIGS. 30 and 31, the secondary lock 590 is designed as a detent mechanism 592 arranged within the recess 539 defined by the adapter nose portion 526 for releasably maintaining member 570 between part 520 and the adapter nose portion 526 during operation of assembly 510. In the embodiment illustrated in FIGS. 30 and 31, mechanism 592 is substantially similar to and functions in the substantially the same manner as mechanism 92 discussed in detail above.

It will be appreciated, however, and as discussed above, the secondary lock 590 can take varied configurations without detracting or departing from the spirit and scope of the present disclosure. For example, the secondary lock for releasably maintaining the securement member 590 operably between part 520 and adapter nose portion 526 can involve forming the locking member 570 from a magnetic material. Alternatively, and as shown in FIGS. 30 and 32, a magnetic insert 595 can be carried by and formed as part of the securement member 570. Although substantially any magnetic material would suffice, such magnetic insert 595 is preferably formed from a magnetic material including neodymium and of the type sold by K&J Magnetics, Inc. in Jamison, Pa. 18929.

As shown in FIG. 30, when securement member 570 is fully inserted between part 520 and adapter nose portion 526, the magnetic insert 595 is arranged in confronting and attractive relation with a portion of either part 520 and/or adapter nose portion 526. As such, the magnetic attraction between the insert 595 in securement member 570 and part 520 and/or adapter nose portion 526 inhibits inadvertent displacement of the securement member 570 from operably between part 520 and adapter nose portion 560 whereby maintaining part 520 and the adapter nose portion in operable combination relative to each other as through lock 560.

Still another alternative lock design for releasably securing a wear part of a multipiece assembly to an adapter is illustrated by way of example in FIGS. 32 through 36. This alternative multipiece assembly is designated generally in FIGS. 32 through 36 by reference numeral 610. The elements of this alternative multipiece assembly design that are functionally analogous to those components discussed above regarding assembly 10 are designated by reference numerals identical to those listed above with the exception the elements of this alternative multipiece assembly uses reference numerals in the 600 series.

As discussed above, wear assembly 610 has a longitudinal axis 616 and includes a replaceable wear part 620 and an adapter or support 622. In the illustrated embodiment, the replaceable wear part 620 is configured as a digging tooth. As mentioned, however, the wear part 620 of assembly 610 can take a myriad of different designs other than a tooth, i.e., a ripper, lip shroud, wear cap, etc. without detracting or departing from the spirit and scope of this invention disclosure.

In the exemplary embodiment illustrated in FIG. 33 through 36, the replaceable wear part or tooth 620 of the wear assembly 610 has a longitudinally elongated wedge shape between a forward end and a rear end thereof. The outer configuration of the tooth 620 can take a myriad of designs without detracting or departing from the spirit and scope of this disclosure.

As shown in FIGS. 33 through 36, tooth 620 defines an open-ended blind cavity or socket 650 extending generally parallel to the longitudinal axis 616 of assembly 610 for longitudinally receiving and accommodating at least a lengthwise section of the adapter nose portion 626 by relative longitudinal movement or translation. The blind cavity 650 defined by tooth 620 is at least partially defined by a pair of opposed and spaced interior top and bottom surfaces separated by a predetermined distance and a pair of side surfaces extending between the top and bottom surfaces of the cavity 650. The wear member or tooth 620 further defines first and second bores 645 and 645', respectively, which open to opposed exterior surfaces or sides of the wear member 620 and to cavity 650. The tooth 620 shown in FIGS. 33 through 36 has top and bottom walls or surfaces 644 and 646, respectively, which converge relative to each other and toward a forward end of the tooth similar to that shown in FIG. 3.

As mentioned above regarding adapter 22, the adapter 622 includes a base portion 624 for allowing assembly 610 to be suitably connected to an edge or lip 12 of a bucket or digging implement 14 through any suitable and well known means and a nose portion 626. Suffice it to say, the configuration of the adapter nose portion 626 illustrated by way of example in FIGS. 33 through 36 is such that it permits the adapter nose portion 626 to be longitudinally received and accommodated within the socket 650 defined by the wear member 620. The adapter nose portion 626 has a second predetermined configuration which proximates the first predetermined configuration of the cavity 650 in wear member 620. The configuration of the adapter nose portion 626 is at least partially defined by two opposed and spaced exterior surfaces.

As discussed above regarding adapter 22, the spacing between at least two of the spaced and opposed exterior surfaces of the adapter nose portion 626 is less than the spacing between the confronting and opposed interior surfaces on the cavity 650 such that, when the adapter nose portion 626 is arranged in operable combination with part 620, a relief 659 is defined between the confronting interior and exterior surfaces on the socket 650 of part 620 and the adapter nose portion 626, respectively. In the embodiment shown in FIGS. 33 through 36, and as discussed above, the relief 659 longitudinally opens to the rear end of the wear member 620. As discussed above, as well as in the embodiment illustrated in FIGS. 33 through 36, the adapter nose portion 626 further defines a recess 639 opening to both opposed and spaced exterior surfaces on the adapter nose portion 626. As illustrated, when the wear member 620 and the adapter nose portion 626 are arranged in operative relation relative to each other, the recess 639 generally aligns with at least one of the bores 645 and 645' defined by the wear part 620.

Another alternative lock design is designated generally FIGS. 33 through 36 by reference numeral 660 and is provided in combination with assembly 610 for releasably maintaining the wear part 620 and adapter nose portion 626 in operable combination relative to each other. Lock 660 is arranged at least partially within the recess 639 defined by the adapter nose portion 626 for generally linear sliding movement. Lock 660 has first and second terminal and axially aligned ends 662 and 664, respectively. In the illustrated embodiment, a body portion 663 of lock 660 is disposed between and joins the ends 662 and 664. In one form, the body portion 663 has a cross-sectional configuration similar to that of the recess 639 in the adapter nose portion 626 but can have any suitable configuration allowing for translation of the lock 660 within the recess 639 of the adapter nose portion without detracting or departing from the spirit and scope of this invention disclosure. The ends 662 and 664 are axially separated by a distance generally equal to or slightly shorter than the predetermined distance separating two opposed interior surfaces partially defining the cavity 650 on part 620. Moreover, terminal end 662 of the lock 660 is sized to be removably accommodated within either bore 645 or 645' defined by part 620.

Figure 33:
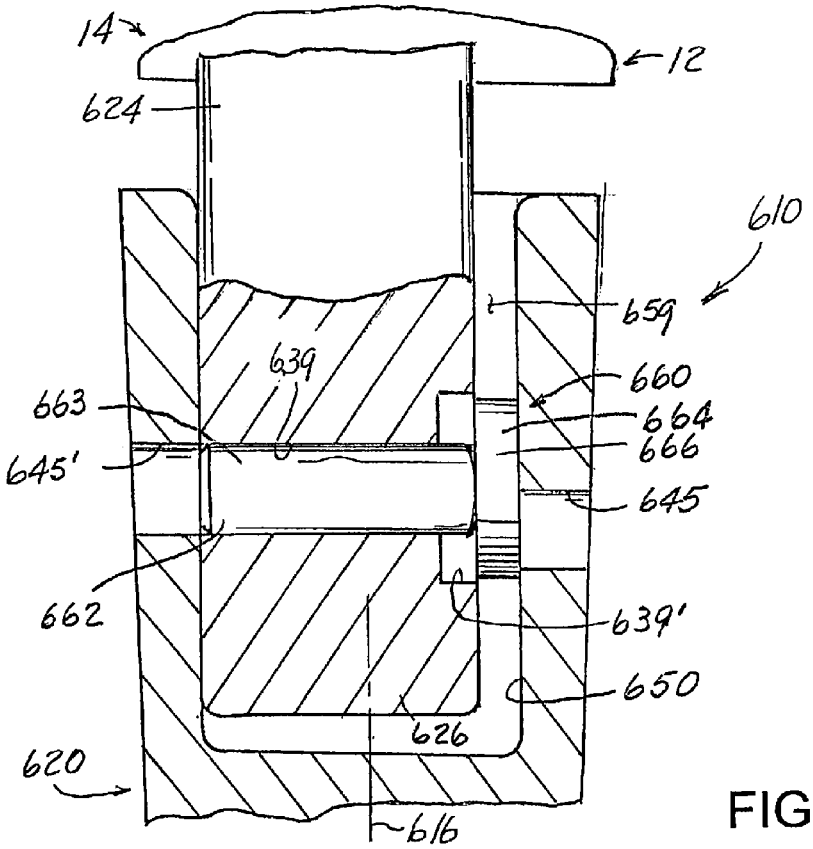
FIGS. 33 through 36 are views similar to FIG. 4 showing an alternative form of a wear assembly embodying principals and teachings of the present disclosure.

After inserting lock 660 into the recess 639 in the adapter nose portion 626, and as shown in FIG. 33, the part 620 can be longitudinally assembled to the adapter nose portion 626. Thereafter, and as illustrated in FIG. 33, the wear member 620 is moved or shifted relative to the adapter nose portion 626 until the exterior surface of the adapter nose portion 626 abuts against the confronting interior surface partially defining the blind cavity 650 whereby causing the first terminal end 662 of lock 660 to project from the opposite exterior surface of the adapter nose portion 626.

Figure 34:
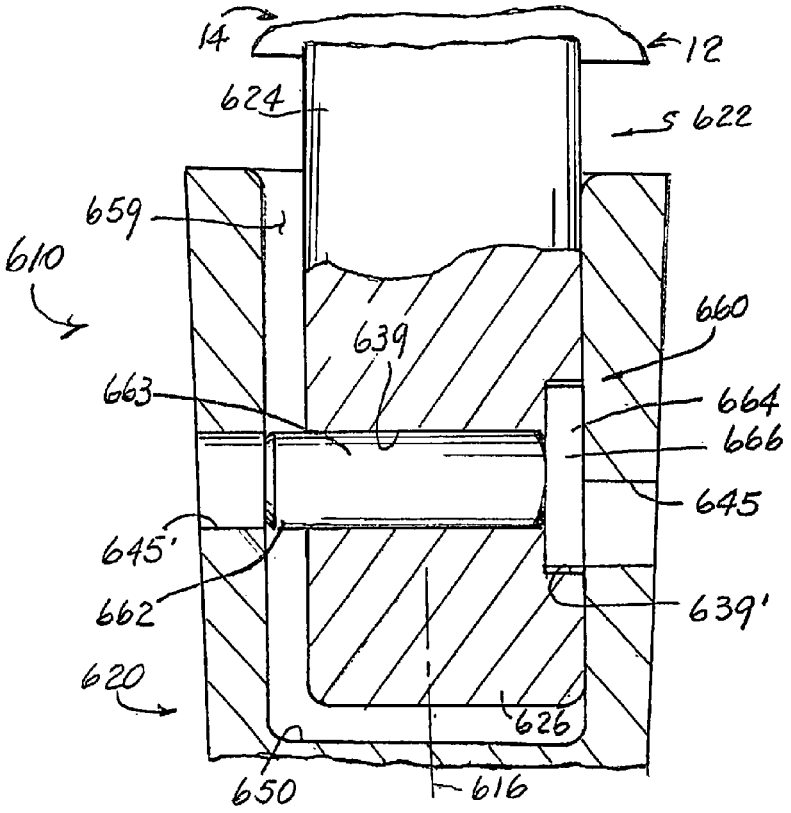
Figure 35:
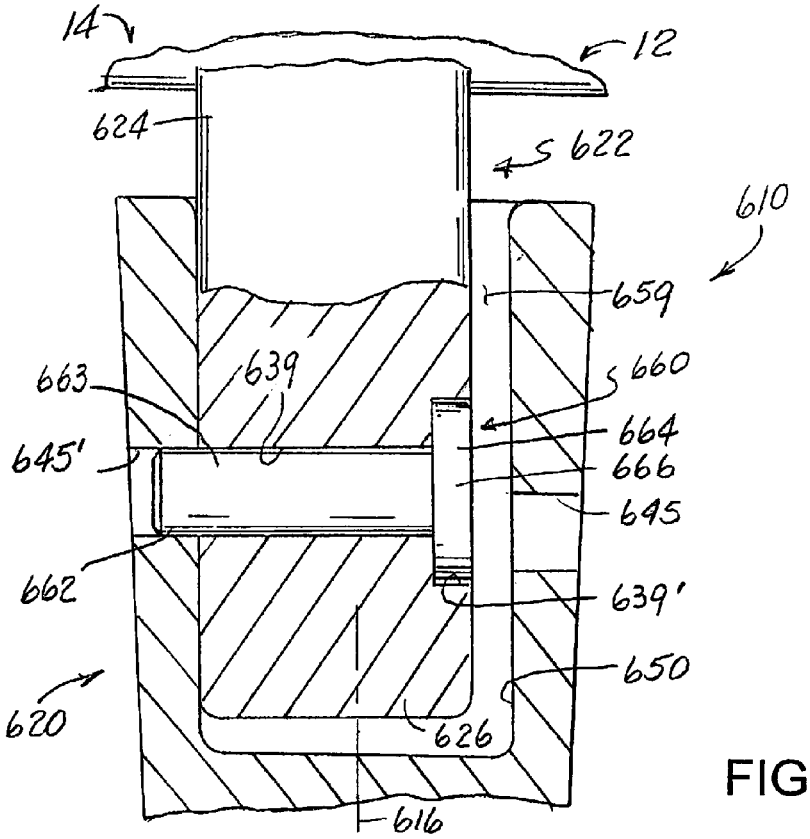

As illustrated in FIG. 34, the wear member 620 is next shifted in an opposite direction until the opposed exterior surface of the adapter nose portion 626 abuts against the confronting interior surface partially defining the blind cavity 650 so as to allow the terminal end 662 of lock 660 to project into bore 645' in part 620. As illustrated in FIG. 35, and because of the size differentiation between the predetermined configuration of the adapter nose portion 626 and the predetermined configuration of cavity 650 defined by part 620, this shifting action of the wear member 620 relative to the adapter nose portion 626 opens the relief 659 between the confronting exterior surface on the adapter nose portion 626 and the interior surface partially defining the blind cavity 650 opposite from the first terminal end 662 of lock 660.

Figure 36:
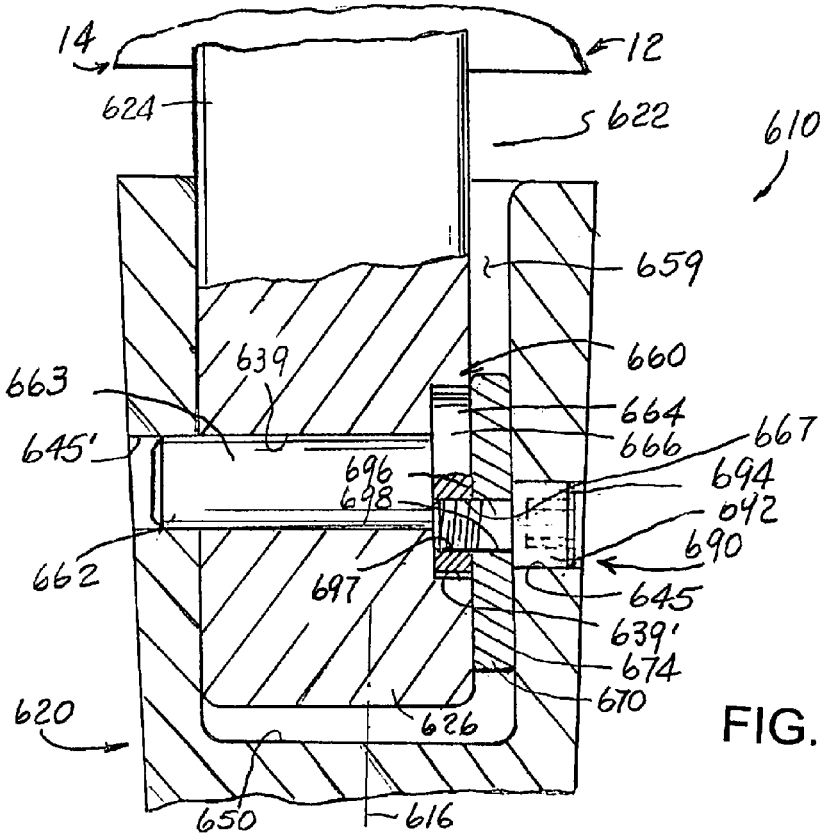

With the relief 659 now being open, and in the embodiment illustrated in FIG. 36, at least a portion of a securement member 670 is inserted into the relief 659 through the opening 680 in the wear member 620 in a direction extending generally normal to the longitudinal axis 616 of the wear assembly 610, as discussed in detail above. When inserted between the confronting exterior surface on the adapter nose portion 626 and the interior surface partially defining the blind cavity 650 opposite from the first terminal end 662 of lock 660, at least a portion of securement member 670 at least partially fills the relief 59, bears against the confronting surfaces on the wear member 620 and adapter nose portion 626, and engages the second terminal end 664 of the lock 660 thereby inhibiting translation of part 620 relative to the adapter nose portion 626 whereby maintaining the first terminal end of the lock 660 position to at least partially project through the opening 645' in part 620 so as to operably couple part. 620 and adapter 622 in operable combination relative to each other while inhibiting longitudinal translation of part 620 relative to the adapter nose portion 626. Preferably, securement member 670 extends in a direction relative to the longitudinal axis 616 of the wear/tooth assembly so as to advantageously avoid operating loads being applied directly thereto during operation of the digging tooth assembly.

In the embodiment illustrated in FIGS. 33 through 36, the second terminal end 664 of the lock 660 is preferably configured with an enlarged head portion 666. The head portion 666 of lock 660 is purposefully sized larger than the cross-section of the recess 639 in the adapter nose portion 626 so as to limit the extent the lock 660 can be inserted within the recess 639 in the adapter nose portion 626. Preferably, and as shown in FIGS. 33 through 36, that exterior surface or side of the adapter nose portion 626 and, more specifically, that end of the recess 639 in the adapter nose portion 626 disposed closest to the second terminal end 664 of the lock 660 is provided with a counterbore 639' which opens to the exterior side of the adapter nose portion Suffice it to say, when lock 660 is assembled to the adapter nose portion 626, the counterbore 639' is sized to releasably accommodate the enlarged head portion 666 of lock 660.

Another form of secondary lock is provided in combination with lock 660 for releasably maintaining member 670 in position between part 620 and the adapter nose portion 626 and for maintaining the lock 660 in position to inhibit inadvertent longitudinal translation of part 620 relative to the adapter nose portion 626. Such an alternative secondary lock arrangement is illustrated by way of example in FIG. 36. This alternative form of secondary lock is designated generally by reference numeral 690.

In that embodiment shown in FIG. 36, the secondary lock 690 is independent of securement member 670 and includes an axially elongated member 692 having an enlarged head portion 694 and a shank portion 696. The distal end of the shank portion 696 of member 692 is preferably provided with external threading thereon. Moreover, in the illustrated example in FIG. 36, the head portion 694 of member 692 is configured to accommodate a tool (not shown) suitable for imparting rotation to member 692 from outside the tooth or wear part 620.

When the wear part 620 and adapter nose portion 626 of assembly 610 are arranged in operable combination relative to each other, with lock 660 in the position shown in FIG. 36, and with the securement member 670 releasably disposed in the position shown in FIG. 36, member 692 of the secondary lock 690 extends endwise through the bore 645 in the side wall or surface 648 of part 620 so as to permit the threaded end of the shank portion 696 of member 692 to be threadably connected, as through threaded opening 697, to the head portion 666 of lock 660. As such, the securement member 670 is maintained in position and secured against inadvertent movement from between part 620 and adapter 622 by the secondary lock 690. In the embodiment illustrated by way of example in FIG. 36, the secondary lock 690 is preferably configured such that, when in the position shown in FIG. 36, the head portion 694 of member 692 is preferably accommodated within the confines defined by the closed margin of the bore 645 on the side wall or surface 648' of part 620 and protected against wear during operation of wear assembly 10.

Figure 37:
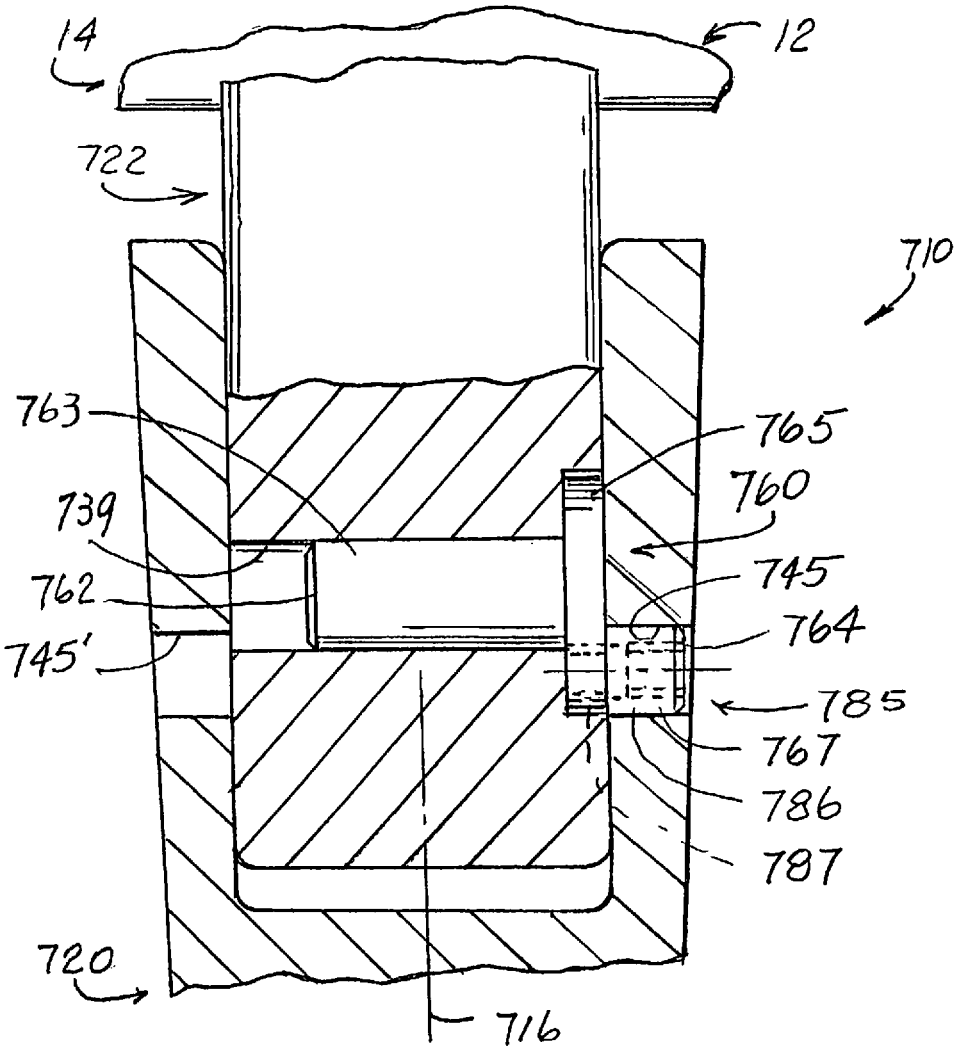
FIG. 37 is another alternative form of lock design for releasably coupling a wear member to a nose portion of an adapter.

Still another alternative lock design for releasably maintaining a wear part and adapter nose portion of a multipiece tooth assembly in operable combination relative to each other is illustrated in FIG. 37. The elements of this alternative assembly which are functionally analogous to those components or elements discussed above regarding assembly 10 are designated by reference numerals identical to those listed above with the exception the elements of this alternative multipiece assembly uses reference numerals in the 700 series.

The multipiece assembly shown in FIG. 37 has a longitudinal axis 716 and includes a replaceable wear part 720 and an adapter or support 722. In the illustrated embodiment, the replaceable wear part 720 is configured as a tooth. As mentioned, however, the wear part of assembly 720 can take a myriad of different designs other than a tooth, i.e., a ripper, lip shroud, wear cap, etc. without detracting or departing from the spirit and scope of this invention disclosure.

In the exemplary embodiment illustrated in FIG. 37, the replaceable part/tooth 720 has a longitudinally elongated wedge shape similar to that shown by way of example in FIG. 3 and is defined by a series of interconnected exterior surfaces or walls between a forward end and a rear end thereof. As mentioned above, the outer configuration of part 720 can take a myriad of designs without detracting or departing from the spirit and scope of this disclosure.

As discussed above regarding assembly 10, and as shown in FIG. 37, wear part 720 defines a rearwardly opening blind cavity or socket 750 extending generally parallel to the longitudinal axis 716 of assembly 710 for longitudinally receiving and accommodating at least a lengthwise section of an adapter nose portion 726 by relative longitudinal movement or translation. The blind cavity 750 defined by part 720 has a predetermined configuration defined by a pair of opposed and spaced interior top and bottom surfaces separated by a predetermined distance and a pair of side surfaces extending between the top and bottom surfaces. The wear part/tooth 720 further defines first and second bores 745 and 745', respectively, which open to opposed exterior surfaces or sides of the wear part 720 and to cavity 750. Preferably, each bore 745, 745' has a closed marginal edge.

As mentioned above regarding assembly 10, the adapter 722 of assembly 710 includes a base portion 724 for allowing assembly 710 to be connected to an edge or lip 12 of a bucket or digging implement 14 through any suitable and well known means and a nose portion 726. Suffice it to say, the configuration of the adapter nose portion 726 illustrated by way of example in FIG. 37 is such that it permits the adapter nose portion 726 to be longitudinally received and accommodated within the socket 750 defined by the wear member 720. Suffice it to say, the configuration of the adapter nose portion 726 is predetermined and is defined by a series of interconnected outer surfaces and is closely sized relative to the inner configuration of cavity 750 defined by part 720 such that, and, with the exception of standard clearances, there is a limited gap or clearance between exterior surfaces of the adapter nose portion 726 and interior surfaces of the blind cavity 750 when the tooth 720 and adapter nose portion 726 are arranged in operative relation relative to each other.

An alternative lock design, generally designed in FIG. 37 by reference numeral 760, is provided in operable combination with assembly 710 for releasably maintaining the wear part 720 and adapter nose portion 726 in operative relation relative to each other. The alternative lock design illustrated in FIG. 37 is at least partially arranged within the recess 739 defined by the adapter nose portion 726. Lock 760 has first and second terminal and axially aligned ends 762 and 764, respectively. In one form, the ends 762 and 764 are axially separated by a distance shorter than the predetermined distance separating two opposed exterior surfaces partially defining the cavity 750 in part 720. In the illustrated embodiment, and between the two ends 762 and 764, lock 760 includes a body portion 763, an enlarged head portion 765, preferably formed integral with body portion 763, and a axial projection 767 extending from and releasably connected to the head portion 765.

In one form, the body portion 763 of lock 760 has a cross-sectional configuration similar to that of the recess 739 in the adapter nose portion 726. It will be appreciated, however, the body portion 763 of lock 760 can have any suitable configuration allowing the first end 762 to be inserted within the recess 739 of the adapter nose portion 726 without detracting or departing from the spirit and scope of this invention disclosure. The enlarged head portion 765 of lock 760 limits the extent to which the first end 762 of lock 760 can be inserted within the recess 726 in the adapter nose portion 726. The second terminal end 764 of the lock 760 is sized to be removably accommodated within either bore 745 or 745' defined by the wear part 720.

As shown schematically in FIG. 37, after inserting the body portion 763 into the recess 739 in the adapter nose portion 726, without the axial projection 767 being connected to the head portion 765, the wear part 720 can be longitudinally assembled to the adapter nose portion 726. After the wear part 720 and adapter nose portion 726 are arranged in operative combination relative to each other, the axial projection 767 is assembled to the remainder of lock 760 through that bore 745, 745' in part 720 20 arranged adjacent to the head portion 765 of lock 760.

In the embodiment shown by way of example in FIG. 37, the axial projection 767 is formed independent of the head portion 765 and includes an axially elongated member 785 having an enlarged head portion 786 and a shank portion 787. One end of the axial projection 767 of lock 760 is preferably provided with external threading thereon. Moreover, in the illustrated example in FIG. 37, the opposed end of the axial projection 767 of member 760 is configured to accommodate a tool (not shown) suitable for imparting rotation to projection 767 from outside the tooth or wear part 720.

When the body portion 763 and head portion 765 lock 760 are disposed in the position shown in FIG. 37, the axial projection 767 is adapted to extends or project outward from head portion 765 of lock 760 through the bore 745, 745' in the wear part 720. In the embodiment illustrated by way of example in FIG. 37, a portion of the axial projection 767 is accommodated within the confines defined by the closed margin of the bore 745, 745' defined by part 720 whereby limiting longitudinal translation of the wear part 720 relative to the adapter nose portion 726. Moreover, and because a portion of the axial projection 767 is advantageously accommodated within the closed margin of the bore 745, 475' the axial projection 767 is protected against wear during operation of assembly 710.

As mentioned, the secondary lock for maintaining the securement member in an operable position between the wear part and the adapter nose portion can take varied configurations without detracting or departing from the spirit and scope of the present disclosure. In this regard, another alternative secondary lock arrangement is illustrated by way of example in FIGS. 38 through 46. The alternative form of secondary lock shown in FIGS. 38 through 46 is designated generally by reference numeral 890 and is in operable combination with a multipiece wear assembly similar to that shown in FIGS. 1 through 6. That is, the multipiece wear assembly wherein this alternative secondary lock is shown includes a wear part similar to wear part 20 discussed above and an adapter having a nose portion similar to the adapter nose portion 26 discussed above. As such, and as discussed above, a relief or space 59 opening to the rear of the tooth/wear part 20 is provided between the wear part 20 and adapter nose portion 26. Notably, however, this alternative embodiment for the second lock 890 advantageously does not require the nose portion 26 to have a bore, similar to bore 39 discussed above, extending therethrough whereby adding strength and rigidity to the wear assembly while reducing the parts required for the wear assembly and, thus, decreasing manufacturing cots and, ultimately, costs to the end user. The wear part/tooth and the adapter nose portion of the assembly shown in FIGS. 38 through 46 are maintained in releasable combination relative to each other by a suitable lock design generally designated in FIG. 37 by reference numeral 860 but could take other designs (see FIGS. 4, 5, 6 and 7) without detracting or departing from the spirit and scope of this invention disclosure.

Figure 38:
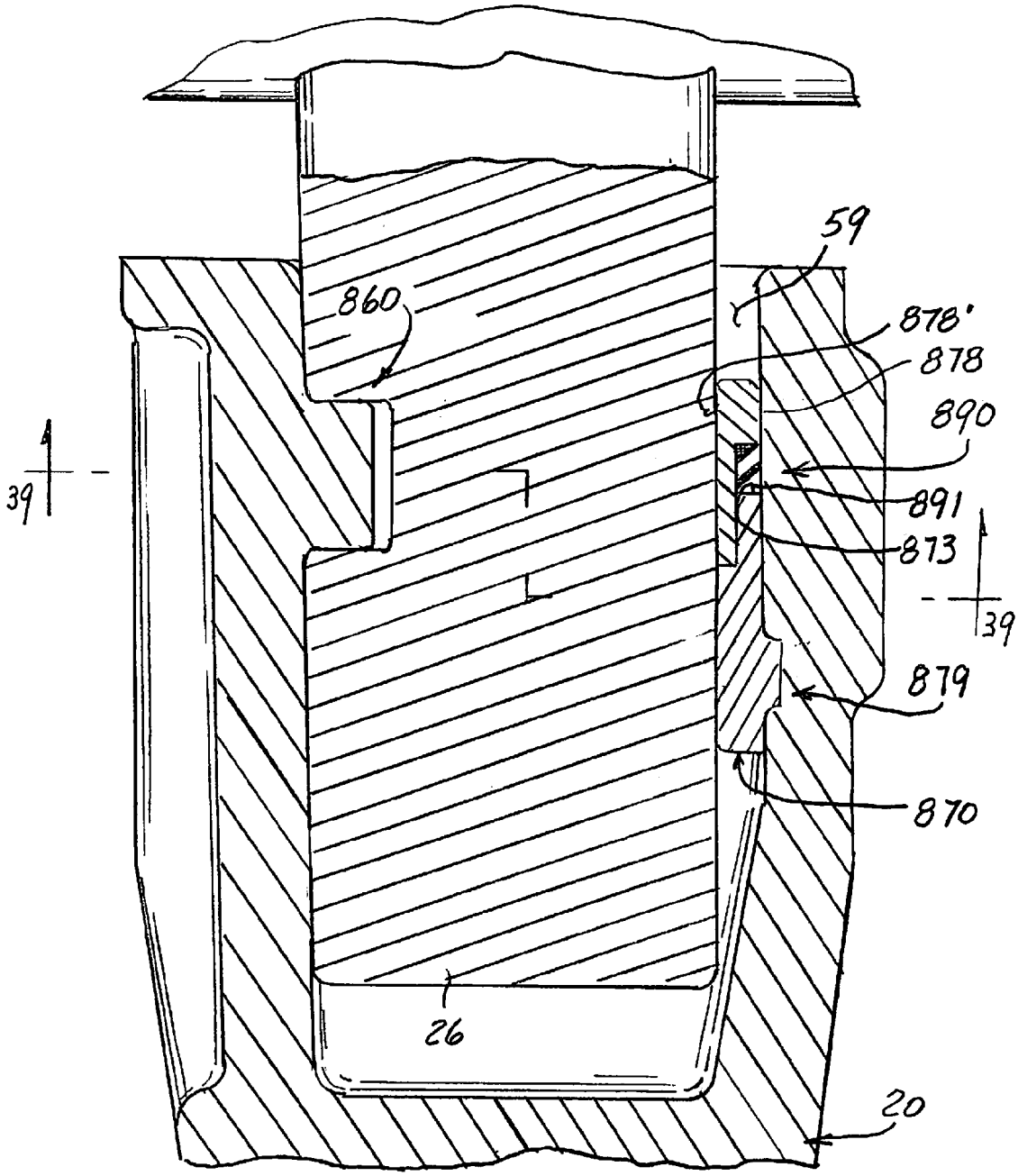
FIG. 38 is a sectional view similar to FIG. 4 showing another alternative secondary lock for use in combination with this invention disclosure.
Figure 39:
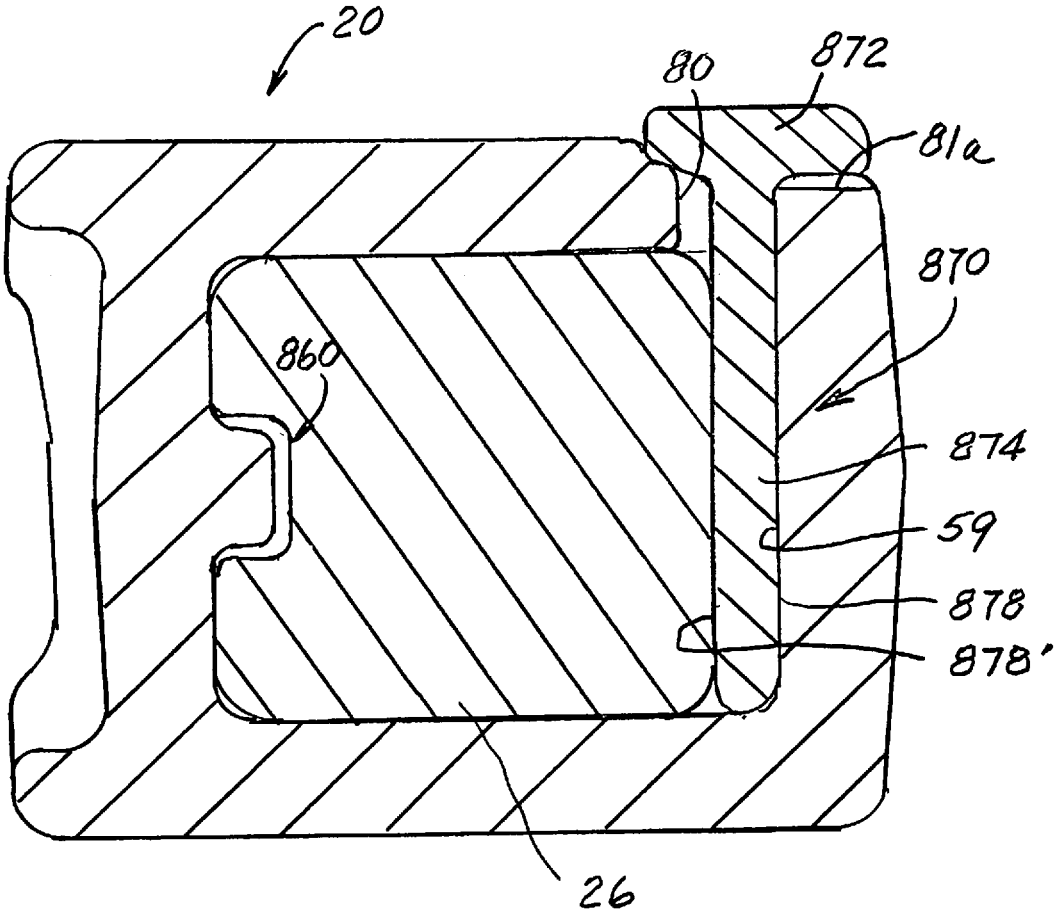
FIG. 39 is a sectional view taken along line 39-39 of FIG. 38.

In accordance with this aspect of the present disclosure, the multipiece wear assembly is furthermore provided with a unitary spacer or securement member generally designated in FIGS. 38 through 46 by reference numeral 870. Securement member 870 functions similar to securement member 70 discussed above. As shown in FIG. 39, and after the part/tooth is arranged in operable combination with the adapter nose portion, at least a portion of the securement member 870 is insertable through an opening 80 defined in the wear part/tooth and into the relief or space 59. As shown in FIG. 12, the tooth/wear part 20 defines a marginal edge for the opening 80 including fore- and aft edges or surfaces 85 and 86, respectively. At least a portion of the securement member 870 is insertable through the opening 80 (FIG. 39) and between the confronting surfaces on the adapter nose portion 26 and tooth cavity 50 so as to at least partially fill the relief 59, bear against confronting surfaces on the adapter nose portion 26 and tooth cavity 50 opposite from the lock 860 while positively and releasably maintaining the lock 860 in an operative position to releasably maintain the adapter nose portion and wear part in operable combination and inhibit longitudinal translation of the wear part relative to the adapter nose portion as long as the securement member is inserted therebetween. By this design, securement member 870 extends in a direction generally normal relative to the longitudinal axis of the wear assembly so as to advantageously avoid operating loads being applied directly thereto during operation of the wear assembly.

In the form shown in FIGS. 40 through 43, securement member or spacer 870 includes an enlarged head portion 872 and a shank portion 874. Member 870 is preferably formed from metal, i.e. steel or other suitable material or non-compressible metal alloy. The head portion 872 is preferably configured to limit the extent to which member 870 is insertable into the relief 59. In the illustrated form shown in FIG. 43, the exposed section of the head portion 872 of member 870 compliments the profile of wear part 20 to promote movement of material therepast.

As shown in FIGS. 39 and 46, the shank portion 874 of member 870 preferably includes two laterally spaced and generally parallel sides 878 and 878'. Notably, the distance between the sides 878 and 878' of as well as the configuration of the shank portion 874 can change from one securement member to another depending upon the particular tooth socket and adapter nose portion combination or conjuncture into which the member 870 is to be inserted. As such, securement member 870 is modular in nature. In one embodiment, tolerances of the shank portion 874 of member 870 are controlled by the difference between the predetermined distance between the cross-section of socket 50 and the cross-section of the adapter nose portion 26. Thus, the combination of lock 60 with the securement member 870 allows the system of this invention disclosure to be used on scores of other manufacturers' adapters, even though the tolerances of those other manufacturers' adapters are not ascertainable with exacting certainty.

As shown in FIG. 39, the shank portion 874 of member 870 preferably has an arcuate configuration between the free distal thereof and where it joins to the head portion 872. Preferably, and after the adapter nose portion 26 is arranged in operable combination with wear part 20, the shank portion 874 of member 870 preferably extends across substantially an entire side of the adapter nose portion 26 after member 870 is fully inserted into an operational position whereby furthermore reducing stress concentrations during operation of the wear assembly.

In the embodiment shown in FIG. 40, the securement member 870 has fore-and-aft spaced generally arcuate and radially spaced first and second surfaces 875 and 876, respectively, extending at least the majority and preferably the entire length of the shank portion 874 of member 870. Preferably, the fore- and aft spacing or distance between the generally arcuate surfaces 875 and 876 at the distal end of the shank portion 874 of member 870 is equal to or less than the fore- and after distance between the surfaces or edges 85 and 86, respectively, defined by the marginal edge of the opening 80 (FIG. 43). In a preferred embodiment, and for reasons discussed below, the fore- and aft distance between the generally arcuate surfaces 875 and 876 at an upper end of member 870 is greater than the fore- and aft distance between the surfaces or edges 85 and 86 (FIG. 43), respectively, defined by the marginal edge of opening 80.

In the form shown in FIGS. 38 and 43, the interior surface of the cavity defined by the wear part/tooth and the securement member 870 preferably have a key and keyway design, generally identified by reference numeral 879. Preferably, the key and keyway design 879 are similar to the key and keyway design 79 discussed in detail above. Such design advantageously allows securement member 870 to interact with the wear part so as to guide insertion of the member 870 into operable combination with the wear part while preferably limiting the direction securement member 870 can be correctly inserted into operable combination with the wear part and the adapter nose portion. Moreover, the configuration of such key and keyway design preferably compliments the arcuate configuration of the shank portion 874 of member 870 and advantageously limits the direction which member 870 can be correctly inserted into operable combination with and between the wear part and adapter nose portion.

In the illustrated embodiment, securement member 870 is of multipiece construction. That is, the securement member 870 includes a first preferably metal piece 871 and a second preferably metal piece 871' which are joined or operably held together by the secondary lock 890. In one form, the first piece 871 is configured to include part of the keyway design 879 discussed above. More specifically, in the design shown by way of example in FIG. 40, the first piece 871 of securement member 870 includes the first and second radially spaced arcuate surfaces 875 and 876, respectively. As such, the first piece 871 operably connects the securement member 870 to the wear part/tooth as through the key and keyway design 879. The second piece 871' constitutes the remainder of the securement member 870.

According to this aspect of the invention disclosure, the secondary lock 890 comprises an elastomeric member or rubber spring 891 which is vulcanized or otherwise operably secured between the part 871 and 871' comprising securement member 870. As such, the two pieces 871 and 871' are compressible toward each other when squeezed through the opening 80 in the wear part of the multipiece wear assembly.

In the form shown in FIG. 40, a generally vertical V-shaped slot or channel 873 is preferably provided between the first and second parts 871 and 871' of securement member 870. The wedge shaped slot or channel 873 provided between the pieces 871 and 871' of securement member 870 is substantially filled by the elastomeric member or rubber spring 891 which is vulcanized or otherwise operably secured between the part 871 and 871'. As will be understood, the purpose of the elastomeric member or rubber spring 891 is to maintain the first and second parts 871 and 871' in operably connected relation while also resiliently urging the members or pieces 871 and 871' away or apart from each other. As shown schematically in FIG. 40, dash line 893 represents the compression radius of the second piece 871' of securement member 870. To affect such desirous ends, the generally vertical V-shaped slot or channel 873 is wider toward an upper end of the securement member 870 than toward a lower edge thereof. In one form, the generally vertical V-shaped slot or channel 873 preferably has an included angle θ of about 3 degrees to about 8 degrees between the parts 871 and 871'. In a most preferred embodiment, the generally vertical V-shaped slot or channel 873 has an included angle θ of about 5 degrees between the parts 871 and 871'. The elastomeric member or rubber spring 891 operably provided between the pieces or parts 871 and 871' of securement member 870 preferably has a Shore D durometer hardness ranging between about 35 and about 70.

Turning to FIGS. 40, 41, 43 and 44, the securement member 870 is preferably provided with an open-ended notch or relief 877 toward an upper end of the second surface of piece 871' of member 870. The open-ended notch or relief 877 preferably has a radial or arcuate surface configuration which is less than the radial configuration of the arcuate surface 876 on member 870. As such, member 870 defines a shoulder 879 displaced from an upper surface of the securement member 870 by a distance generally equal to the thickness of the wear part wall through which opening 80 extends. In operation, and when the securement member 870 is fully inserted into operable combination between the wear part and adapter nose portion, and under the influence of the second lock 890, the shoulder 879 underlies that portion of the interior surface of the tooth cavity through which opening 80 extends whereby inhibiting inadvertent displacement of the securement member 870 during operation of the multipiece wear assembly As shown in FIGS. 45 through 47, the parts or pieces 871 and 871' of securement member 870 are also preferably and movably joined to each other as through interlocking instrumentalities 875. The purpose of the interlocking instrumentalities 875 is to limit shear forces on the confronting faces of members 871 and 871' joined to each other by the elastomeric member or rubber spring 891 when the securement member 870 is being inserted and/or removed from between the wear part and adapter nose portion. In one form, the interlocking instrumentalities 875 includes a tongue and groove design. That is, and intermediate the upper and lower ends thereof, member or piece 871' of securement member 870 includes a tongue 876 which projects toward and into a complimentary open-sided channel or groove 878 defined by member or piece 871 of securement member 870. So as limit interference with movement of the pieces 871, 871' relative to each other, the tongue 876 and groove 878 have a complimentary arcuate configurations whereby readily permitting movement of the pieces 871, 871' relative to each other. As such, vertical forces directed against either member or piece 871, 871 of securement member 870 is transferred to and through the interlocking instrumentalities 875 to the other piece or member 871, 871' of securement member 870. Of course, and with only slight design modifications, the tongue and groove design of the interlocking instrumentalities 875 can be reversed without detracting or departing from the spirit and scope of this invention disclosure. In such an alternative design, the tongue can be provided on piece or member 871 securement member 870 so as to project toward and into a complimentary open-sided channel or groove defined by member or piece 871' to accomplish the same desired result discussed above. Other alternative designs for the interlocking instrumentalities 875 can also be provided without detracting or departing from the broad spirit and scope of this invention disclosure.

In the embodiment illustrated in FIG. 43, the opening 81 defined by the bottom wall of the wear member or tooth 20 permits passage of a suitably shaped tool T therethrough so as to engage and push upwardly against either part or piece 871, 871' of securement member 870 (as described above regarding member 70) whereby facilitating removal of securement member 870, when required or desired, from the space or relief 59 (FIGS. 38 and 39) between wear part and the adapter nose portion to effect repair/replacement of the wear part 20. Passage of tool T through such opening will cause vertical displacement of the member 870 through the opening 80 in the wear part. Only after member 870 is removed from between part and adapter nose portion can the wear part be shifted whereby releasing the lock from inhibiting longitudinal translation between the wear part and the adapter nose portion.

As shown in FIG. 39, when securement member 870 is fully inserted into operable combination with the wear part and the adapter nose portion, a section of the head portion 872 of member 870 overlies and is arranged in confronting relation relative to a section on the wear part. A suitable slot or other suitably shaped recess 81*a* preferably extends to the exterior of wear part 20 from a marginal edge of the opening 80. Besides those steps mentioned above for effecting release of member 870 from engagement with wear part and the adapter nose portion, such suitably shaped slot or groove allows a suitably shaped tool (not shown) to be inserted between the head portion 872 of member 870 and that section of wear part arranged in confronting relation relative thereto to effect separation between member 870 and wear part to effect release of the member 870 and thereby allow the wear member to be separated from the adapter nose portion. Other configuration including grooves or slots can also be provided on the head portion 872 of securement member 870 to facilitate removal of the securement member from between the wear part and adapter nose portion when required and/or desired.

Figure 48:
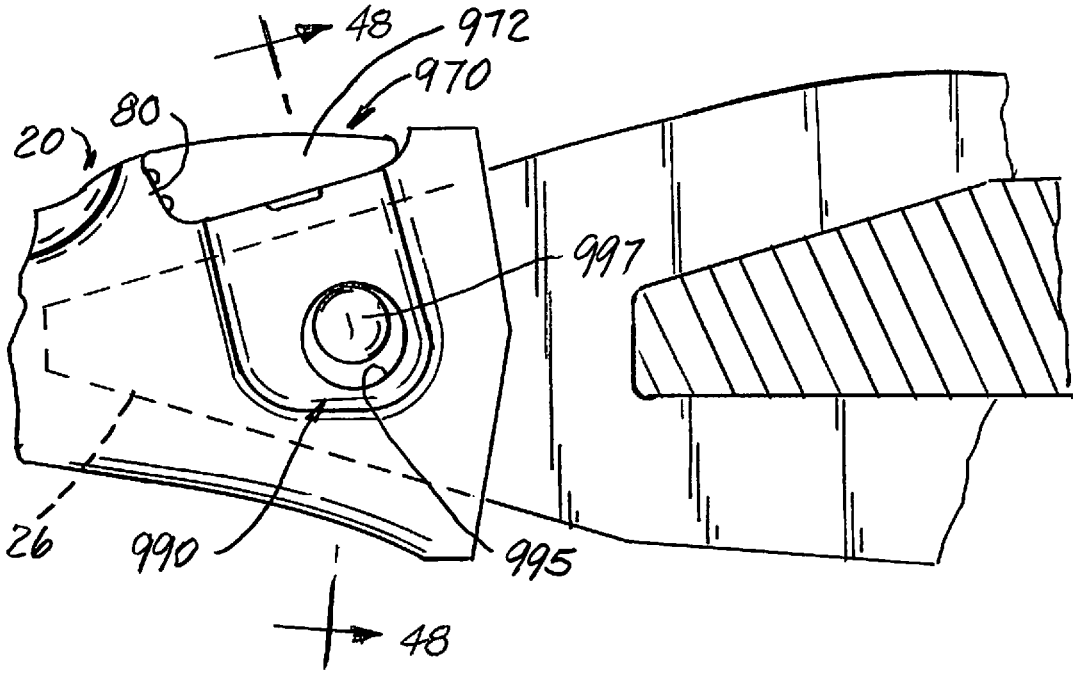
FIG. 48 is a fragmentary view similar to FIG. 3 showing another alternative embodiment of a secondary lock.
Figure 49:
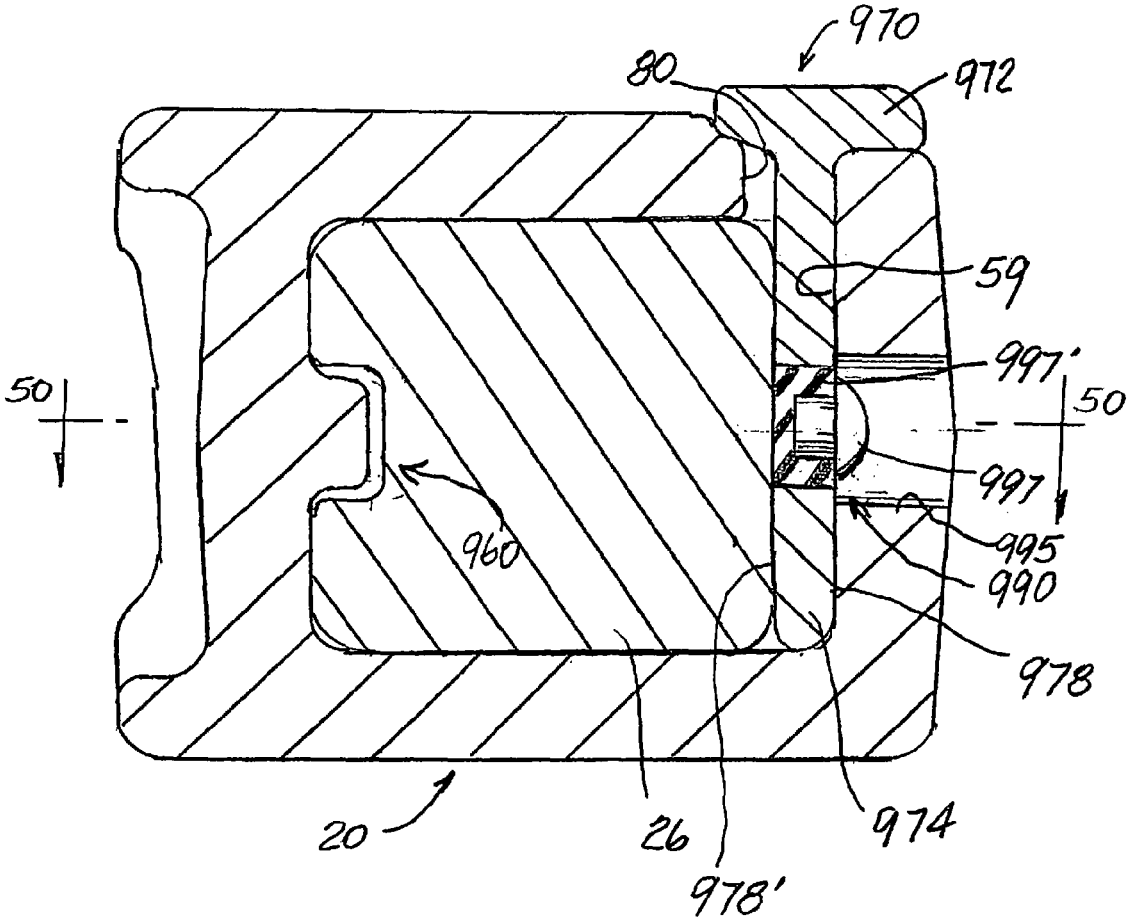
FIG. 49 is a sectional view taken along line 49-49 of FIG. 48.
Figure 50:
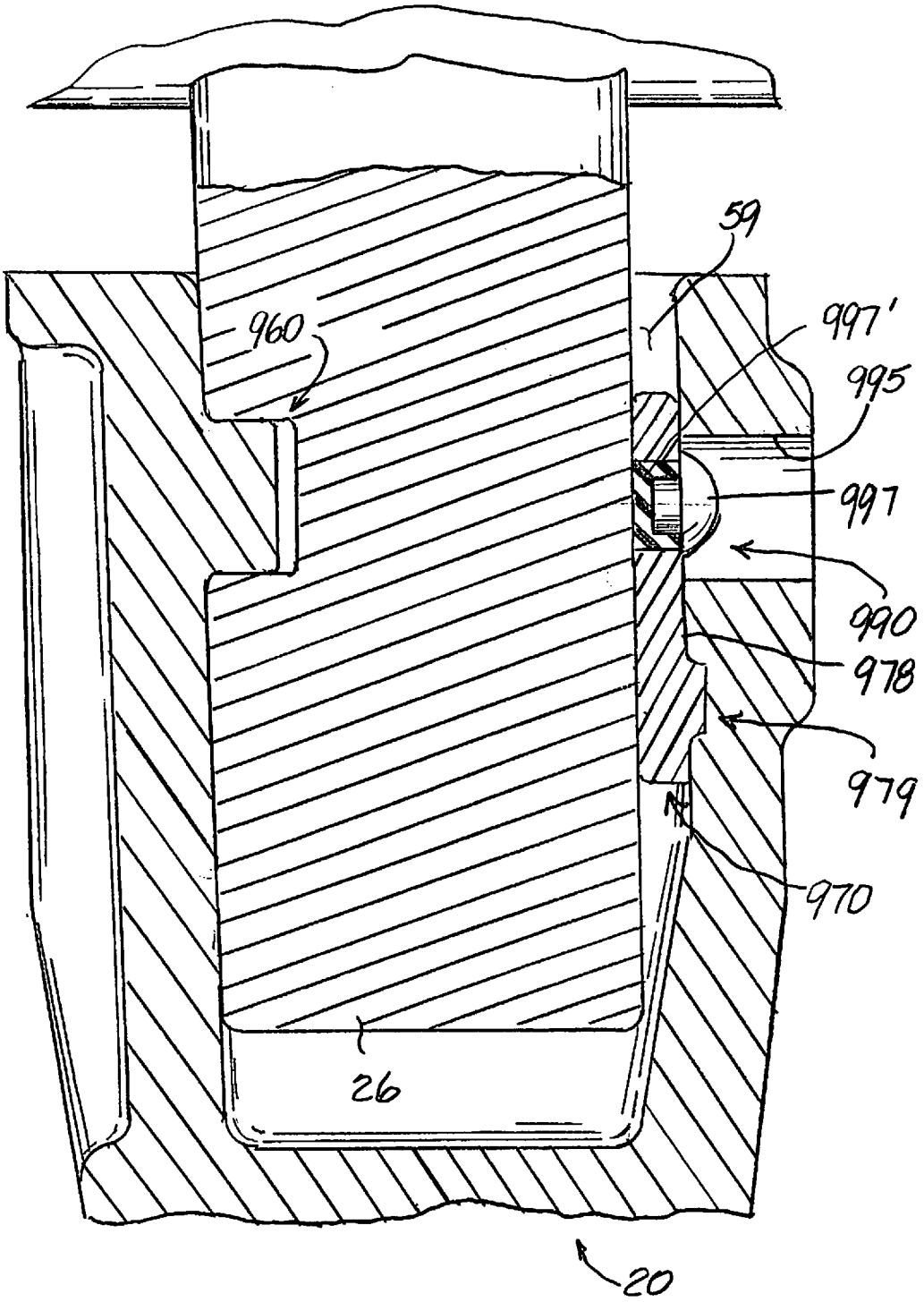
FIG. 50 is a sectional view taken along line 50-50 of FIG. 49.

Yet another secondary lock for maintaining the securement member in an operable position between the wear part and the adapter nose portion is shown by way of example in FIGS. 48 through 50. This alternative form of secondary lock is designated generally by reference numeral 990 and is in operable combination with a multipiece wear assembly similar to that shown in FIGS. 18, 19 and 20. That is, the multipiece wear assembly wherein this alternative version of secondary lock is shown includes a wear part similar to wear part 20 discussed above and an adapter having a nose portion similar to the adapter nose portion 26 discussed above. As such, and as discussed above, a relief or space 59 opening to the rear of the tooth/wear part 20 is provided between the wear part 20 and adapter nose portion 26. Notably, however, this alternative embodiment for the second lock 990 advantageously does not require the nose portion 26 to have a bore, similar to bore 39 discussed above, extending therethrough or otherwise provided therein whereby adding strength and rigidity to the wear assembly while reducing the parts required for the wear assembly and, thus, decreasing manufacturing cots and, ultimately, costs to the end user. Notably, in this embodiment, the wear part of the multipiece assembly includes an opening or bore 995 similar to the bore 195 illustrated by way of example in FIG. 20. The opening or bore 995 has a closed marginal edge defined by the wear part. Moreover, the wear part/tooth and the adapter nose portion of the assembly shown in FIGS. 48 through 50 are maintained in releasable combination relative to each other by a suitable lock design generally designated by reference numeral 960. It will be appreciated, however, lock 960 could take other designs (see FIGS. 4, 5, 6 and 7) without detracting or departing from the spirit and scope of this invention disclosure.

In accordance with this aspect of the present disclosure, the multipiece wear assembly is furthermore provided with a spacer or securement member generally designated in FIGS. 48 through 50 by reference numeral 970. Securement member 970 functions similar to securement member 70 discussed above. That is, and after the wear part/tooth is arranged in operable combination with the adapter nose portion, at least a portion of the securement member 970 is insertable through an opening 80 (FIG. 48) defined in the wear part/tooth and into the relief or space 59 (FIG. 49) so as to at least partially fill the relief 59, bear against confronting surfaces on the adapter nose portion 26 and tooth cavity 50 opposite from the lock 960 while positively and releasably maintaining the lock 960 in an operative position to releasably maintain the adapter nose portion and wear part in operable combination and inhibit longitudinal translation of the wear part relative to the adapter nose portion as long as the securement member is inserted therebetween. By this design, securement member 970 extends in a direction generally normal relative to the longitudinal axis of the wear assembly so as to advantageously avoid operating loads being applied directly thereto during operation of the wear assembly.

In the form shown in FIG. 49, the securement member or spacer 970 includes an enlarged head portion 972 and a shank portion 974. Member 970 is preferably formed from metal, i.e. steel or other suitable material or non-compressible metal alloy. The head portion 972 is preferably configured to limit the extent to which member 970 is insertable into the relief 59. In the illustrated form shown in FIG. 48, the exposed section of the head portion 972 of member 970 compliments the profile of wear part 20 to promote movement of material therepast.

As shown in FIG. 49, the shank portion 974 of member 970 preferably includes two laterally spaced and generally parallel sides 978 and 978'. Notably, the distance between the sides 978 and 978' of as well as the configuration of the shank portion 974 can change from one securement member to another depending upon the particular tooth socket and adapter nose portion combination or conjuncture into which the member 970 is to be inserted. As such, securement member 970 is preferably modular in nature.

In one embodiment, tolerances of the shank portion 974 of member 970 are controlled by the difference between the predetermined distance between the configuration of socket 50 and the configuration of the adapter nose portion 26. Thus, the combination of lock 960 with the securement member 970 allows the system of this invention disclosure to be used on scores of other manufacturers' adapters, even though the tolerances of those other manufacturers' adapters are not ascertainable with exacting certainty.

As in the earlier described embodiments, the shank portion 974 of member 970 preferably has an arcuate configuration between the free distal thereof and where it joins to the head portion 972. Preferably, and after the adapter nose portion 26 is arranged in operable combination with wear part 20, shank portion 974 of member 970 preferably extends across substantially an entire side of the adapter nose portion 26 after member 970 is fully inserted into an operational position whereby furthermore reducing stress concentrations during operation of the wear assembly.

In the form shown in FIG. 50, the interior surface of the cavity defined by the wear part/tooth and the securement member 970 preferably have a key and keyway design, generally identified by reference numeral 979. Preferably, the key and keyway design 879 are similar to the key and keyway design 79 discussed in detail above. Such design advantageously allows securement member 970 to interact with the wear part so as to guide insertion of the member 970 into operable combination with the wear part while preferably limiting the direction securement member 970 can be correctly inserted into operable combination with the wear part and the adapter nose portion. Moreover, the configuration of such key and keyway design preferably compliments the arcuate configuration of the shank portion 974 of member 970 and advantageously limits the direction which member 970 can be correctly inserted into operable combination with and between the wear part and adapter nose portion.

According to this aspect of the invention disclosure, the secondary lock 990 comprises a resiliently biased detent or projection 997 laterally extending from side 978 of the shank portion 974 of securement member 970 toward that interior surface of the cavity defining the opening or bore 995. That is, the detent 997 is adapted to be arranged in confronting relation relative to that interior surface of the tooth cavity when member 970 is inserted into the space 59 between the adapter nose portion 26 and tooth 20. Preferably, the exposed end of the detent 997 has a button-like configuration which is aligned with and sized relative to the inner diameter of the bore 995. An opposed end of detent 997 is captured and carried by the securement member 970 and operates under the influence of a resilient elastomer 997' situated within a bore in the securement member. As shown in FIGS. 49 and 50, the end of detent 997 opposite from its free end is preferably embedded within and heal by the elastomer 997'. Preferably, the elastomer 997' has a Shore D durometer hardness ranging between about 35 and about 70.

When member 970 is first inserted through the opening 80 in the tooth wall 44 into the relief or space 59 between the tooth 20 and adapter nose portion 26, the outer or exposed configuration of the resilient detent 997 allows it to engage with the interior surface or wall of the tooth cavity whereby forcibly causing the detent 997 to retract toward member 970 and thereby compress the elastomer 997'. After the securement member 970 is fully inserted into the relief or space 59 between tooth 20 and adapter nose portion 26 (FIG. 49), and the detent 997 aligns with the opening or bore 995 in the wear part, the resiliency of elastomer 997 causes the detent 997 to snap or otherwise spring into the bore or opening 995 in the wear part under the influence of the resilient member 997' such that the detent 997 thereafter cooperates with the interior diameter of the bore or opening 995 to inhibit inadvertent displacement of the securement member 970 from between the wear part and adapter nose portion.

With the present invention disclosure, variances between the size and configuration of the socket defined by the wear part and the adapter nose portion are readily tolerated and accepted. The simple design proposed by the present disclosure advantageously yields possibilities which have heretofore been unknown by those skilled in the art. That is, by using modular locks insertable between the tooth and adapter nose portion in a direction extending generally perpendicular to the longitudinal axis of the tooth assembly and having different shank portion designs, teeth manufactured, sold and distributed by different manufacturers can be used in combination with either new adapters manufactured, sold and distributed by other manufacturers or that existing population of adapters already existing in the field. Accordingly, an operator is not necessarily required to always return to the original equipment manufacturer for replacement parts only because no one else can provide parts for the particular model tooth/adapter combination being used by that operator. Instead, and with the present invention disclosure, the operator merely selects a modular lock which will accommodate the size variances between the tooth socket and adapter nose portion of the particular parts whereby opening a realm of possibilities which have been heretofore unknown.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A multipiece wear assembly for a digging implement, with said multipiece wear assembly having a longitudinal axis, and comprises:

an adapter with a nose portion having a series of exterior surfaces joined to each other and which combine to define a first predetermined configuration for the nose portion of said adapter;

a wear part assembled onto the nose portion of said adapter by relative longitudinal movement, said wear part having top and bottom exterior walls and defines a blind cavity opening to a rear of said wear part, with said blind cavity having a second predetermined configuration defined by a series of interior surfaces which are separated from each other, with the configuration defined by the exterior surfaces of said blind cavity being greater than the configuration of the adapter nose portion;

a free-ended lock extending generally normal to the longitudinal axis of said wear assembly and from one of the exterior surfaces on the nose portion of said adapter, with said free-ended lock being formed integral with the nose portion of said adapter and extends into a first recess defined by said wear part after said wear part and adapter nose portion are longitudinally assembled in operable combination relative to each other; and a securement member insertable between and in bearing contact with an exterior surface of the adapter nose portion and an adjacent interior surface defining the blind cavity in the wear part opposite from said lock such that said securement member positively and releasably maintains the lock extending from the adapter within the first recess in the wear part so as to releasably maintain said adapter nose portion and wear part in operable combination as long as said securement member is inserted between the wear part and the nose portion of said adapter.

2. The multipiece wear assembly according to claim 1 wherein a portion of said securement member has opposed and generally parallel sides.

3. The multipiece wear assembly according to claim 2 wherein said securement member further includes an enlarged head portion for limiting the extent to which said securement member is insertable into said wear part.

4. The multipiece wear assembly according to claim 3 wherein the enlarged head portion of said securement is configured to facilitate purposeful removal of said securement member from operable combination with the wear part and the adapter nose portion so as to permit replacement of said wear part.

5. The multipiece wear assembly according to claim 2 wherein one of the sides of said securement member and a confronting surface partially defining the blind cavity on said wear part has a key projecting therefrom, and wherein one of the sides of said securement member and a confronting surface defining the blind cavity in said wear part defines a keyway for slidably accommodating said key when said securement member is inserted into operable combination with said wear part and adapter nose portion.

6. The multipiece wear assembly according to claim 5, wherein said key and said keyway on said securement member and the confronting surface partially defining the blind cavity each has an arcuate configuration and includes first and second radial edges configured such that when forces act against said securement member during operation of said multipiece wear assembly said securement member is held against endwise separation from between the adapter nose portion and said wear part.

7. The multipiece wear assembly according to claim 6, wherein the first and second radial edges on each of said key and said keyway on said securement member and the confronting surface partially defining the blind cavity each have a common vertex, with said common vertex being disposed in offset relation from the longitudinal axis of said multipiece wear assembly.

8. The multipiece wear assembly according to claim 1 wherein, said wear part is configured as a digging tooth with top and bottom exterior surfaces converging toward a forward end of said tooth, and wherein the series of separated interior surfaces defining said blind cavity includes top and bottom surfaces and a pair of side surfaces extending between said top and bottom surfaces of said cavity.

9. The multipiece wear assembly according to claim 8 wherein the bottom exterior surface of said digging tooth defines a bore opening to said bottom exterior surface and the blind cavity for accommodating endwise passage of a tool used to facilitate removal of said securement member from between said tooth and the adapter nose portion.

10. The multipiece wear assembly according to claim 1, further including a secondary lock for releasably maintaining said securement member between said wear part and the nose portion of the adapter so as to inhibit shifting movement of said wear part relative to said adapter nose portion.

11. The multipiece wear assembly according to claim 10 wherein the nose portion of said adapter defines a recess which opens to at least one exterior surface of the nose portion of said adapter, and wherein said secondary lock is accommodated in the recess defined by the adapter nose portion and operably cooperates with said securement member to inhibit advertent separation of said securement member from and relative to said wear part and said adapter nose portion thereby maintaining the lock within the recess in the adapter nose portion.

12. The multipiece wear assembly according to claim 10 wherein said secondary lock is provided on said securement member.

13. The multipiece wear assembly according to claim 12 wherein said securement member is of multipiece construction.

14. The multipiece wear assembly according to claim 13 wherein said secondary lock includes a spring arranged in operable combination with said securement member.

15. The multipiece wear assembly according to claim 10 wherein said wear part defines a bore opening to said blind cavity and to an exterior of said wear part, with said wear part defining a closed marginal edge for said bore, and wherein said secondary lock includes a resiliently biased projection carried by said securement member and which combines with the marginal edge of said bore to releasably maintain said securement member between said wear part and the nose portion of the adapter so as to inhibit shifting movement of said wear part relative to said adapter nose portion.

* * * * *